US011097549B2

(12) United States Patent
Nagashima et al.

(10) Patent No.: US 11,097,549 B2
(45) Date of Patent: Aug. 24, 2021

(54) LIQUID CONTAINER

(71) Applicant: SEIKO EPSON CORPORATION, Tokyo (JP)

(72) Inventors: Takumi Nagashima, Matsumoto (JP); Hiroyuki Kawate, Hokuto (JP); Yoshiaki Shimizu, Matsumoto (JP); Akihiro Toya, Shiojiri (JP); Tetsuya Takamoto, Matsumoto (JP); Tadahiro Mizutani, Shiojiri (JP); Hiroyoshi Ozeki, Shiojiri (JP); Manabu Yamaguchi, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 218 days.

(21) Appl. No.: 16/324,005

(22) PCT Filed: Aug. 7, 2017

(86) PCT No.: PCT/JP2017/028561
§ 371 (c)(1),
(2) Date: Feb. 7, 2019

(87) PCT Pub. No.: WO2018/030330
PCT Pub. Date: Feb. 15, 2018

(65) Prior Publication Data

US 2021/0078333 A1 Mar. 18, 2021

(30) Foreign Application Priority Data

Aug. 12, 2016 (JP) ..... JP2016-158443
Oct. 17, 2016 (JP) ..... JP2016-203316

(51) Int. Cl.
*B41J 2/175* (2006.01)

(52) U.S. Cl.
CPC ..... *B41J 2/1752* (2013.01); *B41J 2/17513* (2013.01); *B41J 2002/17516* (2013.01)

(58) Field of Classification Search
None
See application file for complete search history.

(56) References Cited

U.S. PATENT DOCUMENTS 3,952,649 A 4/1976 Dikoff
8,220,909 B2 7/2012 Domae
(Continued)

FOREIGN PATENT DOCUMENTS

CN 1705566 A 12/2005
EP 2 127 884 A2 12/2009
(Continued)

OTHER PUBLICATIONS

Non-Final Office Action dated May 21, 2018 in co-pending U.S. Appl. No. 15/674,948 (14 pgs.).
(Continued)

*Primary Examiner* — Erica S Lin
*Assistant Examiner* — Tracey M McMillion
(74) *Attorney, Agent, or Firm* — Oliff PLC

(57) ABSTRACT

There is provided a technique of improving the mounting position of a liquid container relative to a liquid ejection device. The liquid container configured to be mountable to and dismountable from a case of the liquid ejection device includes a bag-like member that has flexibility and that includes a containing portion provided to contain a liquid inside thereof; and connection member that is located at an end of the bag-like member. The connection member includes a liquid outlet configured such that a liquid introducing element of the liquid ejection device is inserted in the liquid outlet; a container-side electrical connecting structure configured such that a device-side electrical connecting
(Continued)

structure of the liquid ejection device is connected with the container-side electrical connecting structure; and two guided elements configured such that at least respective parts of two guide elements of the case are fitted in the two guided elements in a state that the liquid container is placed in the case. In a mounting state that the liquid container is mounted to the liquid ejection device, the liquid outlet is located between the two guided elements, and the container-side electrical connecting structure is located between one of the two guided elements and the liquid outlet.

15 Claims, 44 Drawing Sheets

(56) References Cited

U.S. PATENT DOCUMENTS

| | | | | |
|---|---|---|---|---|
| 8,385,787 | B2 | 2/2013 | Yamaguchi et al. | |
| 8,591,006 | B2 | 11/2013 | Xiao | |
| 8,608,284 | B2 | 12/2013 | Aoki | |
| 8,864,291 | B2 | 10/2014 | Urabe | |
| 8,926,074 | B2 | 1/2015 | Morino et al. | |
| 8,931,887 | B2 | 1/2015 | Aoki et al. | |
| 9,067,426 | B2 | 6/2015 | Urabe | |
| 9,085,166 | B1 | 7/2015 | Takagiwa | |
| 9,139,013 | B2 | 9/2015 | Nagashima et al. | |
| 9,227,415 | B2 | 1/2016 | Nagashima et al. | |
| 9,346,278 | B2 | 5/2016 | Ishizawa et al. | |
| 9,636,918 | B2 | 5/2017 | Okuno et al. | |
| 2005/0185036 | A1* | 8/2005 | Seino | B41J 2/1752 347/86 |
| 2005/0243148 | A1 | 11/2005 | Miyazawa et al. | |
| 2011/0064478 | A1 | 3/2011 | Yamaguchi et al. | |
| 2012/0056957 | A1 | 3/2012 | Xiao | |
| 2013/0176367 | A1 | 7/2013 | Morino et al. | |
| 2013/0186513 | A1 | 7/2013 | Aoki et al. | |
| 2015/0070445 | A1 | 3/2015 | Kanbe et al. | |
| 2015/0085029 | A1* | 3/2015 | Takahashi | B41J 2/17553 347/86 |
| 2015/0273842 | A1 | 10/2015 | Aoki et al. | |
| 2015/0321481 | A1 | 11/2015 | Ishizawa et al. | |
| 2016/0016411 | A1 | 1/2016 | Kawate et al. | |
| 2016/0067978 | A1 | 3/2016 | Okuno et al. | |
| 2016/0096375 | A1 | 4/2016 | Ozeki | |
| 2016/0101628 | A1* | 4/2016 | Kobayashi | B41J 2/17553 347/86 |
| 2016/0176195 | A1 | 6/2016 | Kawate et al. | |
| 2017/0100940 | A1 | 4/2017 | Ishizawa et al. | |

FOREIGN PATENT DOCUMENTS

| | | | |
|---|---|---|---|
| EP | 2431183 | A1 | 3/2012 |
| EP | 2 803 488 | A2 | 11/2014 |
| JP | H01-133749 | A | 5/1989 |
| JP | 2008-207429 | A | 9/2008 |
| JP | 2009-279876 | A | 12/2009 |
| JP | 2012-053422 | A | 3/2012 |
| JP | 2012-096422 | A | 5/2012 |
| JP | 2014-024349 | A | 2/2014 |
| JP | 2014-240182 | A | 12/2014 |
| JP | 2015-058542 | A | 3/2015 |
| JP | 2016-007786 | A | 1/2016 |
| JP | 2016-022637 | A | 2/2016 |
| JP | 2016-043595 | A | 4/2016 |
| JP | 2016-132135 | A | 7/2016 |
| WO | WO-2013/105504 | A1 | 7/2013 |
| WO | WO-2015/136933 | A1 | 9/2015 |

OTHER PUBLICATIONS

Final Office Action dated Dec. 13, 2018 in co-pending U.S. Appl. No. 15/674,948 (12 pgs.).

International Search Report dated Oct. 10, 2017 in PCT/JP2017/028561 with English-language translation (4 pgs.).

* cited by examiner

LIQUID CONTAINER

FIELD

The present disclosure relates to a liquid container.

BACKGROUND

An ink pack is a known aspect of a liquid container (as described in, for example, Patent Literatures 1 to 3 given below). The ink pack includes a container such as a bag-like member that has flexibility and contains ink, which is to be supplied to an inkjet printer (hereinafter may be simply referred to "printer") that is one aspect of a liquid ejection device. The printer with the ink pack mounted thereto may include a case such as a tray which the ink pack is placed in. In such a printer, the ink pack is placed in the case and is mounted along with the case to the printer. This establishes an ink supply path and an electrical communication path between the ink pack and the printer.

CITATION LIST

Patent Literatures

[Patent Literature 1] JP 2009-279876A
[Patent Literature 2] WO 2013/105504 pamphlet
[Patent Literature 3] JP 2014-240182A

SUMMARY

Technical Problem

It is desirable that the ink pack is mounted at a predetermined appropriate position to the printer. An inappropriate mounting position is likely to fail to establish the ink supply path and the electrical communication path of the printer. This is also likely to provide unstable connection of the ink supply path and unstable connection of the electrical communication path and to deteriorate the connections with elapse of time. Furthermore, this is likely to generate an excessive stress by the contact with a printer-side component in the course of connection with the printer and to damage or deteriorate the ink pack. Various studies have conventionally been made to improve the mounting position of the ink pack to the printer. There is, however, still a room for improvement. This problem is not limited to the ink pack mounted to the printer but is commonly found with regard to a liquid container mounted to a liquid ejection device.

Solution to Problem

The present disclosure may be implemented by aspects described below, in order to solve at least part of the above problems.

[1] According to one aspect of the present disclosure, there is provided a liquid container. This liquid container is mounted to a liquid ejection device. A direction parallel to direction of gravity is defined as a Z direction; a direction of the Z direction that is identical with the direction of gravity is defined as a +Z direction and a direction of the Z direction that is opposite to the direction of gravity is defined as a −Z direction. A direction orthogonal to the Z direction is defined as a Y direction; one direction of the Y direction is defined as a +Y direction and the other direction of the Y direction is defined as a −Y direction. A direction orthogonal to the Z direction and the Y direction is defined as an X direction; one direction of the X direction is defined as a +X direction and the other direction of the X direction is defined as a −X direction.

The liquid ejection device comprises a housing, a case, a liquid introducing element and a device-side electrical connecting structure. The housing includes a case placement unit provided inside thereof. The case is configured to move along the +Y direction to be inserted into the case placement unit. The case includes a bottom surface arranged to face in the −Z direction and two guide elements protruded in the −Z direction from the bottom surface in a state that the case is placed in the case placement unit. The liquid introducing element is located at a +Y direction side end of the case placement unit. The device-side electrical connecting structure is located at the +Y direction side end of the case placement unit.

The liquid container is configured to be mountable to and dismountable from the case. The liquid container includes a bag-like member and a connection member. The bag-like member includes a containing portion provided inside thereof to contain a liquid therein. The connection member is located at a +Y direction side end of the liquid container, in a mounting state that the liquid container is mounted to the liquid ejection device.

The connection member comprises a liquid outlet, a container-side electrical connecting structure and two guided elements. The liquid outlet is configured such that the liquid introducing element is inserted into the liquid outlet in the −Y direction, in the mounting state. The container-side electrical connecting structure is configured such that the device-side electrical connecting structure is connected with the container-side electrical connecting structure in the −Y direction, in the mounting state. The two guided elements are configured such that at least respective parts of the two guide elements are fitted in the two guided elements, in a state that the liquid container is placed in the case.

In the mounting state, the liquid outlet is located between the two guided elements in the X direction, and the container-side electrical connecting structure is located between one of the two guided elements and the liquid outlet.

In the liquid container of this aspect, fitting the two guide elements into the corresponding guided elements stabilizes the location position of the liquid container in the case. This configuration accordingly suppresses deterioration of the location position of the liquid container relative to the liquid ejection device and suppresses deterioration of the connection of the liquid container with the liquid ejection device.

The container-side electrical connecting structure is positioned by the three points, i.e., the two guided elements and the liquid outlet. This configuration suppresses the location position of the liquid container from rotating relative to the device-side electrical connecting structure. This accordingly suppresses reduction of the electrical connectivity between the liquid container and the liquid ejection device and suppresses a useless stress from being generated in a connecting portion of the liquid ejection device and the liquid container, thereby suppressing the connecting portion from being damaged or deteriorated.

[2] In the liquid container of the above aspect, in the mounting state, the two guided elements may be located on the −Y direction side of the container-side electrical connecting structure and the liquid outlet.

In the liquid container of this aspect, the liquid outlet is located at the position away from a virtual straight line of connecting the two guided elements. This configuration further increases the positioning accuracy of the container-side electrical connecting structure by the three points, i.e., the two guided elements and the liquid outlet and further suppresses the location position of the liquid container from rotating relative to the device-side electrical connecting structure.

The liquid outlet and the container-side electrical connecting structure are collectively provided at a position nearer to the +Y direction side end of the connection member. This configuration achieves downsizing of the connection member. This configuration additionally facilitates the connection of the liquid outlet with the liquid introducing element and the connection of the container-side electrical connecting structure with the device-side electrical connecting structure.

[3] In the liquid container of the above aspect, in the mounting state, the containing portion may be located on the −Y direction side of the two guided elements.

In the liquid container of this aspect, the liquid outlet and the container-side electrical connecting structure are located at positions away from the containing portion of the bag-like member across the two guided elements. The support of the respective guide elements fitted in the corresponding guided elements suppresses a change in location position of the bag-like member from affecting a connecting portion between the liquid outlet and the liquid introducing element and a connecting portion between the container-side electrical connecting structure and the device-side electrical connecting structure. This accordingly suppresses the stress from being continuously generated in these connecting portions and suppresses, for example, deformation and deterioration of the connection-involved components.

[4] In the liquid container of the above aspect, the container-side electrical connecting structure may have a terminal portion that electrically comes into contact with the device-side electrical connecting structure. The terminal portion may be located on the +Z direction side of respective −Z direction side ends of the two guide elements and may be pressed in at least the +Z direction by the device-side electrical connecting structure, in the mounting state.

In the liquid container of this aspect, fitting the guide elements in the corresponding guided elements suppresses the location position of the connection member from rotating in the +Z direction due to pressing the terminal portion by the device-side electrical connecting structure.

[5] In the liquid container of the above aspect, the liquid ejection device may have two positioning elements that are provided in the case placement unit and that are extended from a +Y direction side end toward a −Y direction side end of the case placement unit. The connection member of the liquid container may be provided with two receiving portions configured to respectively receive the two positioning elements. The two receiving portions may be located at positions that are away from each other in the X direction across the liquid outlet in the mounting state. Each of the two receiving portions may be arranged to at least partly overlap with either one of the two guided elements when being viewed in the Y direction in the mounting state.

In the liquid container of this aspect, the two receiving portions configured to receive the positioning elements increases the positioning accuracy in the case of connection of the liquid introducing element with the liquid outlet and improves the connectivity of the liquid container with the liquid ejection device. The connection between the two positioning elements and the two receiving portions suppresses rotation of the location position of the liquid container and thereby further stabilizes the mounting position of the liquid container. This accordingly enables the connection of the liquid supply path and the connection of the electrical communication path between the liquid ejection device and the liquid container to be more appropriately maintained.

[6] In the liquid container of the above aspect, at least one of the guided elements may be provided over a length in the Z direction of the connection member in the mounting state.

The configuration of the liquid container of this aspect enhances the visual recognition of the guide elements and the guided elements in the course of placing the liquid container in the case and improves the mountability of the liquid container to the case.

[7] In the liquid container of the above aspect, each of the two guided elements may include at least an inclined surface that is provided at an inlet side end with an inlet which corresponding one of the guide elements is inserted in and that is inclined to face the inlet.

The configuration of the liquid container of this aspect facilitates the smooth insertion operation of the guide elements into the guided elements in the course of placing the liquid container in the case and improves the mountability of the liquid container to the case.

[8] In the liquid container of the above aspect, a leading end of the bag-like member may be arranged to overlap with the two guided elements in the X direction in the mounting state, and the bag-like member may include portions that are arranged to overlap with the two guided elements when being viewed in the Y direction in the mounting state.

The configuration of the liquid container of this aspect suppresses a positional misalignment of the supply port relative to the connection member and thereby suppresses deterioration of the connection of the liquid supply path between the liquid ejection device and the liquid container. This also facilitates assembly of the liquid container.

[9] In the liquid container of the above aspect, the bag-like member may have a leading end that is located on a +Y direction side of the bag-like member in the mounting state and that is held by the connection member. The leading end may include portions that overlap with the two guided elements in the X direction in the mounting state.

In the liquid container of this aspect, the guided elements of the connection member support the leading end of the bag-like member to suppress a positional misalignment of the bag-like member relative to the connection member and to suppress deterioration of the mounting position of the liquid container. The connection member serves to protect the bag-like member and thereby enhances the impact resistance of the liquid container.

[10] In the liquid container of the above aspect, the leading end may include depressions that are arranged to overlap with the two guided elements in the X direction in the mounting state, that are arranged to overlap with the two guided elements in the Y direction in the mounting state, and that are respectively indented along an inner circumferential surface of one of the two guided elements in a direction from the guided element toward the bag-like member.

The configuration of the liquid container of this aspect enhances the impact resistance of the liquid container, while suppressing the bag-like member from interfering with the two guided elements.

All the plurality of components included in each of the aspects of the disclosure described above are not essential, but some components among the plurality of components may be appropriately changed, omitted or replaced with other additional components or part of the limitations may be deleted, in order to solve part or all of the problems described above or in order to achieve part or all of the advantageous effects described herein. In order to solve part or all of the problems described above or in order to achieve part or all of the advantageous effects described herein, part or all of the technical features included in one aspect of the disclosure described above may be combined with part or all of the technical features included in another aspect of the disclosure described above to provide one independent aspect of the disclosure.

The present disclosure may be implemented by various aspects other than the liquid container, for example, a liquid ejection device, a liquid ejection system and a connection method and a connecting structure of the liquid container in the liquid ejection system. In the description hereof, the term "system" means a configuration that a plurality of components cooperate with one another to exert one or a plurality of functions. The "system" includes a configuration that part or all of a plurality of components are arranged at remote locations to cooperate with one another, as well as a configuration that a plurality of components cooperate with one another in one single device.

DESCRIPTION OF EMBODIMENTS

A. First Embodiment

According to a first embodiment, the configuration of a liquid ejection device 10 is described with reference to FIGS. 1 to 6. The configuration of a liquid container 100 mounted to the liquid ejection device 10 and the configuration of a case 61 used to mount the liquid container 100 are described with reference to FIGS. 7 to 37. In the description hereof, the liquid ejection device 10 with the liquid containers 100 mounted thereto may be called "liquid ejection system 11".

A1. Configuration of Liquid Ejection Device

Appearance Configuration of Liquid Ejection Device

Figure 1:
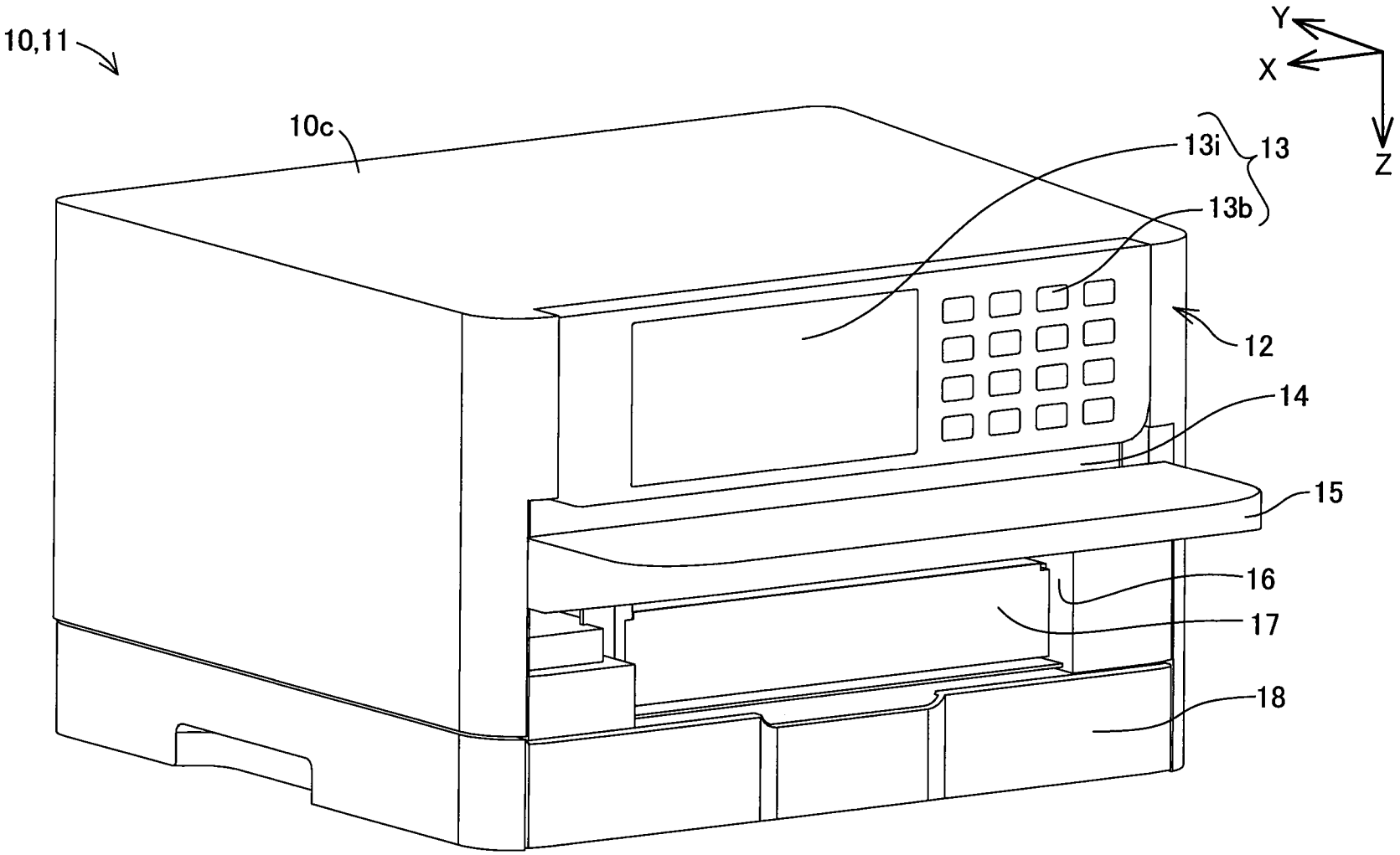
FIG. 1 is a schematic perspective view illustrating the appearance configuration of a liquid ejection device.

FIG. 1 is a schematic perspective view illustrating the appearance configuration of a liquid ejection device 10 that constitutes the liquid ejection system 11. FIG. 1 illustrates arrows X, Y and Z indicating three directions that are perpendicular to one another. Arrows X, Y and Z corresponding to those shown in FIG. 1 are appropriately illustrated in other drawings that are referred to in the description hereof.

The directions indicated by the arrows X, Y and Z are based on the location position of the liquid ejection device 10 in the ordinary use state. The ordinary use state of the liquid ejection device 10 denotes the state that the liquid ejection device 10 is placed on a horizontal plane to be used. In the description below, the directions indicated by the arrows X, Y and Z are respectively referred to as "X direction", "Y direction", and "Z direction". With regard to the X direction, one direction is called "+X direction", and the other direction is called "−X direction". Similarly with regard to the Y direction and the Z direction, respective one directions are called "+Y direction" and "+Z direction", and the respective other directions are called "−Y direction" and "−Z direction".

The following describes the X, Y and Z directions in the sequence of the Z direction, the Y direction and the X direction. The Z direction shows a direction parallel to the direction of gravity. The +Z direction shows the direction of gravity, and the −Z direction shows a direction opposite to the direction of gravity. The Z direction corresponds to a vertical direction (height direction) of the liquid ejection device 10. In the description below, the term meaning "above" and the term meaning "below" with regard to the liquid ejection device 10 are related to the vertical direction on the basis of the direction of the arrow Z, unless otherwise specified. The term "above" represents the −Z direction, and the term "below" represents the +Z direction. A "horizontal direction" represents a direction perpendicular to the Z direction.

The Y direction shows a mounting/dismounting direction of the liquid container 100 to and from the liquid ejection device 10 and corresponds to a direction parallel to a front-rear direction (depth direction) of the liquid ejection device 10. The +Y direction shows a mounting direction of the liquid container 100 to the liquid ejection device 10 and corresponds to a direction from a front surface side to a rear surface side of the liquid ejection device 10. The −Y direction shows a dismounting direction of the liquid container 100 from the liquid ejection device 10 and corresponds to a direction from the rear surface side to the front surface side of the liquid ejection device 10. In the description below, the term meaning "front" and the term meaning "rear" with regard to the liquid ejection device 10 are related to the front-rear direction on the basis of the direction of the arrow Y, unless otherwise specified. The term "front" represents the −Y direction, and the term "rear" represents the +Y direction.

The X direction shows a direction parallel to a left-right direction (width direction) of the liquid ejection device 10. The +X direction corresponds to a direction from a right side to a left side when the liquid ejection device 10 is viewed from its front side. The −X direction corresponds to an opposite direction from the left side to the right side. In the description below, the terms meaning "right" and the term meaning "left" with regard to the liquid ejection device 10 are related to the left-right direction on the basis of the direction of the arrow X, unless otherwise specified. The term "right" represents the −X direction, and the term "left" represents the +X direction.

In the description below, the X, Y and Z directions used to describe components (for example, the case 61 and the liquid container 100) separable from the liquid ejection device 10 are all based on their positions in a mounting state appropriately mounted to the liquid ejection device 10 in the ordinary use state.

According to the embodiment, the liquid ejection device 10 is an inkjet printer, and the liquid ejection system 11 is an inkjet type printing system. In the liquid ejection device 10 according to the embodiment, the liquid ejected to be consumed is ink. The ink may be, for example, pigment ink. The liquid ejection device 10 is configured to eject ink droplets and record ink dots on a medium as a processing object, so as to form an image. This medium may be, for example, printing paper. The liquid ejection device 10 according to the embodiment includes a housing 10*c* that is a resin hollow box-like body forming an exterior of the liquid ejection device 10. The housing 10*c* is in an approximately rectangular parallelepiped shape. An operation part 13, a medium outlet 14, a medium receiver 15, a medium storage inlet 16, a medium storage unit 17, and a cover member 18 are provided on a front surface portion 12 which is arranged to face in the −Y direction and which the user operating the liquid ejection device 10 is expected to face.

The operation part 13 includes a display portion 13*i* configured to display information that is to be given to the user, and a plurality of operation buttons 13*b* configured to accept the user's operations. The medium outlet 14 is an outlet of the medium fed out from inside of the liquid ejection device 10. The medium outlet 14 is formed as a slit-like opening that is wide in the X direction and is open to the −Y direction. The medium receiver 15 is located below the medium outlet 14 to be protruded like a flange in the −Y direction and is configured to receive the medium discharged from the medium outlet 14.

The medium storage inlet 16 is an opening portion, from which the user supplies the medium to the liquid ejection device 10. According to the embodiment, the medium storage inlet 16 is located below the medium receiver 15 to be open in the −Y direction and is formed as an opening portion in an approximately rectangular shape that is wide in the X direction. The medium storage unit 17 is a tray-like member configured to store a stock of the medium that is the processing object medium according to the embodiment. The medium storage unit 17 is placed in the medium storage inlet 16, such that a front surface of the medium storage unit 17 is visible from outside of the liquid ejection device 10 through the medium storage inlet 16. The user stores the medium in the medium storage unit 17 drawn out in the −Y direction from the liquid ejection device 10 through the medium storage inlet 16 and remounts the medium storage unit 17 through the medium storage inlet 16 to supply the medium to the liquid ejection device 10.

The cover member 18 is a resin plate-like member that forms part of the exterior of the liquid ejection device 10. According to the embodiment, the cover member 18 is in an approximately rectangular shape that is wide in the X direction and is placed below the medium storage inlet 16. The cover member 18 has claws (not shown) that are provided on its outer circumferential edge and is detachably mounted to the housing 10*c*. The cover member 18 serves to cover and protect a plurality of the liquid containers 100 placed inside of the liquid ejection device 10.

Internal Configuration of Liquid Ejection Device

Figure 2:
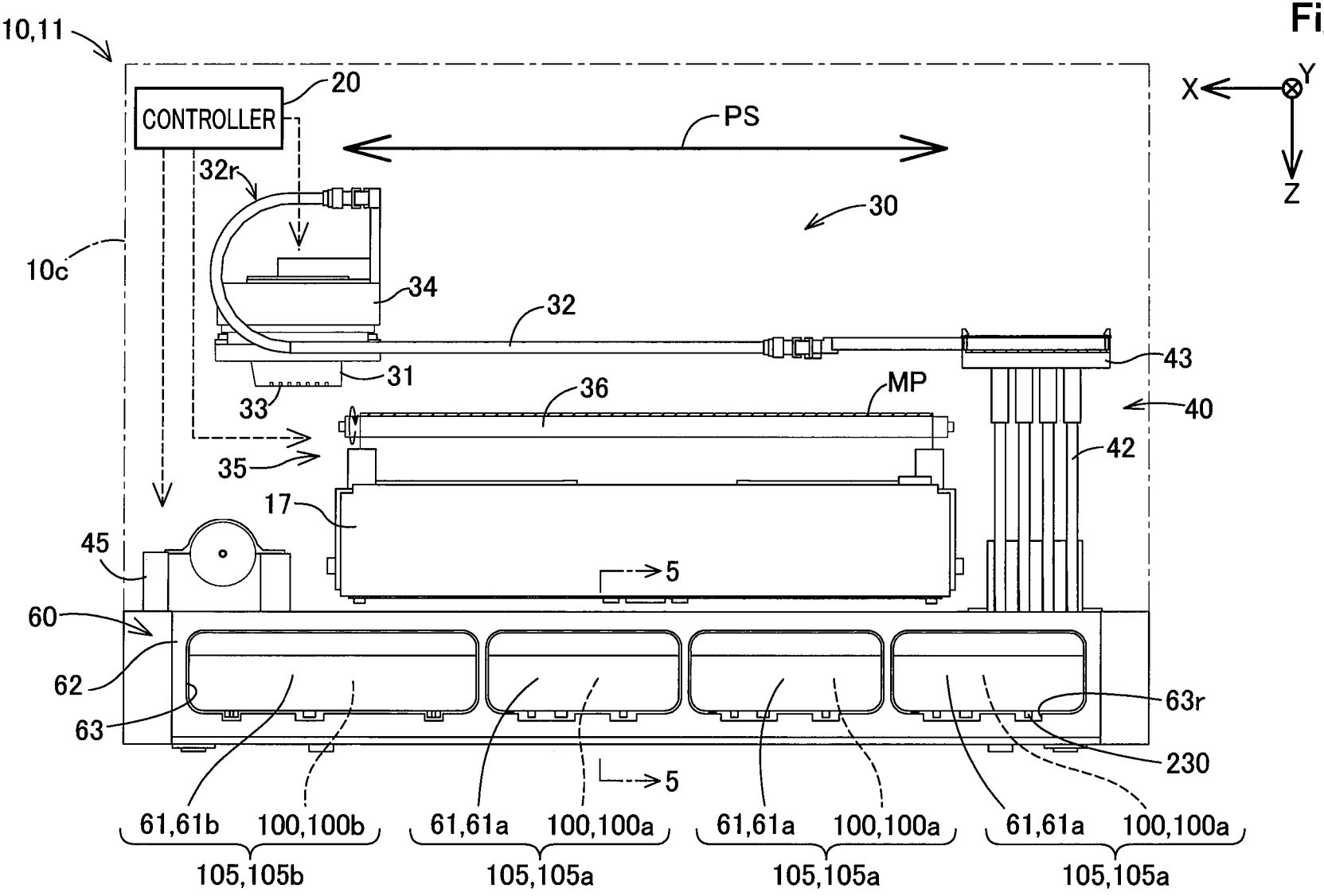
FIG. 2 is a first schematic diagram illustrating the internal configuration of the liquid ejection device.
Figure 3:
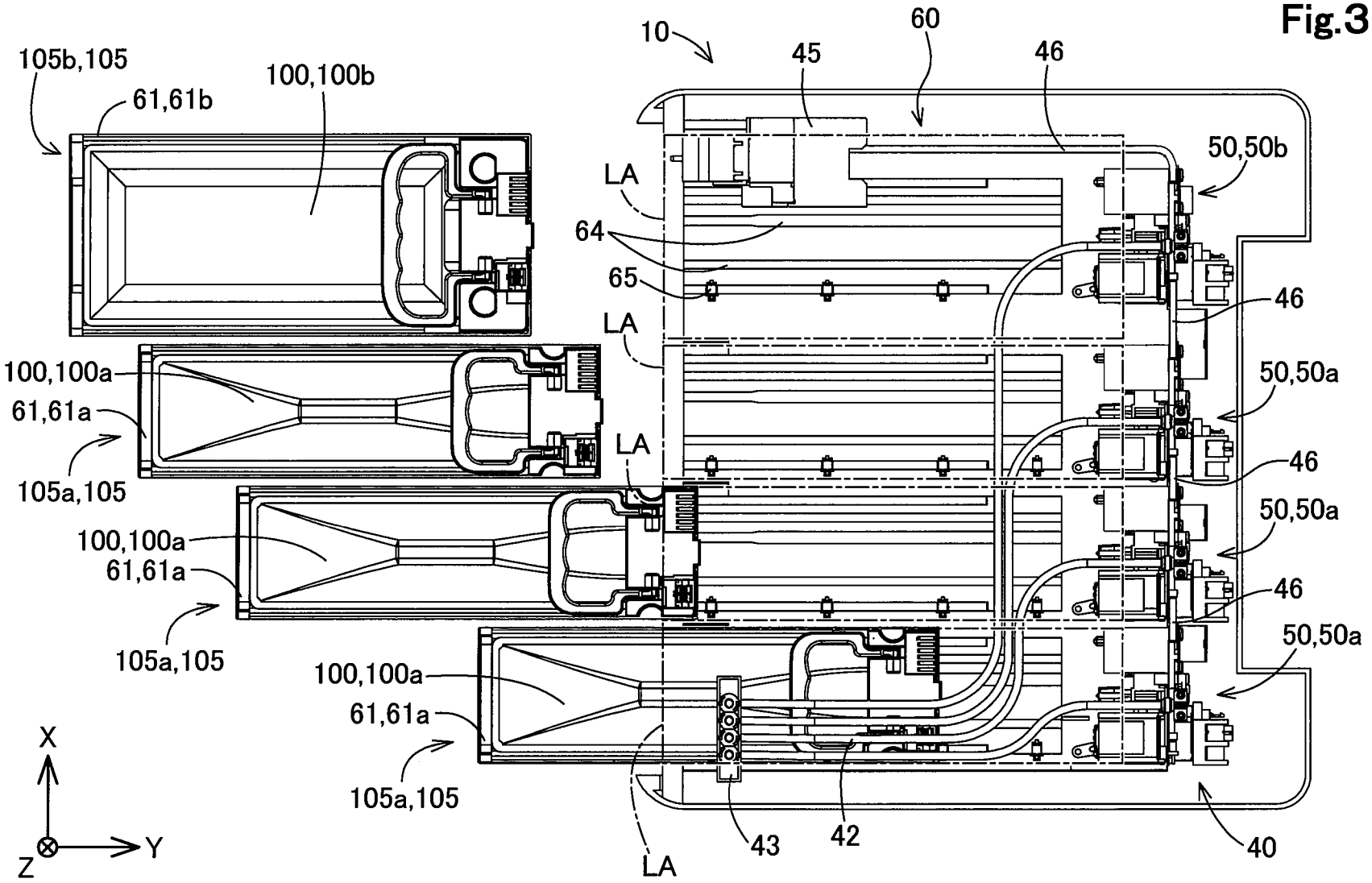
FIG. 3 is a second schematic diagram illustrating the internal configuration of the liquid ejection device.

The outline of the internal configuration of the liquid ejection device 10 is described with reference to FIGS. 2 to 6. FIG. 2 is a schematic diagram illustrating the liquid ejection device 10 viewed in the +Y direction with omission of the housing 10*c* and the cover member 18. FIG. 2 illustrates a controller 20, an ejection unit 30, a medium conveyance unit 35, a liquid supply unit 40, and a case placement unit 60 which are extracted from primary components of the liquid ejection device 10. FIG. 3 is a schematic diagram illustrating the liquid ejection device 10 viewed in the +Z direction with omission of the housing 10*c* and the cover member 18. The controller 20, the ejection unit 30 and the medium conveyance unit 35 that are illustrated in FIG. 2 are omitted from the illustration of FIG. 3. As a matter of convenience, FIG. 3 illustrates a plurality of the liquid containers 100 drawn out in the −Y direction along with cases 61 from their location areas LA where the respective liquid containers 10 are mounted to the liquid ejection device 10.

The liquid ejection device 10 includes the controller 20, the ejection unit 30, the medium conveyance unit 35, the liquid supply unit 40 and the case placement unit 60 (as shown in FIG. 2). In the liquid ejection device 10, liquids are supplied from the liquid containers 100 placed in the case placement unit 60 via supply pipes 42 of the liquid supply unit 40 to the ejection unit 30. The ejection unit 30 ejects the liquids onto a medium MP that is fed out from the medium storage unit 17 and conveyed by the medium conveyance unit 35, so as to form a printed image on the medium MP. The controller 20, the ejection unit 30, the medium conveyance unit 35, the liquid supply unit 40, and the case placement unit 60 are described sequentially.

Controller

The controller 20 is configured to control the operations of respective components in the liquid ejection device 10. The controller 20 is configured by a microcomputer including at least a central processing unit and a main storage unit. The central processing unit loads and executes various programs on and in the main storage unit to exert various functions. The functions of the controller 20 will be described sequentially.

Ejection Unit

The ejection unit 30 includes a head portion 31 and a plurality of tubes 32 (shown in FIG. 2). The head portion 31 receives the supplies of liquids from the liquid supply unit 40 via the plurality of tubes 32. A supply mechanism of the liquids from the liquid supply unit 40 will be described later. The head portion 31 includes a liquid chamber (not shown) configured to store the liquid supplied from the liquid supply unit 40. Nozzles 33 are provided on a bottom surface of the liquid chamber to be open downward. The head portion 31 ejects the liquid stored in the liquid chamber from the nozzles 33 under control of the controller 20 by a known method, for example, application of a pressure to ink by means of a piezoelectric element.

According to the embodiment, the head portion 31 is mounted on a carriage 34 and is configured to linearly reciprocate in the X direction under control of the controller 20. FIG. 2 illustrates a two-way arrow PS indicating moving directions and a moving range of the head portion 31. According to the embodiment, a main scan direction of the liquid ejection device 10 corresponds to the X direction. The ejection unit 30 includes a guide shaft along which the carriage 34 moves, a motor configured to generate a driving force, and a pulley configured to transmit the driving force, as a driving mechanism configured to move the head portion 31. Illustration and detailed description of these elements is omitted.

The plurality of tubes 32 connected with the head portion 31 have flexibility. The plurality of tubes 32 are arrayed in parallel to the Y direction. The plurality of tubes 32 are arranged approximately linearly in the +X direction along a scan route of the head portion 31 from a joint 43 that is a connecting portion with the supply pipes 42 of the liquid supply unit 40 described later and are then curved upward and folded back in the −X direction to be connected with the head portion 31. Curved portions 32*r* of the plurality of tubes 32 are displaced with movement of the head portion 31. This configuration suppresses the plurality of tubes 32 from disturbing the main scan of the head portion 31 and facilitates the smooth moving operation of the head portion 31.

Medium Conveyance Unit

The medium conveyance unit 35 conveys the medium MP as the processing object under control of the controller 20 (as shown in FIG. 2). The medium conveyance unit 35 includes a conveyance roller 36 that is laid in the X direction below the head portion 31. The medium storage unit 17 described above is placed below the conveyance roller 36. The medium conveyance unit 35 is equipped with a feed-out mechanism (not shown) configured to feed out the medium MP one by one from the medium storage unit 17 onto an outer circumferential surface of the conveyance roller 36. The medium conveyance unit 35 rotates the conveyance roller 36 by means of a drive motor (not shown) and moves the medium MP placed below the head portion 31 in the −Y direction by its rotational driving force. According to the embodiment, a sub scan direction of the liquid ejection device 10 corresponds to the −Y direction. The medium MP passing through an area below the head portion 31 is discharged out of the liquid ejection device 10 through the medium outlet 14.

In the course of a printing process of the liquid ejection device 10, the controller 20 conveys the medium MP in the sub scan direction described above by means of the medium conveyance unit 35. The head portion 31 placed above the conveyance roller 36 is reciprocated in the main scan direction along the conveyance roller 36 and is configured to eject ink droplets toward a printing surface of the medium P at a timing determined according to print data. Ink dots are accordingly recorded on the medium MP at positions determined according to the print data, so as to form an image based on the print data.

Liquid Supply Unit

Figure 4:
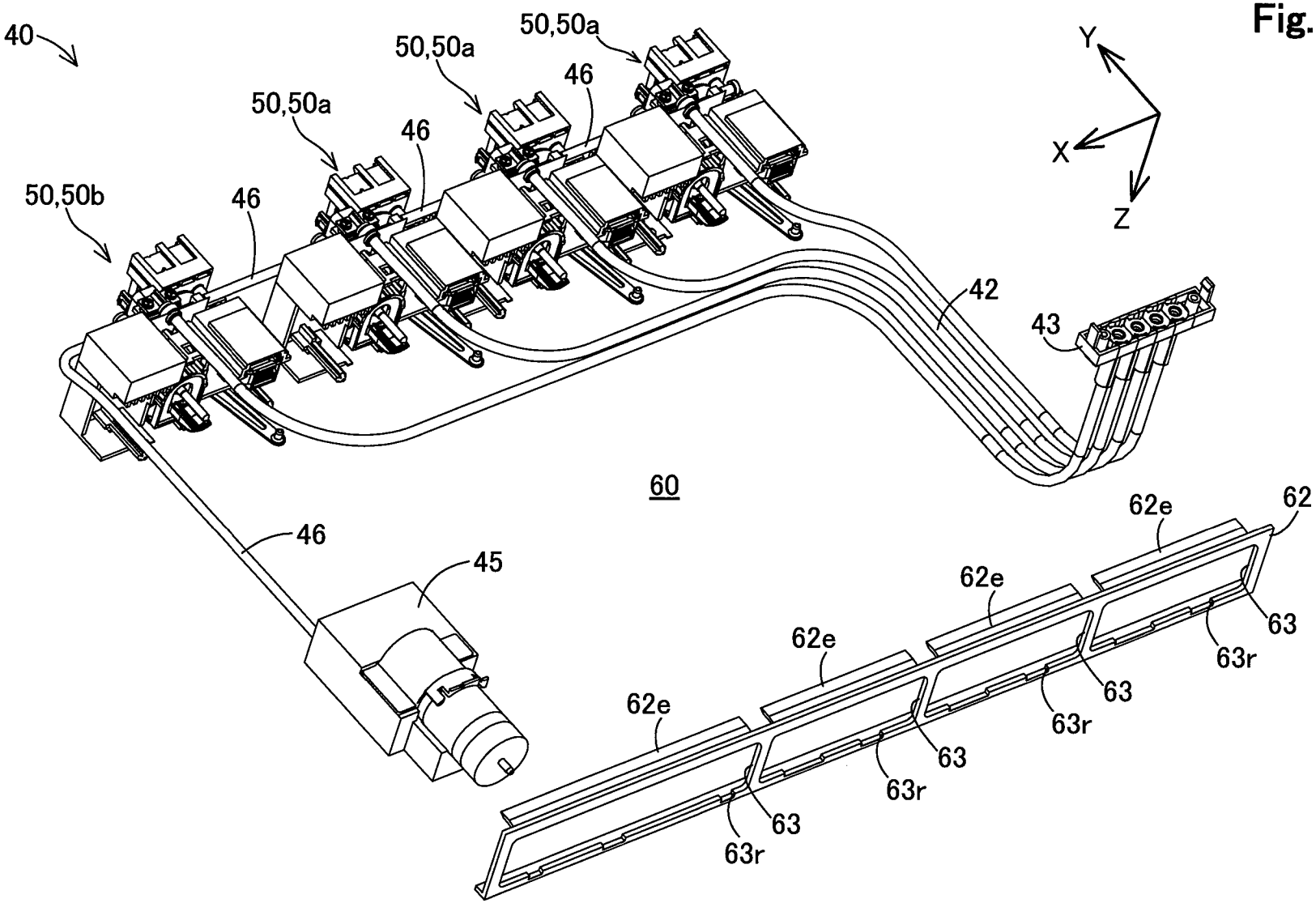
FIG. 4 is a schematic perspective view illustrating a liquid supply unit extracted.

The liquid supply unit 40 is described with reference to FIG. 4, along with FIG. 2 and FIG. 3. FIG. 4 is a schematic perspective view extracting and illustrating the liquid supply unit 40. FIG. 4 illustrates an opening member 62 together with the liquid supply unit 40, with a view to showing a positional relationship between the liquid supply unit 40 and the opening member 62 in the liquid ejection device 10. The liquid supply unit 40 includes a plurality of connection receiving portions 50, a pressure fluctuation generator 45 and a pressure transmitting pipe 46, in addition to the plurality of supply pipes 42 and the joint 43 described above (as shown in FIGS. 3 and 4). The configuration of the plurality of connection receiving portions 50 is described first. The supply pipes 42 and the joint 43 are described next. The pressure fluctuation generator 45 and the pressure transmitting pipe 46 constituting a liquid suction and delivery mechanism are then described.

Connection Receiving Portion

The liquid supply unit 40 is connected with the plurality of liquid containers 100 placed in the case placement unit 60 via the plurality of connection receiving portions 50. Four liquid containers 100 respectively containing different color inks are mounted to the liquid ejection device 10 of the embodiment as described later. According to the embodiment, the liquid supply unit 40 includes four connection receiving portions 50 respectively corresponding to the four liquid containers 100.

According to the embodiment, three out of the four liquid containers 100 are first liquid containers 100*a* that have identical capacities to contain the liquids, and the remaining one is a second liquid container 100*b* that has a larger capacity to contain the liquid than the capacities of the first liquid containers 100*a*. Three out of the plurality of connection receiving portions 50 are first connection receiving portions 50*a* corresponding to the first liquid containers 100*a*, and the remaining one is a second connection receiving portion 50*b* corresponding to the second liquid container 100*b*. The first connection receiving portions 50*a* and the second connection receiving portion 50*b* are collectively called "connection receiving portion 50" unless there is a need to distinguish the connection receiving portions 50*a* and 50*b* from each other. Similarly the first liquid containers 100*a* and the second liquid container 100*b* are collectively called "liquid container 100" unless there is a need to distinguish the liquid containers 100*a* and 100*b* from each other. According to the embodiment, the first connection receiving portions 50*a* and the second connection receiving portion 50*b* have no substantial structural differences with regard to the configuration involved in connection with the liquid containers 100.

The plurality of connection receiving portions 50 are placed on a +Y direction side end of the case placement unit 60 (as shown in FIG. 3 and FIG. 4). The respective connection receiving portions 50 are arrayed to be aligned in the X direction on a lowest step at deepest positions on the rear surface side of the liquid ejection device 10. The respective connection receiving portions 50 are placed to receive the connection of the corresponding liquid containers 100 from the −Y direction side. The three first connection receiving portions 50*a* are arranged in parallel at substantially equal intervals from the right side. The second connection receiving portion 50*b* is placed on the leftmost side.

Figure 5:
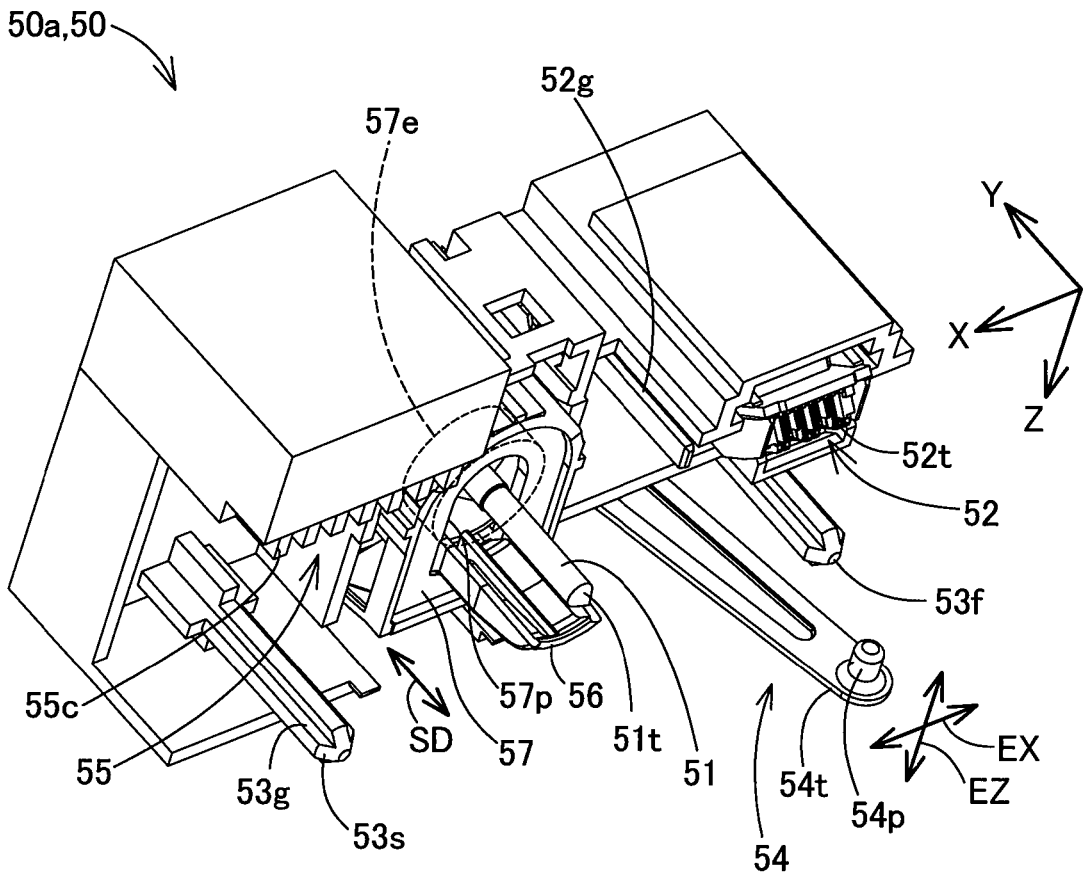
FIG. 5 is a schematic perspective view illustrating a connection receiving portion.

The general configuration of each of the connection receiving portions 50 is described with reference to FIG. 5. FIG. 5 is a schematic perspective view extracting and illustrating part of the first connection receiving portions 50*a* among the plurality of connection receiving portions 50. The following description is commonly applied to the first connection receiving portions 50*a* and the second connection receiving portion 50*b* unless otherwise specified. The connection receiving portion 50 is configured as one part by integrating a liquid introducing element 51, a device-side electrical connecting structure 52, a first positioning element 53*f*, a second positioning element 53*s*, a device-side fixation structure 54, and a fitting structure 55.

The liquid introducing element 51 is configured such that the liquid flows in from the liquid container 100. According to the embodiment, the liquid introducing element 51 is located on a +Y direction side end of the case placement unit 60. The liquid introducing element 51 is configured by a tube that is linearly extended in the −Y direction and that is open at a leading end portion 51*t* on the −Y direction side. The leading end portion 51*t* of the liquid introducing element 51 is inserted into the liquid container 100, so that the liquid introducing element 51 is connected with the liquid container 100. According to the embodiment, the liquid introducing element 51 is protruded in the −Y direction at an approximate center in the X direction of the connection receiving portion 50.

A rear end portion on the +Y direction side of the liquid introducing element 51 is arranged to communicate with a pump chamber (not shown) provided inside of the connection receiving portion 50. The liquid flowed into the liquid introducing element 51 flows into the pump chamber. A check valve structure (not shown) is provided inside of the connection receiving portion 50 to suppress the liquid flowing into the pump chamber from flowing back to the liquid introducing element 51.

In the connection receiving portion 50 according to the embodiment, a liquid receiving element 56 is provided below the liquid introducing element 51. The liquid receiving element 56 is extended in the −Y direction along the liquid introducing element 51. The liquid receiving element 56 is slightly curved downward to follow the shape of a lower side surface of the liquid introducing element 51 and serves as a receiver to receive the liquid leaked from a connecting position of the liquid introducing element 51 with the liquid container 100. The liquid receiving element 56 may be omitted.

Abase end member 57 is provided at rear ends on the +Y direction side of the liquid introducing element 51 and the liquid receiving element 56. The base end member 57 is a resin member having a through hole 51*p*, which the liquid introducing element 51 is inserted through. The base end member 57 is mounted to be movable in the Y direction. A helical spring serving as a biasing member 57*e* is placed on a rear surface side of the base end member 57 to surround the periphery of the liquid introducing element 51 and is configured to apply an elastic force in the −Y direction to the base end member 57. The biasing member 57*e* is placed behind the base end member 57 to be not visible, and its location position is shown by the broken line in FIG. 5. The base end member 57 is elastically moved in the Y direction as shown by an arrow SD by a force applied by the biasing member 57*e*. When the liquid container 100 is mounted to the liquid ejection device 10, a force in the −Y direction is applied to the liquid container 100 and the case 61 by the base end member 57.

The device-side electrical connecting structure 52 is a connector that is electrically connected with the liquid container 100. The device-side electrical connecting structure 52 is located on a +Y direction side end of the case placement unit 60 (as shown in FIG. 3). The device-side electrical connecting structure 52 has a plurality of terminal portions 52*t* arrayed in the X direction. The respective terminal portions 52*t* are protruded from the surface of the device-side electrical connecting structure 52 and come into contact with to be electrically connected with a container-side electrical connecting structure (described later) of the liquid container 100. It is desirable that the respective terminal portions 52*t* are biased in their protruding direction by an elastic member such as a leaf spring. According to the embodiment, the device-side electrical connecting structure 52 is arranged at an inclination angle corresponding to a location angle of the container-side electrical connecting structure of the liquid container 100.

The device-side electrical connecting structure 52 is arranged to face obliquely upward, such that its normal vector on the surface includes a −Y-direction vector component and a −Z direction vector component.

The device-side electrical connecting structure 52 is connected with the controller 20 (shown in FIG. 29) via a wiring (not shown). The wiring may be formed, for example, by a flexible flat cable. Electrical connection between the device-side electrical connecting structure 52 and the container-side electrical connecting structure causes electric signals to be transmitted between the controller 20 and the liquid container 100. The controller 20 accordingly obtains information with regard to the liquid contained in the liquid container 100. The information with regard to the liquid is, for example, the color of ink, the type of ink, and a parameter indicating the amount of the liquid contained in the liquid container 100. The controller 20 also serves to electrically detect the connecting state of the liquid container 100.

One guide projection 52*g* is provided on each of two sides in the X direction of the device-side electrical connecting structure 52. As a matter of convenience, FIG. 5 illustrates only the guide projection 52*g* on the +X direction side with omission of the guide projection 52*g* on the −Y direction side. The guide projection 52*g* is shown to be protruded in the −Y direction in FIG. 5 for convenience sake and serves as a positioning structure to connect the container-side electrical connecting structure (described later) of the liquid container 100 with the device-side electrical connecting structure 52.

The first positioning element 53*f* and the second positioning element 53*s* are protruded at positions that are separate from each other. According to the embodiment, the first positioning element 53*f* and the second positioning element 53*s* are configured as shaft portions extended in the −Y direction and are arranged to be parallel to the liquid introducing element 51. The first positioning element 53*f* is located on the −X direction side of the liquid introducing element 51, and the second positioning element 53*s* is located on the +X direction side of the liquid introducing element 51. The first positioning element 53*f* is located on the −X direction side of the device-side electrical connecting structure 52. According to the embodiment, the first positioning element 53*f* and the second positioning element 53*s* have leading ends that are arranged at positions substantially aligned in the Y direction. The first positioning element 53*f* and the second positioning element 53*s* are provided at approximately the same height positions and are placed at lower positions than the positions of the liquid introducing element 51 and the device-side electrical connecting structure 52.

In the mounting state of the liquid container 100, both the first positioning element 53*f* and the second positioning element 53*s* are inserted into corresponding receiving structures (described later) provided in the liquid container 100. The first positioning element 53*f* and the second positioning element 53*s* serve to define the location position in the X direction and the location angle in the horizontal direction of the liquid container 100 in the mounting state of the liquid container 100.

It is desirable that the first positioning element 53*f* and the second positioning element 53*s* are protruded toward the −Y direction side of the leading end portion 51*t* of the liquid introducing element 51. This configuration enables the liquid introducing element 51 to be connected with a liquid outlet (described later) of the liquid container 100 in the state that the mounting position of the liquid container 100 is defined by the pair of positioning elements 53*f* and 53*s*. As illustrated, it is preferable to provide grooves 53*g* that are formed in outer circumferential side surfaces of the respective positioning elements 53*f* and 53*s* that are extended parallel to the Y direction. This configuration ensures the smooth insertion of the positioning elements 53*f* and 53*s* into the receiving structures of the liquid container 100.

The device-side fixation structure 54 works in combination with a case-side fixation structure (described later) provided in the case 61 where the liquid container 100 is placed to restrict the movement of the case 61 in the Y direction. According to the embodiment, the device-side fixation structure 54 is configured as an arm member and is extended in the −Y direction to enter below the mounted liquid container 100. The device-side fixation structure 54 is located on the −X direction side of the liquid introducing element 51 and is located below the device-side electrical connecting structure 52.

The device-side fixation structure 54 has a leading end 54*t* on its −Y direction side that is protruded toward the −Y direction side of the leading end portion 51*t* of the liquid introducing element 51. The leading end 54*t* is protruded toward the −Y direction side of leading ends of the respective positioning elements 53*f* and 53*s*. The leading end 54*t* is provided with a protrusion 54*p*. The protrusion 54*p* is protruded in the −Z direction at the center of the leading end 54*t*. The protrusion 54*p* is engaged with an engaged element provided in the case-side fixation structure in a case placement state that the case 61 is mounted to the case placement unit 60. In the description below, in some cases, the protrusion 54*p* is also called "engagement element 54*p*". Locking the protrusion 54*p* by the engaged element provided in the case-side fixation structure restricts the movement of the case 61 in the −Y direction.

The device-side fixation structure 54 is mounted to be rotatable in a lateral direction about its rear end on the +Y direction side as the point of support as shown by a two-way arrow EX. The device-side fixation structure 54 is biased in the +X direction by means of an elastic member (not shown) placed inside of the connection receiving portion 50 and is elastically rotated in the −X direction when an external force is applied in the −X direction. The device-side fixation structure 54 is also mounted to be rotatable in the height direction about its rear end on the +Y direction side as the point of support as shown by a two-way arrow EZ. The device-side fixation structure 54 is biased in the −Z direction by means of an elastic member (not shown) placed inside of the connection receiving portion 50 and is elastically rotated in the +Z direction when an external force is applied in the +Z direction. The mechanism of engagement between the device-side fixation structure 54 and the case-side fixation structure of the case 61 will be described later.

The fitting structure 55 is provided on the +X direction side of the liquid introducing element 51. The fitting structure 55 is located above the second positioning element 53*s* and has a concave-convex structure including an array of a plurality of protrusions 55*c* in an approximately rectangular shape that are protruded to an identical height in the +Z direction and that are extended parallel to the −Y direction. The respective connection receiving portions 50 have different arrayed patterns of the protrusions 55*c* in the concave-convex structure of the fitting structure 55. The liquid container 100 corresponding to each of the connection receiving portions 50 is provided with a fitting structure receiving structure (described later) that has a matching concave-convex structure corresponding to the arrayed pattern of the concave-convex structure of the fitting structure 55. This configuration suppresses any non-corresponding wrong liquid container 100 from being connected with the connection receiving portion 50.

Supply Pipe and Joint

The plurality of supply pipes 42 are configured by resin tube members having flexibility (as shown in FIG. 4). Each of the supply pipes 42 is connected with the pump chamber (not shown) provided inside of each of the connection receiving portions 50 described above. The respective supply pipes 42 are laid out from the respective connection receiving portions 50 to go through above the placement area of the liquid containers 100, are gathered on a −X direction side end and are drawn in parallel to the −Y direction (as shown in FIG. 3 and FIG. 4). The respective supply pipes 42 are then drawn in the −Z direction on a front side end of the liquid ejection device 10 to be connected with the joint 43 that is placed at a higher position than the position of the medium conveyance unit 35 (as shown in FIG. 2 and FIG. 4). As described above, each of the supply pipes 42 is connected with corresponding one of the plurality of tubes 32 of the ejection unit 30 via the joint 43.

Liquid Suction and Delivery Mechanism in Liquid Supply Unit

The pressure fluctuation generator 45 is a generation source of generating a pressure fluctuation for suction and delivery of the liquid and is configured by, for example, a pump (as shown in FIG. 2 and FIG. 3). The pressure fluctuation generator 45 is placed above the case placement unit 60 at a position nearer to the front surface portion 12 of the liquid ejection device 10 (as shown in FIG. 2). The pressure fluctuation generator 45 is located above the mounting position of the first liquid container 100*a*. The pressure transmitting pipe 46 is connected with the pressure fluctuation generator 45 and is configured to transmit the pressure fluctuation generated by the pressure fluctuation generator 45 (as shown in FIG. 3 and FIG. 4). The pressure transmitting pipe 46 is connected with a pressure chamber (not shown) provided inside of each connection receiving portion 50.

The pressure chamber of each connection receiving portion 50 is arranged across a flexible membrane to be adjacent to the pump chamber, which the fluid flows in from the liquid container 100. When the pressure in the pressure chamber is decreased by the pressure fluctuation generator 45, the flexible membrane is bent toward the pressure chamber to increase the volume of the pump chamber and to cause the liquid contained in the liquid container 100 to be sucked into the pump chamber via the liquid introducing element 51. When the pressure in the pressure chamber is increased by the pressure fluctuation generator 45, on the other hand, the flexible membrane is bent toward the pump chamber to decrease the volume of the pump chamber and to cause the liquid flowing into the pump chamber to be pressed out to the supply pipe 42. The pressure fluctuation generator 45 repeatedly increases and decreases the pressure in the pressure chamber in this manner, so that the liquid supply unit 40 supplies the liquid to the ejection unit 30.

Case Placement Unit

In the liquid ejection device 10 according to the embodiment, the case placement unit 60 is provided on a lower most level (as shown in FIG. 2 and FIG. 3). A plurality of the cases 61 are placed in the case placement unit 60. In the case placement state described above, the plurality of cases 61 are arrayed in a line in the X direction in the case placement unit 60. A plurality of the liquid containers 100 are respectively located in the plurality of cases 61. One liquid container 100 is located in one case 61. Accordingly, the plurality of liquid containers 100 located in the cases 61 are placed in the case placement unit 60 to be arrayed in a line in the X direction. In FIG. 2, the liquid containers 100 are hidden in the cases 61 to be not visible, so that the respective location positions of the liquid containers 100 are shown by the broken line with the corresponding reference signs. In FIG. 3, location areas LA that are location positions where the cases 61 and the liquid containers 100 are mounted in the case placement unit 60 are shown by the one-dot chain line.

In the case placement unit 60, one second liquid container 100*b* is placed at its +X direction side end, and three first liquid containers 100*a* are placed on its −X direction side (as shown in FIG. 2). One corresponding connection receiving portion 50 is provided on a +Y direction side of the location area LA of each liquid container 100 (as shown in FIG. 3). As described above, different color inks are contained in the respective liquid containers 100 according to the embodiment. The combination of the color inks contained in the respective liquid containers 100 is not specifically limited. For example, cyan, magenta and yellow inks may be respectively contained in the three first liquid containers 100*a*, whereas black ink expected to have the largest consumed amount may be contained in the second liquid container 100*b*. One identical color ink may be contained in part or all of the liquid containers 100.

The plurality of cases 61 are used to mount the liquid containers 100. According to the embodiment, the case 61 is configured as a tray-like vessel. The case 61 is movable in the Y direction in the case placement unit 60 to be mounted to and dismounted from the liquid ejection device 10. The vacant case 61 without the liquid container 100 therein is also placeable in the case placement unit 60. The details of mounting and dismounting of the cases 61 and the liquid containers 100 to and from the liquid ejection device 10 will be described later.

The liquid container 100 is detachably mounted to the Z direction side of the case 61 drawn out from the case placement unit 60. The liquid container 100 that is placed in the case 61 is mounted to the liquid ejection device 10. More specifically, the liquid container 100 that is placed in the case 61 is mounted to the case placement unit 60 of the liquid ejection device 10. The liquid container 100 that is placed in the case 61 is taken out from the case placement unit 60. The case 61 includes first cases 61*a* which the first liquid containers 100*a* are placed in, and a second case 61*b*, which the second liquid container 100*b* is placed in. The first cases 61*a* and the second case 61*b* are collectively called "case 61" unless there is a need to distinguish the cases 61*a* and 61*b* from each other. The details of the configuration of the case 61 will be described later.

In the description hereof, the first liquid container 100*a* properly placed in the first case 61*a* is also called "first mounting body 105*a*". Similarly, the second liquid container 100*b* properly placed in the second case 61*b* is also called "second mounting body 105*b*". The first mounting body 105*a* and the second mounting body 105*b* are collectively called "mounting body 105" unless there is a need to distinguish the mounting bodies 105*a* and 105*b* from each other.

The opening member 62 is placed at the inlet of the case placement unit 60 (as shown in FIG. 2 and FIG. 4). The opening member 62 is a plate-like member in an approximately rectangular shape and includes four through ports 63 that are pierced in the thickness direction. The opening member 62 is located and fixed on a −Y direction side end of the case placement unit 60 in such a state that its thickness direction corresponds to the Y direction and its longitudinal direction corresponds to the x direction. Each of the through ports 63 is an insertion port which the case 61 is inserted in. Each through port 63 has an opening shape corresponding to an outer circumferential contour of the corresponding case 61 when being viewed in the Y direction. The opening member 62 serves to guide insertion and draw-out of the case 61 into and from the liquid ejection device 10. The opening member 62 also serves to suppress the user from inserting the first case 61*a* or the second case 61*b* into a wrong location. A plurality of concaves 63*r* that are recessed in the +Z direction are provided at a lower end of each through port 63. The respective concaves 63*r* are provided corresponding to rail ribs 230 (described later) provided on a lower surface of the case 61 that corresponds to the through port 63 and serve to allow the rail ribs 230 to be inserted into the case placement unit 60 and to guide movement of the rail ribs 230. The opening member 62 may be omitted.

Figure 6:
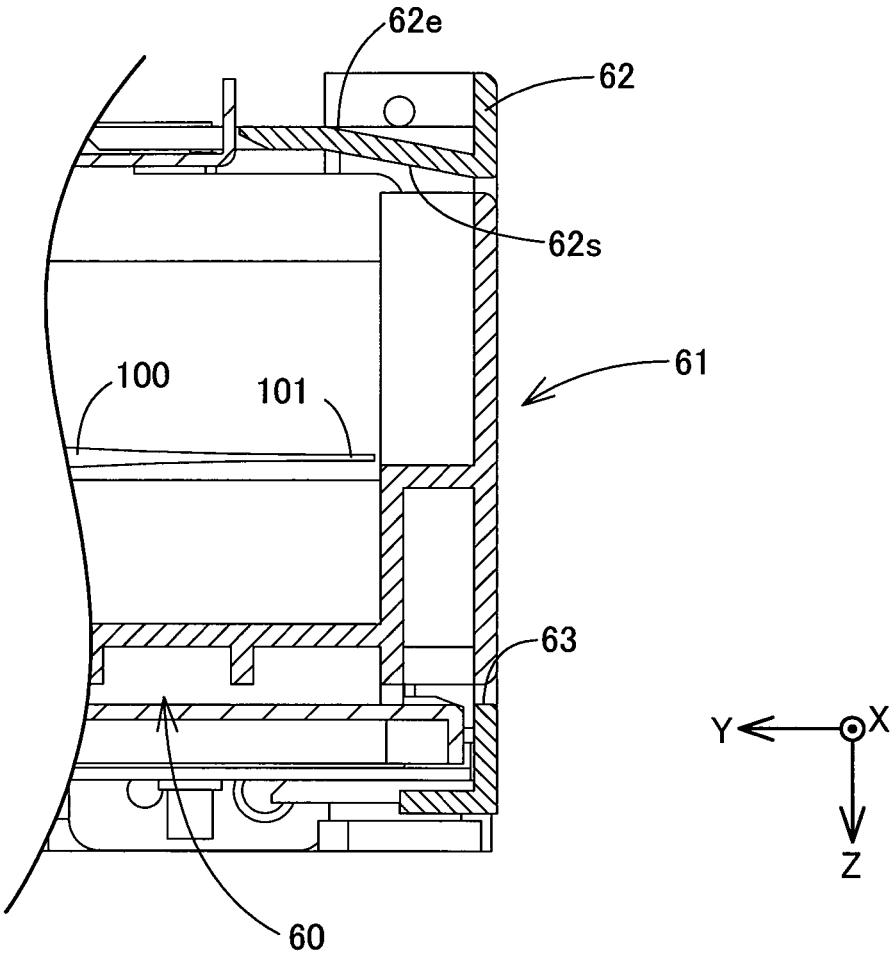
FIG. 6 is a schematic sectional view illustrating an inlet of a case placement unit.

FIG. 6 is a schematic sectional view illustrating the inlet of the case placement unit 60, taken along a line 5-5 shown in FIG. 2. The opening member 62 includes top wall portions 62*e* that are provided at upper ends of the respective through ports 63 and that are protruded like flanges in the +Y direction (as shown in FIG. 4 and FIG. 6). The top wall portion 62*e* includes an inclined wall surface 62*s* that is arranged to face in the +Z direction and that is inclined upward from the −Y direction side toward the +Y direction side. When the liquid contained in the liquid container 100 is consumed and a −Y direction-side end 101 of a bag-like member (described later) in the liquid container 100 moves up in the case 61, the end 101 is guided by the inclined wall surface 62*s* in the course of drawing out the case 61. This configuration enables the case 61 to be smoothly drawn out from the case placement unit 60.

A plurality of rail grooves 64 are formed in a bottom surface of the case placement unit 60 (as shown in FIG. 2). The respective rail grooves 64 are linearly formed for the respective location areas LA of the liquid containers 100 over the entire range in the Y direction of the case placement unit 60. The rail rib (described later) provided on the lower surface of the case 61 is fitted in each rail groove 64. The rail groove 64 serves to guide movement in the Y direction of the case 61 inside of the liquid ejection device 10 and to suppress the cases 61 adjacent to each other in the X direction from coming into contact with each other. This configuration also simplifies connection of the liquid container 100 with the connection receiving portion 50. Each case 61 may employ a different configuration of the rail groove 64 and the corresponding rail rib, for the purpose of preventing wrong mounting. Part or all of the rail grooves 64 may be omitted.

A plurality of rollers 65 are placed on the bottom surface of the case placement unit 60 (as shown in FIG. 3). The respective rollers 65 are arranged to be appropriately dispersed in the Y direction for the respective location areas LA of the liquid containers 100. Rotation of each roller 65 reduces the moving resistance in the course of moving the case 61 in the Y direction and enable to be smoothed the user's moving operation of the case 61. The rollers 65 may be omitted.

Configurations of Liquid Containers and Cases

The configurations of the first liquid container 100*a* and the first case 61*a* constituting the first mounting body 105*a* are described below with appropriately referring to FIGS. 7 to 16. The configurations of the second liquid container 100*b* and the second case 61*b* constituting the second mounting body 105*b* are then described with referring to FIGS. 17 to 24.

First Mounting Body: First Liquid Container and First Case

Figure 7:
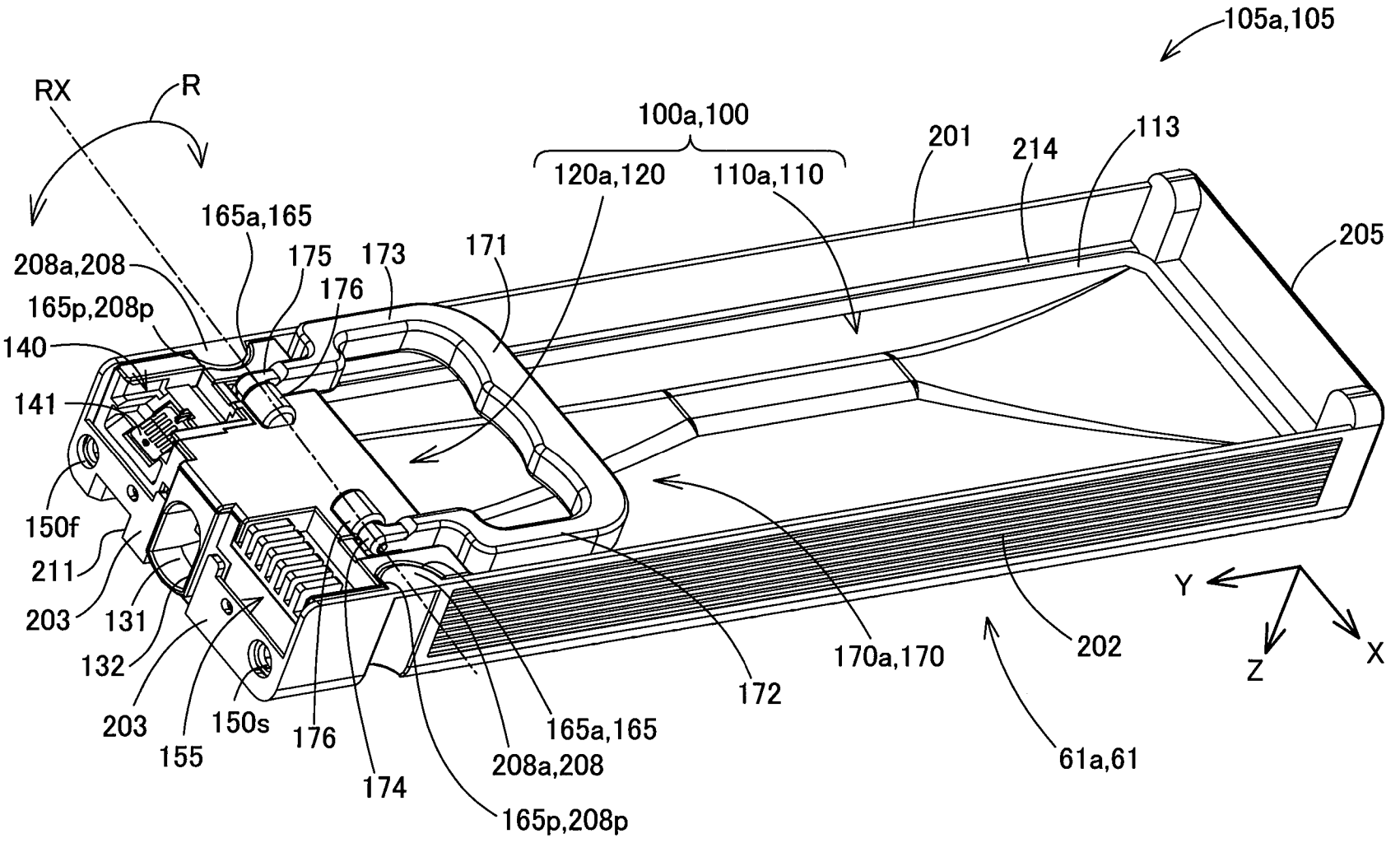
FIG. 7 is a schematic perspective view illustrating a first mounting body viewed from above.
Figure 8:
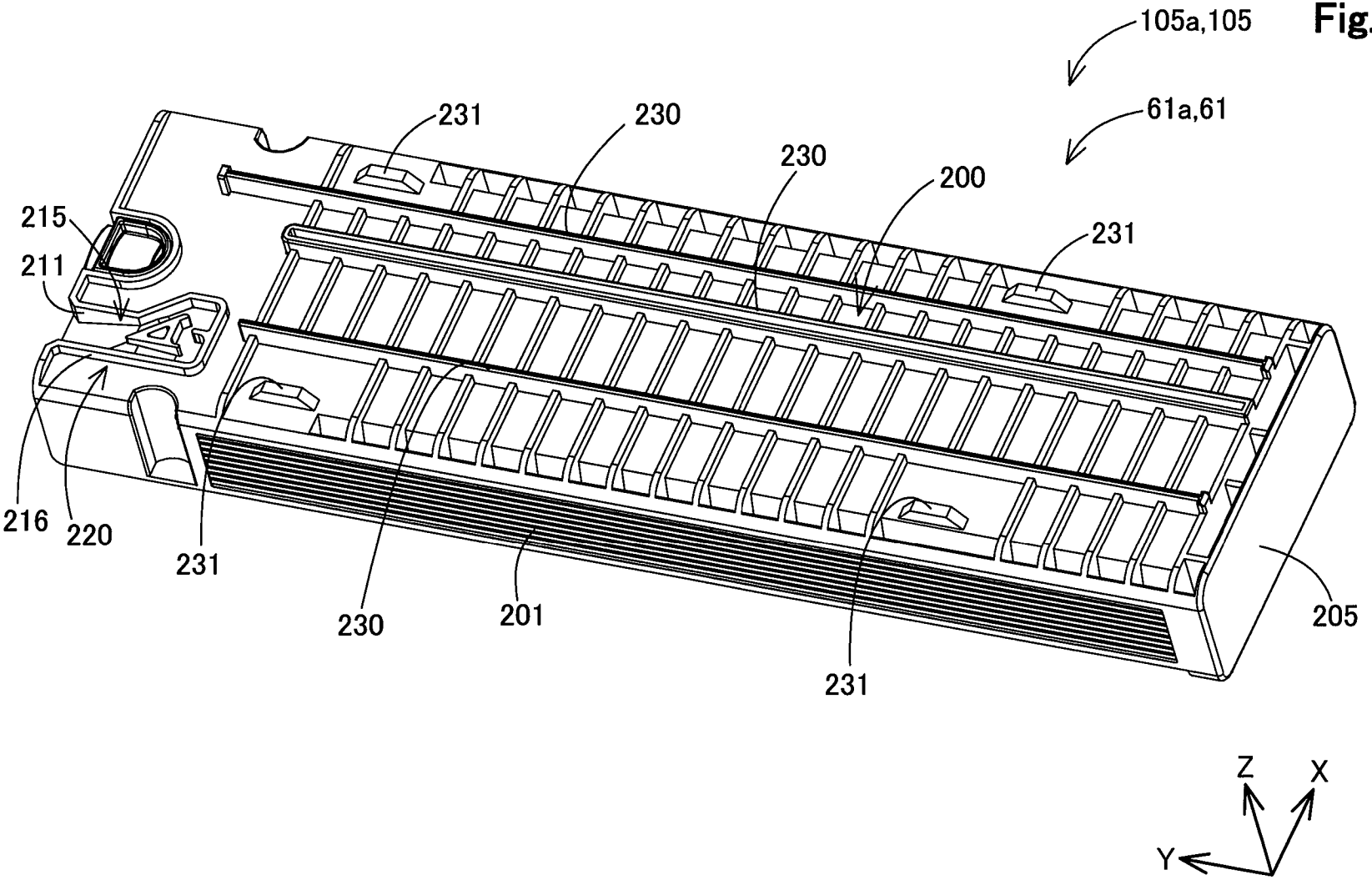
FIG. 8 is a schematic perspective view illustrating the first mounting body viewed from below.
Figure 9:
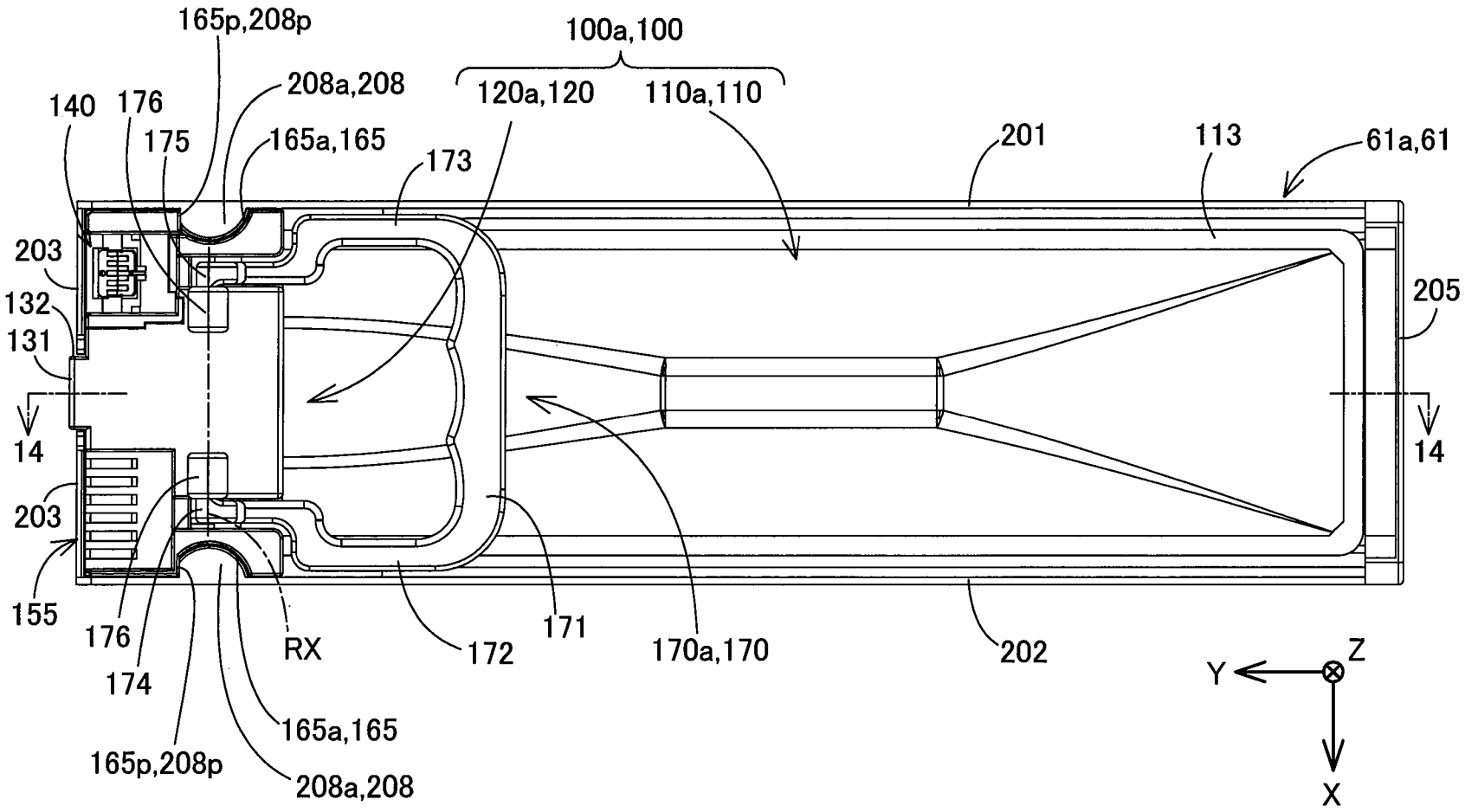
FIG. 9 is a schematic diagram illustrating an upper surface side of the first mounting body.
Figure 10:
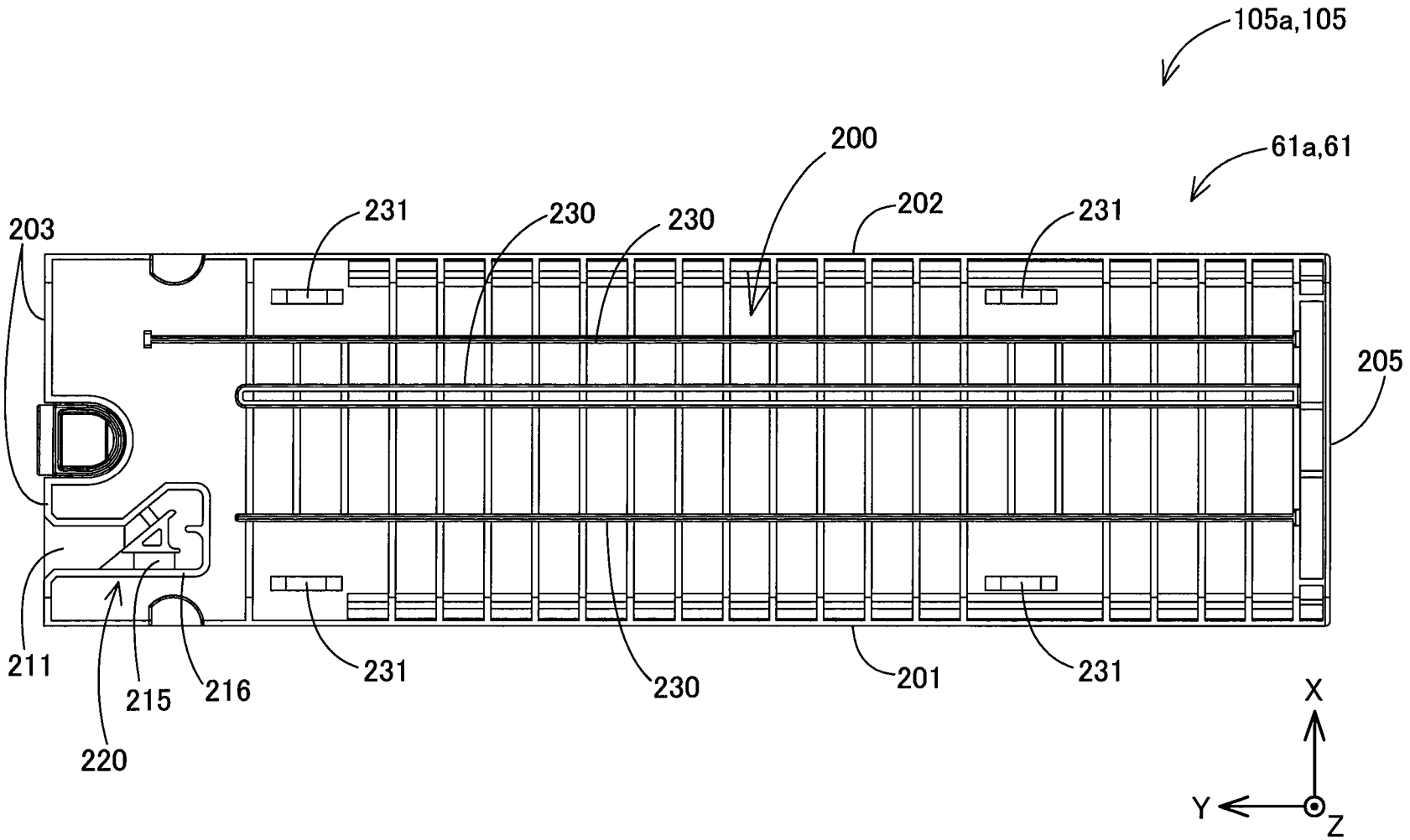
FIG. 10 is a schematic diagram illustrating a lower surface side of the first mounting body.
Figure 11:
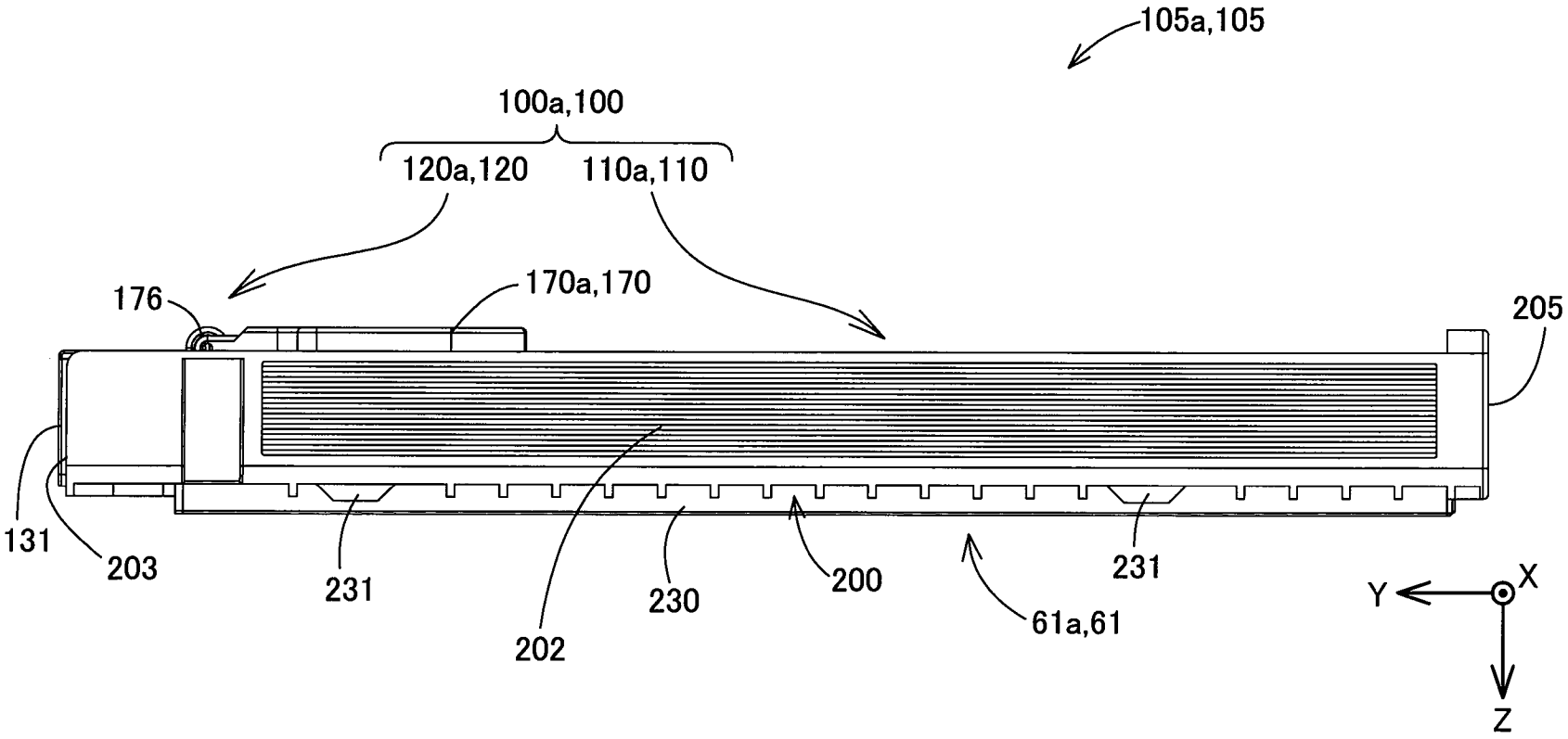
FIG. 11 is a schematic diagram illustrating a left side surface side of the first mounting body.
Figure 12:
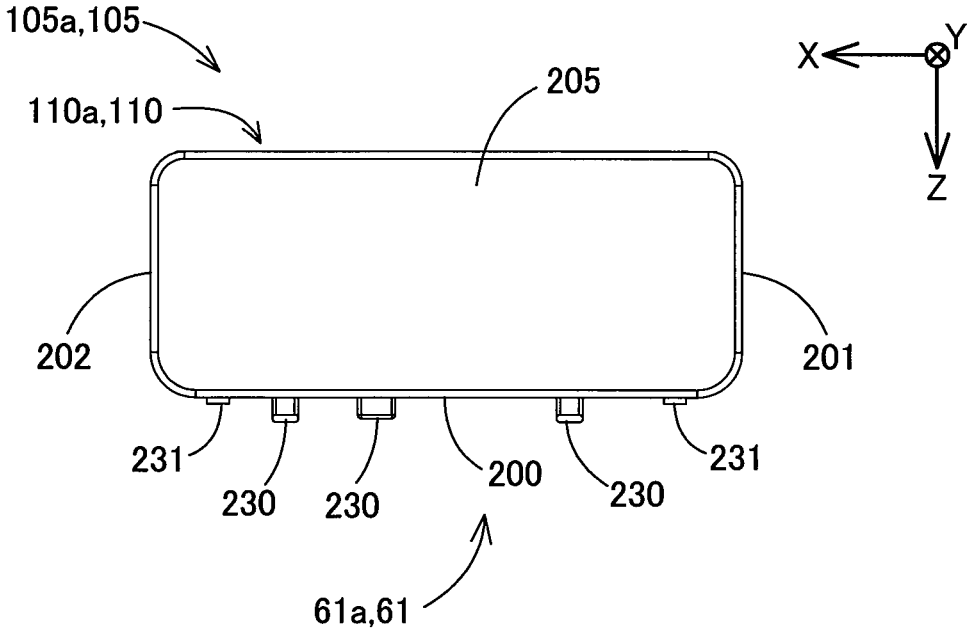
FIG. 12 is a schematic diagram illustrating a front surface side of the first mounting body.
Figure 13:
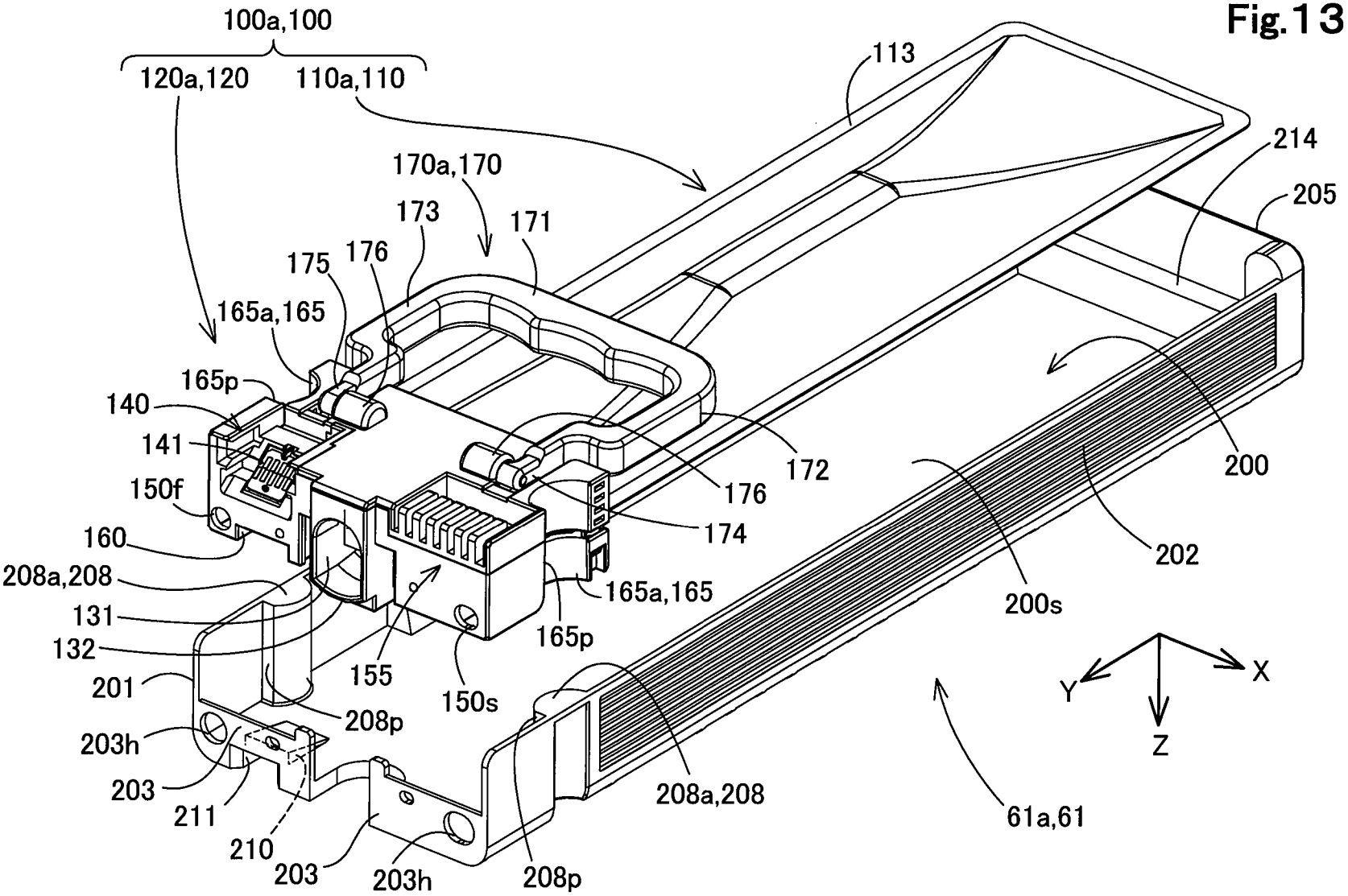
FIG. 13 is a schematic exploded perspective view illustrating a first case and a first liquid container separated from each other.
Figure 14:
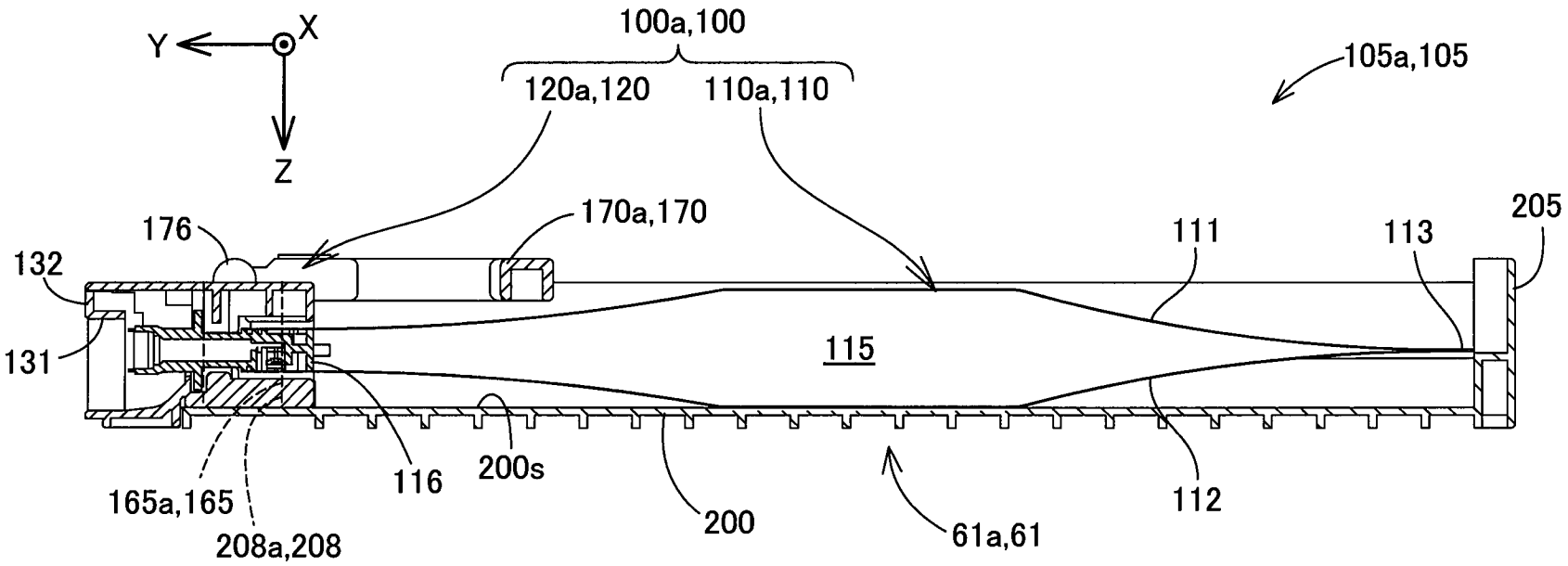
FIG. 14 is a schematic sectional view illustrating the first mounting body.
Figure 15:
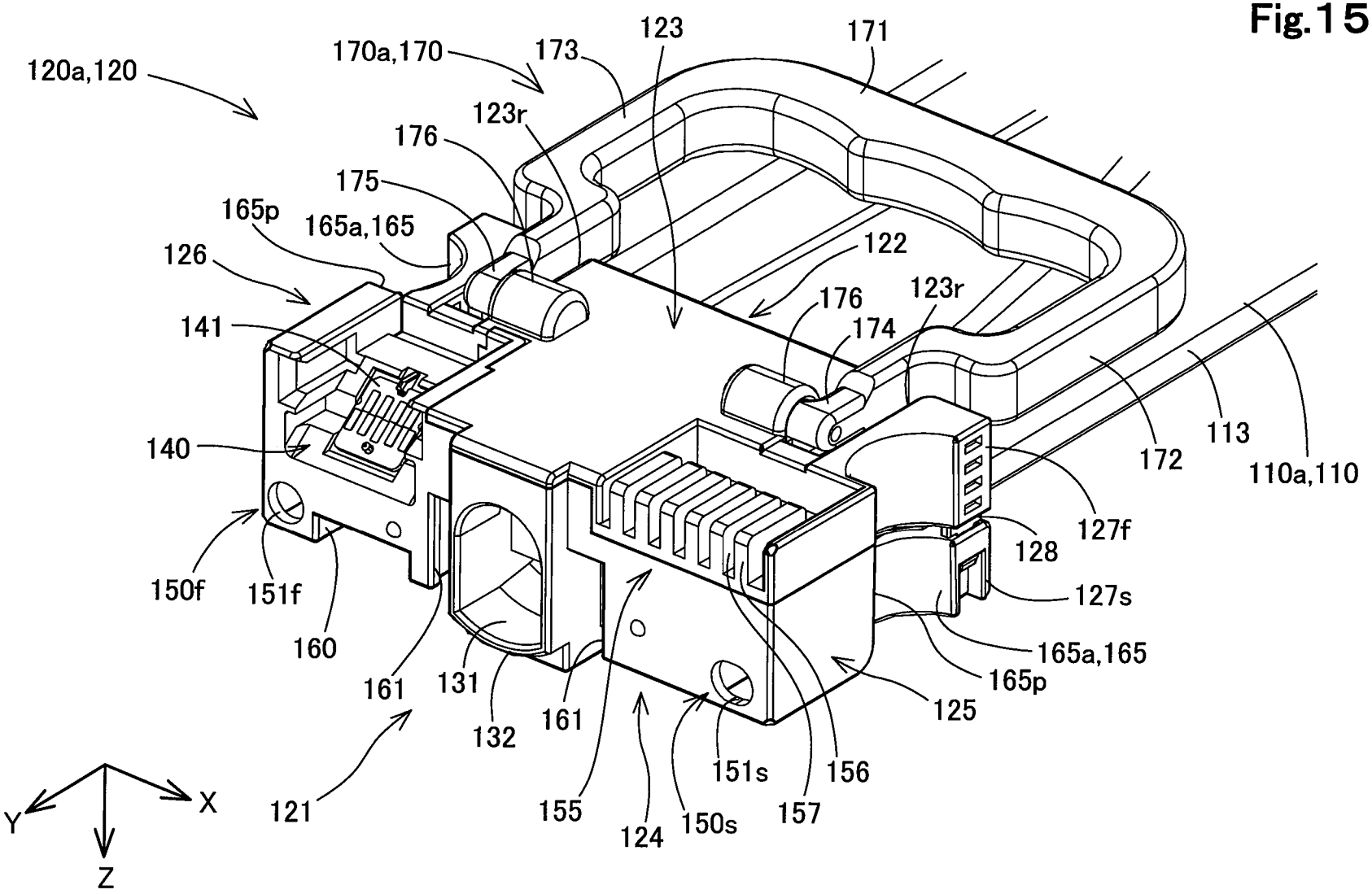
FIG. 15 is a schematic perspective view extracting and illustrating the periphery of a connection member.
Figure 16:
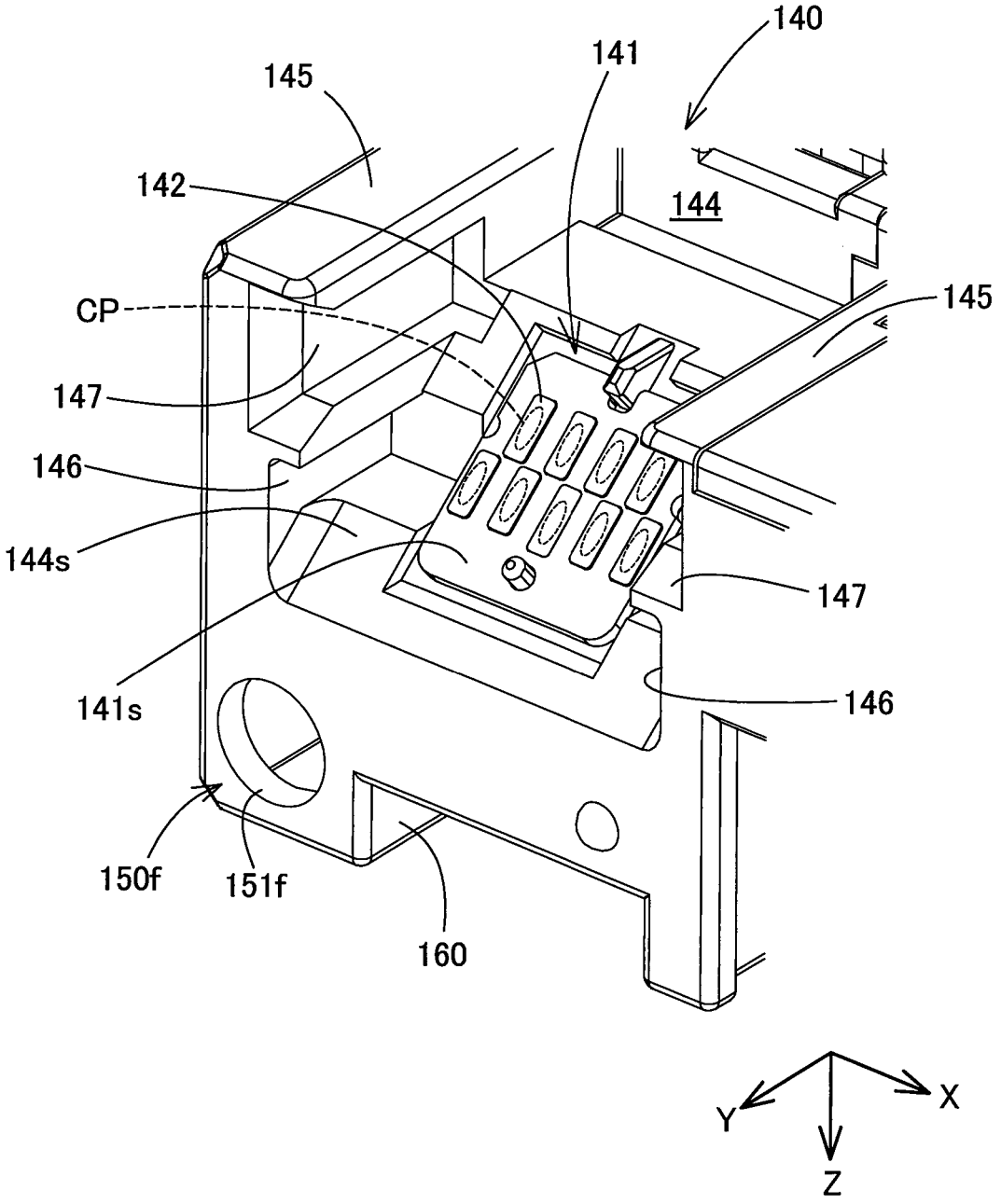
FIG. 16 is a schematic perspective view extracting and illustrating the periphery of a container-side electrical connecting structure.

The following description refers to FIGS. 7 to 16. FIG. 7 is a schematic perspective view illustrating the first mounting body 105*a* viewed from above. FIG. 8 is a schematic perspective view illustrating the first mounting body 105*a* viewed from below. FIG. 9 is a schematic diagram illustrating an upper surface side of the first mounting body 105*a* when the first mounting body 105*a* is viewed in the +Z direction. FIG. 10 is a schematic diagram illustrating a lower surface side of the first mounting body 105*a* when the first mounting body 105*a* is viewed in the −Z direction. FIG. 11 is a schematic diagram illustrating a left side surface side of the first mounting body 105*a* when the first mounting body 105*a* is viewed in the −X direction. A right side surface side of the first mounting body 105*a* is substantially similar to the left side surface side of the first mounting body 105*a*. FIG. 12 is a schematic diagram illustrating a front surface side of the first mounting body 105*a* (i.e., a rear end side in the mounting direction of the first mounting body 105*a* to the liquid ejection device 10) when the first mounting body 105*a* is viewed in the +Y direction. FIG. 13 is a schematic exploded perspective view illustrating the first liquid container 100*a* taken out from the first case 61*a* when being viewed downward. FIG. 14 is a schematic sectional view illustrating the first mounting body 105*a*, taken along a line 14-14 in FIG. 9. FIG. 15 is a schematic perspective view illustrating the periphery of a connection member 120*a* when being viewed downward. FIG. 16 is a schematic perspective view illustrating the periphery of a container-side electrical connecting structure 140 extracted from FIG. 15. The following first describes the schematic configuration of the first liquid container 100*a* and subsequently describes the schematic configuration of the first case 61*a*.

First Liquid Container

The first liquid container 100*a* is an ink pack and includes a bag-like member 110*a* and a connection member 120*a* (as shown in FIG. 7 and FIG. 8). The first liquid container 100*a* has an approximately rectangular outer circumferential contour having its longitudinal direction corresponding to the Y direction when being viewed in the Z direction (as shown in FIG. 9). The connection member 120*a* forms a +Y direction side end portion of the first liquid container 100*a*. The bag-like member 110*a* is located on the −Y direction side of the connection member 120*a*.

The first liquid container 100*a* is configured to have a width in the Z direction that is smaller than a width in the X direction and a width in the Y direction (as shown in FIG. 13 and FIG. 14). The term "width" herein means a distance in each direction between components located at the outermost positions in the direction of the first liquid container 100*a*. In other words, the first liquid container 100*a* has a thin flat plate-like shape. Accordingly the first liquid container 100*a* has high stability at the location position on the first case 61*a* (as shown in FIG. 7 and FIG. 14).

Bag-Like Member

The bag-like member 110*a* is a container forming a containing portion 115 to contain the liquid therein (as shown in FIG. 7, FIG. 13 and FIG. 14). The bag-like member 110*a* has flexibility. The flexibility of the bag-like member 110*a* may be such a degree that the bag-like member 110*a* is bent by its own weight or may be such a degree that the bag-like member 110*a* keeps its shape by its own weight and is bent by applying a greater load than the own weight. The bag-like member 110*a* has an approximately rectangular shape having its longitudinal direction corresponding to the Y direction when being viewed in the Z direction (as shown in FIG. 9). The bag-like member 110*a* is formed by laying two sheet members 111 and 112 one over the other and welding an outer circumferential edge 113. The containing portion 115 inside of the bag-like member 110*a* has an approximately rectangular shape (not shown) having its longitudinal direction corresponding to the Y direction, like the bag-like member 110*a*, when being viewed in the Z direction.

The first sheet member 111 is located on the −Z direction side and forms an upper surface of the bag-like member 110*a* (as shown in FIG. 14). The second sheet member 112 is located on the +Z direction side and forms a lower surface of the bag-like member 110*a*. The respective sheet members 111 and 112 have rectangular shapes of identical sizes (as shown in FIG. 9 and FIG. 13). The respective sheet members 111 and 112 may not be formed in a completely flat shape. It is preferable that the respective sheets 111 and 112 are formed in a bent shape to be gradually swelled toward the center in the bag-like member 110*a* (as shown in FIG. 14).

The respective sheet members 111 and 112 are made of a material having flexibility gas barrier property and liquid impermeability. The respective sheet members 111 and 112 may be formed from film members made of, for example, polyethylene terephthalate (PET), nylon or polyethylene. Each of the sheet members 111 and 112 may be configured by layering a plurality of films made of the above material. In this case, for example, an outer layer may be formed by a PET or nylon film having excellent impact resistance, and an inner layer may be formed by a polyethylene film having excellent ink resistance. Furthermore, a deposition layer of aluminum or the like may be added to the layered structure.

A supply port member 116 is attached to a +Y direction side end of the bag-like member 110 (as shown in FIG. 14). The supply port member 116 will be described later. A skeleton member configured to keep the shape of the containing portion 115 and a tubular member configured to introduce the liquid contained in the containing portion 115 to outside of the bag-like member 110*a* are placed inside of the bag-like member 110*a*. The internal structure of the bag-like member 110*a* is omitted from the illustration of FIG. 14.

Connection Member

The connection member 120*a* is attached to a +Y direction side end of the bag-like member 110*a* (as shown in FIG. 7, FIG. 9, FIG. 13 and FIG. 14). The connection member 120*a* is fixed to a front end portion in the mounting direction of the first mounting body 105*a*. The connection member 120*a* has a function of connecting with the corresponding first connection receiving portion 50*a* and a function of fixing the first liquid container 100*a* to the first case 61*a*.

The general appearance of the connection member 120*a* is described. The connection member 120*a* is generally formed in an approximately rectangular parallelepiped shape having its longitudinal direction corresponding to the X direction (as shown in FIG. 13 and FIG. 15). The width in the X direction of the connection member 120*a* is slightly larger than the width in the X direction of the bag-like member 110*a* (as shown in FIG. 9). The difference may be, for example, several mm to ten-odd mm. A main body of the connection member 120*a* may be formed by, for example, molding a resin material such as polypropylene.

The connection member 120*a* includes a first surface portion 121, a second surface portion 122, a third surface portion 123, a fourth surface portion 124, a fifth surface portion 125 and a sixth surface portion 126 (as shown in FIG. 15). In the description hereof, the "surface portion" may not be necessarily formed in a planar shape but may be formed in a curved shape or may have concaves, convexes, level differences, grooves, bends and inclined surfaces. The state that two surface portions "intersect with each other" means any of the state that two surface portions actually intersect with each other, the state that one extending surface of one surface portion intersects with the other surface portion, and the state that extending surfaces of two surface portions intersect with each other. A curved surface or an inclined surface may intervene between adjacent surface portions to smoothly connect the respective surface portions or to obliquely intersect with the respective surface portions, respectively.

The first surface portion 121 is arranged to face in the +Y direction and forms a front end face in the mounting direction of the first liquid container 100*a*. As described later, components provided to connect with the first connection receiving portion 50*a* are collectively provided on the first surface portion 121-side of the connection member 120*a*. The second surface portion 122 is located at a position opposed to the first surface portion 121 and is arranged to face in the −Y direction. The second surface portion 122 forms a rear end face in the mounting direction of the first liquid container 100*a*. The bag-like member 110*a* described above is fixed to the second surface portion 122. The third surface portion 123 is arranged to intersect with the first surface portion 121 and the second surface portion 122 and to face in the −Z direction. The third surface portion 123 forms an upper surface of the connection member 120*a*. A handle 170*a* is attached to the third surface portion 123 to enhance the handling performance of the first liquid container 100*a*. The handle 170*a* will be described later.

The fourth surface portion 124 is located at a position opposed to the third surface portion 123 and is arranged to intersect with the first surface portion 121 and the second surface portion 122. The fourth surface portion 124 is a surface portion on the +Z direction side to face in the +Z direction and forms a bottom surface of the connection member 120*a*. The fifth surface portion 125 is arranged to intersect with the first surface portion 121, the second surface portion 122, the third surface portion 123 and the fourth surface portion 124. The fifth surface portion 125 is arranged to face in the +X direction and forms a left side surface of the connection member 120*a*. The sixth surface portion 126 is located at a position opposed to the fifth surface portion 125 and is arranged to intersect with the first surface portion 121, the second surface portion 122, the third surface portion 123 and the fourth surface portion 124. The sixth surface portion 126 is arranged to face in the −X direction and forms a right side surface of the connection member 120*a*.

The connection member 120*a* includes a first member 127*f* and a second member 127*s* that are laid one over the other in the Z direction (as shown in FIG. 15). A slit 128 is formed in the connection member 120*a*. A +Y direction side end portion of the bag-like member 110*a* is inserted in the slit 128 formed in the second surface portion 122. The bag-like member 110*a* is fixed to the connection member 120*a* in such a state that the +Y direction side end portion thereof is placed between the first member 127*f* and the second member 127*s* in the Z direction. The details of the fixation structure of the bag-like member 110*a* in the connection member 120*a* will be described later.

The connection member 120*a* is provided with a liquid outlet 131, a container-side electrical connecting structure 140, a first receiving portion 150*f*, a second receiving portion 150*s* and a fitting structure receiving portion 155 as components provided to connect with the first connection receiving portion 50*a* (as shown in FIG. 7, FIG. 13 and FIG. 15). These components are collectively provided on the first surface portion 121-side of the connection member 120*a*. The following sequentially describes these components and then describes other components provided in the connection member 120*a*.

Liquid Outlet

The liquid outlet 131 is an opening portion that is open in the +Y direction (as shown in FIG. 15). Accordingly, the liquid outlet 131 has a center axis that is parallel to the Y direction. The liquid introducing element 51 of the first connection receiving portion 50*a* (shown in FIG. 15) is inserted toward the −Y direction into the liquid outlet 131. The liquid outlet 131 is provided at an approximate center position in the X direction in the first surface portion 121. The liquid outlet 131 is formed at a similar height position to the height of fixation of the bag-like member 110*a*.

The liquid outlet 131 communicates with the containing portion 115 that is a liquid containing space provided inside of the bag-like member 110*a*. The liquid outlet 131 communicates with the containing portion 115 via a supply port member 116 (shown in FIG. 14) that is mounted to the +Y direction side end portion of the bag-like member 110*a* and a tubular member 300 (shown in FIG. 32 that is referred to later) that is connected with the supply port member 116. The detailed description of the configuration of the liquid flow path in the first liquid container 100*a* is omitted. A valve structure that is kept closed prior to insertion of the liquid introducing element 51 into the liquid outlet 131 and that is opened by insertion of the liquid introducing element 51 and a seal structure (not shown) are provided inside of the connection member 120*a* for the purpose of preventing leakage of the liquid.

According to the embodiment, a peripheral portion 132 of the liquid outlet 131 is entirely recessed in the −Y direction in the first surface portion 121, and the liquid outlet 131 opens at a position protruded in the −Y direction from the peripheral portion 132. The liquid outlet 131 is accordingly surrounded by a wall portion formed by the peripheral portion 132. This configuration enhances the protection of the liquid outlet 131 and suppresses, for example, the user from mistakenly touching the liquid outlet 131. This configuration also reduces degradation such as damage or deformation caused by collision of the liquid outlet 131 when the first liquid container 100*a* is mistakenly dropped off. The peripheral portion 132 may be provided with a peripheral rib that is formed to surround the liquid outlet 131 and to be protruded in the +Y direction.

When the liquid introducing element 51 of the first connection receiving portion 50*a* is connected with the liquid outlet 131, the peripheral portion 132 comes into contact with and is pressed by the base end member 57 (shown in FIG. 5) provided in the periphery of the liquid introducing element 51 to receive an elastic force in the −Y direction. In the mounting state that the first liquid container 100*a* is mounted to the liquid ejection device 100, the first case 61*a* with the first liquid container 100*a* placed therein is engaged with the first connection receiving portion 50*a* (as described later). This configuration suppresses the first liquid container 100*a* and the first case 61*a* from moving in the −Y direction from the location area LA even when the peripheral portion 132 is biased in the −Y direction by the base end member 57.

Container-Side Electrical Connecting Structure

The container-side electrical connection structure 140 includes a substrate portion 141 provided to connect with the device-side electrical connecting structure 52 (as shown in FIG. 7, FIG. 15 and FIG. 16). The container-side electrical connecting structure 140 electrically comes into contact with the device-side electrical connecting structure 52 of the first connection receiving portion 50*a* (shown in FIG. 5). A plurality of terminals 142 are placed on a surface 141*s* of the substrate portion 141 (as shown in FIG. 16). The plurality of terminals 142 are located at positions corresponding to the terminal portions 52*t* of the device-side electrical connecting structure 52. A storage device configured to store information with regard to the liquid, a circuit configured to detect connection with the device-side electrical connecting structure 52 and the like (their illustration and detailed description are omitted) may be provided on an opposite side face opposite to the surface 141*s* of the substrate portion 141.

According to the embodiment, each of the terminals 142 has a substantially flat contact surface which the terminal portion 52*t* of the device-side electrical connecting structure 52 comes into contact with. The positions of contact areas CP of the respective terminals 142 that come into contact with the terminal portions 52*t* of the device-side electrical connecting structure 52 are shown by the broken line in FIG. 16. The contact areas CP of the respective terminals 142 are arrayed on an upper line and on a lower line in an array direction parallel to the X direction on the surface 141*s* of the substrate portion 141. The arrayed pattern of the terminals 142 and the contact areas CP is not limited to that illustrated in FIG. 16.

According to the embodiment, the container-side electrical connecting structure 140 is provided at a position nearer to a −X direction side end of the connection member 120*a* and is located on the −X direction side of the liquid outlet 131 (as shown in FIG. 9 and FIG. 15). A substrate placement structure 144 configured to place the substrate portion 141 of the container-side electrical connecting structure 140 is formed in the connection member 120*a* as a concave that is recessed in the −Y direction and in the +Z direction (as shown in FIG. 16). The substrate placement structure 144 includes an inclined surface 144*s* that is formed to face obliquely upward between the +Y direction and the −Z direction. The container-side electrical connecting structure 140 is placed on the inclined surface 144*s* to be inclined at a location angle substantially parallel to the inclined surface 144*s*. Accordingly, a normal vector of a contact surface between the surface 141*s* of the substrate portion 141 and the terminal portion 52*t* has a +Y direction vector component and a −Z direction vector component.

As described above, the substrate portion 141 is arranged such that its surface 141*s* faces in the −Z direction. In the case of electrical connection with the device-side electrical connecting structure 52, the container-side electrical connecting structure 140 electrically comes into contact with the device-side electrical connecting structure 52, while receiving at least a downward +Z direction force from the device-side electrical connecting structure 52. This downward force provides the good contact between the container-side electrical connecting structure 140 and the device-side electrical connecting structure 52 and enhances the electrical connectivity of the container-side electrical connecting structure 140.

According to the embodiment, the substrate portion 141 is arranged to be inclined as described above, so that its surface 141*s* also faces in the +Y direction. When the first liquid container 100*a* is moved in the +Y direction along with the first case 61*a* to connect the container-side electrical connecting structure 140 with the device-side electrical connecting structure 52, the force of moving the first case 61*a* in the +Y direction is used to form the electrical connection between the container-side electrical connecting structure 140 with the device-side electrical connecting structure 52.

This accordingly enhances the electrical connectivity between the container-side electrical connecting structure 140 and the device-side electrical connecting structure 52.

In the course of connection with the device-side electrical connecting structure 52, the terminal portions 52*t* of the device-side electrical connecting structure 52 move with rubbing against the contact surfaces of the terminals 142 of the container-side electrical connecting structure 140. This enables foreign substances and the like adhering to the contact surfaces of the terminals 142 of the container-side electrical connecting structure 140 to be removed by the terminal portions 52*t* of the device-side electrical connecting structure 52 and thereby further enhances the electrical connectivity of the container-side electrical connecting structure 140.

Additionally when the first liquid container 100*a* is taken out along with the first case 61*a* from the case placement unit 60, movement of the first liquid container 100*a* in the −Y direction is assisted by a force in the −Y direction received from the device-side electrical connecting structure 52. This configuration simplifies the detachment of the first liquid container 100*a*.

The substrate portion 141 is placed at a deep position of the substrate placement structure 144 (as shown in FIG. 16). The substrate portion 141 is placed between two wall portions 145 that are provided on the respective sides in the X direction and that are protruded in the −Z direction and in the +Y direction from the surface 141*s* of the substrate portion 141. These wall portions 145 serve as protection of the substrate portion 141. For example, this configuration suppresses the user from mistakenly touching the substrate portion 141 and suppresses the substrate portion 141 from being damaged when the first liquid container 100*a* is mistakenly dropped off.

Each of side wall surfaces 146 located on the respective sides in the X direction across the substrate portion 141 in the substrate placement structure 144 is provided with one guide recess 147 formed as a groove extended in the Y direction (as shown in FIG. 16). The guide recess 147 is open in the +Y direction. When the device-side electrical connecting structure 52 is connected with the container-side electrical connecting structure 140, the guide projections 52*g* provided on the respective sides in the X direction of the device-side electrical connecting structure 52 are inserted in the −Y direction into the corresponding guide recesses 147. This positions the substrate portion 141 relative to the device-side electrical connecting structure 52.

First Receiving Portion and Second Receiving Portion

The first receiving portion 150*f* and the second receiving portion 150*s* are provided on the first surface portion 121 of the connection member 120*a* (as shown in FIG. 15). When the first liquid container 100*a* is mounted to the liquid ejection device 10, the first receiving portion 150*f* receives the first positioning element 53*f* (shown in FIG. 5), whereas the second receiving portion 150*s* receives the second positioning element 53*s* (shown in FIG. 5). This configuration appropriately defines the mounting position of the first liquid container 100*a*.

According to the embodiment, the first receiving portion 150*f* and the second receiving portion 150*s* are formed as holes extended in the −Y direction and respectively have a first opening 151*f* and a second opening 151*s* (shown in FIG. 15). The respective openings 151*f* and 151*s* of the first receiving portion 150*f* and the second receiving portion 150*s* respectively receive insertion of the corresponding positioning elements 53*f* and 53*s* from the +Y direction side. According to the embodiment, the first opening 151*f* of the first receiving portion 150*f* and the second opening 151*s* of the second receiving portion 150*s* have different opening shapes. The details will be described later.

The first receiving portion 150*f* is located on the −X direction side of the liquid outlet 131 (as shown in FIG. 15). In the first liquid container 100*a*, the first receiving portion 150*f* is provided at a lower corner on the −X direction side of the first surface portion 121. The second receiving portion 150*s* is, on the other hand, located on the +X direction side of the liquid outlet 131. In the first liquid container 100*a*, the second receiving portion 150*s* is provided at a lower corner on the +X direction side of the first surface portion 121.

According to the embodiment, the liquid outlet 131 is placed between the pair of receiving portions 150*f* and 150*s* in the X direction. This configuration enhances the positioning accuracy in the X direction of the liquid outlet 131 relative to the liquid introducing element 51 (shown in FIG. 5) when the first liquid container 100*a* is mounted to the liquid ejection device 10. This accordingly improves the connectivity between the liquid introducing element 51 and the liquid outlet 131. According to the embodiment, the two receiving portions 150*f* and 150*s* are respectively provided at positions that at least partly overlap with guided elements 165*a* (described later) provided on the same side in the X direction when the first liquid container 100*a* is viewed in the Y direction. According to the embodiment, providing a large distance in the X direction between the pair of receiving portions 150*f* and 150*s* further enhances the positioning accuracy.

Fitting Structure Receiving Portion

The fitting structure receiving portion 155 is provided on the +X direction side of the liquid outlet 131 (as shown in FIG. 15). The fitting structure receiving portion 155 is provided at a position nearer to a +X direction side end at a +Y direction side end of the third surface portion 123. The fitting structure receiving portion 155 is located on an opposite side to the container-side electrical connecting structure 140 in the X direction across the liquid outlet 131. The fitting structure receiving portion 155 has a concave-convex structure including an array of a plurality of protrusions 156 in an approximately rectangular shape that are protruded to an identical height in the −Z direction and that are extended parallel to the −Y direction. An arrayed pattern in the X direction of the protrusions 156 and valleys 157 as concaves formed therebetween in the fitting structure receiving portion 155 is a reverse pattern of the arrayed pattern of the concave-convex structure in the fitting structure 55 (shown in FIG. 5) that is the object to the connected.

When the first liquid container 100*a* is moved in the +Y direction to be connected with the corresponding first connection receiving portion 50*a*, the concave-convex structure of the fitting structure receiving portion 155 is fitted for the concave-convex structure of the fitting structure 55. In the case of an inadequate combination of the first liquid container 100*a* with the first connection receiving portion 50*a*, on the other hand, the concave-convex structure of the fitting structure receiving portion 155 is not fitted for the concave-convex structure of the fitting structure 55. This configuration suppresses any non-corresponding wrong first liquid container 100*a* from being connected with the first connection receiving portion 50*a*.

Other Components of Connection Member

Recess

A recess 160 that is recessed in the −Z direction is provided on the fourth surface portion 124 of the connection member 120*a* (as shown in FIG. 15 and FIG. 16). According to the embodiment, the recess 160 is formed in an approximately rectangular shape and is extended in the +Y direction to the first surface portion 121 to be open in the +Y direction. In the process of placing the first liquid container 100*a* in the first case 61*a*, a convex (described later) formed on a bottom surface of the first case 61*a* is received in the recess 160. The recess 160 is formed at a position that at least partly overlaps with the container-side electrical connecting structure 140 when being viewed in the Z direction. The reason of such overlap arrangement will be described later.

Fitting Concave

A pair of fitting concaves 161 are formed in the fourth surface portion 124 of the connection member 120*a* (as shown in FIG. 15). The two fitting concaves 161 are arrayed in the X direction across the liquid outlet 131. The two fitting concaves 161 are respectively formed at positions adjacent to the peripheral portion 132 of the liquid outlet 131. According to the embodiment, the respective fitting concaves 161 are formed as concaves cut in the −Z direction. Like the recess 160 described above, the respective fitting concaves 161 are open in the +Y direction on the first surface portion 121. In the process of placing the first liquid container 100*a* in the first case 61*a*, parts of rear wall portions 203 of the first case 61*a* are inserted and fitted in the respective fitting concaves 161 (as shown in FIG. 7 and FIG. 13). This configuration positions the liquid outlet 131 in the X direction relative to the first case 61*a*.

Guided Element

The connection member 120*a* is provided with two guided elements 165*a* (as shown in FIG. 7, FIG. 9, FIG. 13 and FIG. 15). In the process of placing the first liquid container 100*a* in the first case 61*a*, the respective guided elements 165*a* are guided by corresponding guide elements 208*a* (described later) provided in the first case 61*a* to position the first liquid container 100*a* relative to the first case 61*a* (as shown in FIG. 13). In the state that the first liquid container 100*a* is placed in the first case 61*a*, the guide elements 208*a* are fitted in the guided elements 165*a*, so that the connection member 120*a* is fixed to the first case 61*a* (as shown in FIG. 7 and FIG. 9).

In the first liquid container 100*a*, one of the two guided elements 165*a* is provided on the fifth surface portion 125-side and the other on the sixth surface portion 126-side of the connection member 120*a* (as shown in FIG. 9). The two guided elements 165*a* of the first liquid container 100*a* are formed as concaves that are recessed in the X direction in the fifth surface portion 125 and in the sixth surface portion 126 (as shown in FIG. 15). According to the embodiment, the guided elements 165*a* are grooves in an approximately semicircular shape in a horizontal cut surface (as shown in FIG. 9) and are formed over the length in the direction of the arrow Z in the respective surface portions 125 and 126 of the connection member 120*a* (as shown in FIG. 15). A +Y direction side end portion of the guided element 165*a* has a chamfered shape. Each of the guided elements 165*a* accordingly has a planar portion 165*p* including a flat surface facing in the −Y direction.

According to the embodiment, the two guided elements 165*a* are formed to be arrayed in the X direction (as shown in FIG. 9). The two guided elements 165*a* are formed symmetrically with respect to the center of the first connection member 120*a* in the X direction. Each of the guided elements 165*a* is located on the −Y direction side of the liquid outlet 131, the container-side electrical connecting structure 140 and the fitting structure receiving portion 155. The two guided elements 165*a* are provided on the respective sides of the liquid outlet 131 in the X direction, so that the liquid outlet 131 is located between the two guided elements 165*a* in the X direction. The container-side electrical connecting structure 140 is located in the X direction between the liquid outlet 131 and the guided element 165*a* on the −X direction side. The fitting structure receiving portion 155 is located in the X direction between the liquid outlet 131 and the guided element 165*a* on the +X direction side. The details of the configuration and the functions of the guided elements 165 will be described later.

Handle

The handle 170*a* is a portion which the user holds, for example, when moving the first liquid container 100*a* (as shown in FIG. 7, FIG. 9, FIG. 13 and FIG. 15). According to the embodiment, the handle 170*a* is produced by molding a resin material such as polypropylene. The handle 170*a* includes a grip portion 171, two coupling portions 172 and 173 and two base end portions 174 and 175. The grip portion 171 is a portion which the user grasps with a hand. The grip portion 171 is extended in the direction of the arrow X. According to the embodiment, the width in the X direction of the grip portion 171 is slightly smaller than the width in the X direction of the connection member 120*a* and is slightly larger than the width in the X direction of the bag-like member 110*a* (as shown in FIG. 9).

The two coupling portions 172 and 173 are extended from the respective end portions of the grip portion 171 in a direction intersecting with the X direction. The first coupling portion 172 couples a +X direction side end portion of the grip portion 171 with the first base end portion 174. The second coupling portion 173 couples a −X direction side end portion of the grip portion 171 with the second base end portion 175. The respective base end portions 174 and 175 are shaft-like portions in an approximately cylindrical shape and are protruded along the X direction to be opposed to each other. It is preferable that the grip portion 171 and the two coupling portions 172 and 173 are appropriately thinned with a view to weight reduction.

The first base end portion 174 is protruded in the −X direction at an end of the first coupling portion 172, and the second base end portion 175 is protruded in the +X direction at an end of the second coupling portion 173. The two base end portions 174 and 175 are respectively connected with fixation structures 176 that are provided on the third surface portion 123 of the connection member 120*a*. The fixation structures 176 serve to fix the handle 170*a* to the first connection member 120*a* in a rotatable manner. According to the embodiment, the fixation structures 176 are formed as shaft holes extended in the X direction, and the respective base end portions 174 and 175 are inserted in the X direction in these shaft holes.

According to the embodiment, the two base end portions 174 and 175 are located between the two guided elements 165*a* in the X direction. According to the embodiment, the two base end portions 174 and 175 are provided at positions overlapping with the two guided elements 165*a* in the X direction. The distance in the X direction between the two base end portions 174 and 175 is shorter than the width in the X direction of the grip portion 171 (described later).

The handle 170*a* is provided at an exposed position in the state that the first liquid container 100*a* is placed in the first case 61*a*. The handle 170*a* is provided at a position that is visible and operable for the user.

Figure 17:
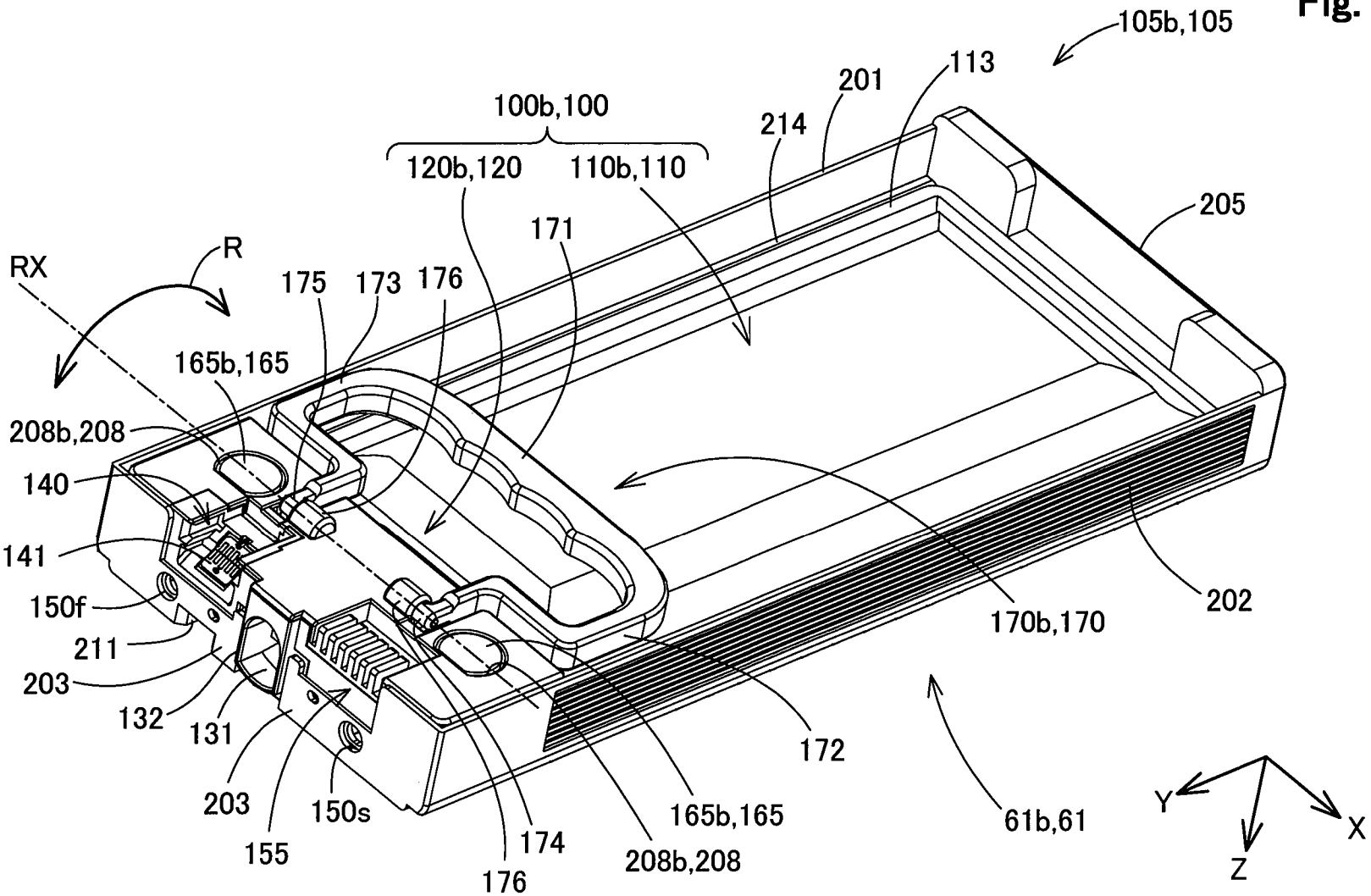
FIG. 17 is a schematic perspective view illustrating a second mounting body viewed from above.

The handle 170*a* is operated by the user to rotate relative to the connection member 120*a* as shown by an arrow R in FIG. 17. The handle 170*a* is rotatable both in a direction from the bag-like member 110*a*-side toward the first connection member 120*a*-side and in a direction from the first connection member 120*a*-side toward the bag-like member

110*a*-side. A rotating axis RX as the center of rotation of the handle 170*a* matches with center axes of the two base end portions 174 and 175. According to the embodiment, the rotating axis RX intersects with the mounting direction of the first liquid container 100*a* to the first connection receiving portion 50*a* (i.e., the Y direction that is the opening direction of the liquid outlet 131) and is along the X direction. According to the embodiment, the bag-like member 110*a* is located on the opposite side of the liquid outlet 131, the container-side electrical connecting structure 140 and the fitting structure receiving portion 155 across the rotating axis RX.

The handle 170*a* is rotatable in the state that the first liquid container 100*a* is placed in the first case 61*a*. In the mounting state that the first liquid container 100*a* is mounted to the liquid ejection device 10, the handle 170*a* is laid down toward the bag-like member 110*a*-side to be set at a first position shown in FIG. 7. For example, in the case of carrying the first liquid container 100*a*, the handle 170*a* is rotated toward the connection member 120*a*-side from the first position to be set at a second position (shown in FIG. 35).

Using the handle 170*a* enhances the convenience in handling the first liquid container 100*a*, for example, carrying the first liquid container 100*a* and mounting and dismounting the first liquid container 100*a* to and from the first case 61*a*. More specifically, according to the embodiment, the handle 170 has the grip portion 171 extended in the X direction and is thus readily gripped by the user. The handle 170 is fixed to the connection member 120 at the two points, i.e., at the two base end portions 174 and 175 and is thereby stably rotatable. The configuration of the handle 170 according to the embodiment provides the high operability and enhances the handling performance of the liquid container 100. The other details of the configuration and the functions of the handle 170*a* will be described later.

First Case

The following description refers to FIGS. 7 to 14. The first case 61*a* has an approximately rectangular parallelepiped shape having its longitudinal direction corresponding to the Y direction. The first case 61*a* is formed as a hollow box-like body that is open in the −Z direction and in the +Y direction. The first case 61*a* is made of, for example, a resin material such as polypropylene.

The first case 61*a* includes a bottom wall portion 200, two side wall portions 201 and 202, two rear wall portions 203 and a front wall portion 205. The bottom wall portion 200 is a wall portion in an approximately rectangular shape that forms a bottom of the first case 61*a* (as shown in FIG. 8 and FIG. 10) and is extended in the X direction and in the Y direction. In the description hereof, the term "extending" means continuously extending in a certain direction without being divided. Concavity convexity bends, holes and joints may be provided in the middle of the extension. The first liquid container 100*a* is placed on the bottom wall portion 200 (as shown in FIG. 7 and FIG. 13). The bottom wall portion 200 has such a size that receives at least the entire bag-like member 110*a* in the state that the first liquid container 100*a* is placed.

The first side wall portion 201 is a wall portion in an approximately rectangular shape that intersects with and is coupled with a longer side on the −X direction side of the bottom wall portion 200 and forms a right side wall portion of the first case 61*a* (as shown in FIG. 7 and FIG. 8). The second side wall portion 202 is a wall portion in an approximately rectangular shape that intersects with and is coupled with a longer side on the +X direction side of the bottom wall portion 200 and forms a left side wall portion of the first case 61*a* (as shown in FIG. 7 and FIG. 11). The first side wall portion 201 and the second side wall portion 202 are arranged parallel to each other and are extended substantially over the entire length in the Y direction. The first side wall portion 201 and the second side wall portion 202 are located across the bag-like member 110*a* of the first liquid container 100*a* in the X direction and serve to define the location angle in a direction along a horizontal plane of the bag-like member 110*a* in a direction along the Y direction.

The heights of the first side wall portion 201 and the second side wall portion 202 are substantially identical with the height of the third surface portion 123 of the connection member 120*a* of the first liquid container 100*a* (as shown in FIG. 7 and FIG. 11). According to the embodiment, part of the handle 170*a* at the first position is protruded from upper ends of the first side wall portion 201 and the second side wall portion 202 when the first mounting body 105*a* is viewed in the direction of the arrow X (as shown in FIG. 11).

The two rear wall portions 203 stand in the −Z direction at a +Y direction side end of the bottom wall portion 200 (as shown in FIG. 13). The respective rear wall portions 203 are provided on the respective ends in the X direction and are respectively coupled with the two side wall portions 201 and 202 on the same sides in the X direction. In the state that the first liquid container 100*a* is placed, the liquid outlet 131 and its peripheral portion 132 are located between the two rear wall portions 203 (as shown in FIG. 7). Parts of the rear wall portions 203 are inserted and fitted in the respective fitting concaves 161 formed on the respective sides in the X direction of the liquid outlet 131 to close the respective fitting concaves 161. The peripheral portion 132 is slightly protruded in the +Y direction from the two rear wall portions 203 (as shown in FIG. 7 and FIG. 9).

The two rear wall portions 203 are lower than the respective side wall portions 201 and 202 (as shown in FIG. 13). The two rear wall portions 203 are formed to cover lower portions of the connection member 120*a* that are below the container-side electrical connecting structure 140 and the fitting structure receiving portion 155 in the state that the first liquid container 100*a* is placed in the first case 61*a* (as shown in FIG. 7). The rear wall portions 203 are provided with through holes 203*h* at positions corresponding to the first receiving portion 150*f* and the second receiving portion 150*s* to receive insertion of the respective positioning elements 53*f* and 53*s* (as shown in FIG. 13).

The front wall portion 205 is extended in the X direction and in the Z direction at a −Y direction side end of the bottom wall portion 200 and is coupled with the bottom wall portion 200 and the two side wall portions 201 and 202 (as shown in FIG. 7). The front wall portion 205 is higher than the two side wall portions 201 and 202 (as shown in FIG. 7 and FIG. 11). This configuration facilitates the user to catch the front wall portion 205 with fingers when drawing out the first case 61*a* from the case placement unit 60. The handle 170*a* at the first position is covered and hidden by the front wall portion 205 when the first mounting body 105*a* is viewed in the Y direction (as shown in FIG. 12). Such space-saving arrangement of the handle 170*a* suppresses the handle 170*a* from disturbing mounting and dismounting of the first mounting body 105*a* to and from the case placement unit 60.

The two guide elements 208*a* protruded in the −Z direction are provided on a bottom surface 200*s* of the first case 61*a* that is a surface of the bottom wall portion 200 facing in the −Z direction (as shown in FIG. 13). As described above, the two guide elements 208*a* are respectively fitted in the two corresponding guided elements 165*a* provided in the connection member 120*a* of the first liquid container 100*a* (as shown in FIG. 7). This configuration positions the first liquid container 100*a* on the first case 61*a* and suppresses misalignment of the location position of the first liquid container 100*a*, for example, rotation in a direction along the horizontal direction.

In the first case 61*a*, the guide elements 208*a* are integrated with the respective side wall portions 201 and 202 (as shown in FIG. 13). The guide elements 208*a* are formed as projections that are protruded from the respective side wall portions 201 and 202 toward the location area of the connection member 120*a*. According to the embodiment, the guide elements 208*a* are formed in a semicylindrical shape. It is preferable that inside of the respective guide elements 208 is thinned with a view to reducing the weight of the first case 61*a*.

A +Y direction side end portion of the guide element 208*a* has a chamfered shape. The guide element 208*a* accordingly has a planar portion 208*p* including a flat surface facing in the +Y direction. When the guide elements 208*a* are fitted in the guided elements 165*a*, the planar portions 208*p* of the guide elements 208*a* are in surface contact with the planar portions 165*p* of the guided elements 165*a* (as shown in FIG. 7). When a load in the −Y direction is applied to the first liquid container 100*a* placed in the first case 61*a*, the contact between the planar portion 165*p* and the planar portion 208*p* that are opposed to each other in the Y direction stabilizes the position of the first liquid container 100*a*.

The height in the Z direction of each guide element 208*a* is substantially equal to the thickness in the Z direction of the first connection member 120*a*. Accordingly in the state that the first liquid container 100*a* is placed in the first case 61*a*, the respective guide elements 208*a* are placed over the entire height direction in the corresponding guided elements 165*a*. This configuration enables the planar portion 165*p* and the planar portion 208*p* that are opposed to each other in the Y direction to readily come into contact with each other when a load in the −Y direction is applied to the first liquid container 100*a* placed in the first case 61*a*. This configuration accordingly enhances the position stability of the first liquid container 100*a*.

Additionally, the first case 61*a* is provided with a projection 210 protruded in the −Z direction at a +Y direction side end on the bottom surface 200*s* of the bottom wall portion 200 (as shown in FIG. 13). The projection 210 is located at a position on the −X direction side of a center portion in the X direction. According to the embodiment, the projection 210 is formed in a rectangular shape. The projection 210 is formed to be hollow. An inner space 211 of the projection 210 will be described later. The projection 210 is received in the recess 160 of the connection member 120*a* described above (shown in FIG. 16) when the first liquid container 100*a* is placed in the first case 61*a*.

According to the embodiment, when the projection 210 is received in the recess 160, an outer wall surface of the projection 210 is in surface contact with an inner wall surface of the recess 160. Accordingly, the projection 210 is fitted in the recess 160. According to the embodiment, the projection 210 and the recess 160 accordingly serve as a positioning structure of the connection member 120*a* in the first case 61*a*.

As described above, according to the embodiment, at least part of the container-side electrical connecting structure 140 is placed above the recess 160. In the first mounting body 105*a*, at least part of the container-side electrical connecting structure 140 is placed above the projection 210. Accordingly even in the case of leakage of the liquid to the bottom surface 200*s* of the first case 61*a*, the projection 210 suppresses the liquid from flowing along the wall surface of the first case 61*a* and reaching the container-side electrical connecting structure 140.

A plurality of linear thin grooves extended in the Y direction (not shown) are arrayed parallel to each other in the X direction on a −Z direction side surface of the bottom wall portion 200. The thin grooves serve to guide the movement of the bag-like member 110*a* of the first liquid container 100*a* sliding on the surface of the bottom wall portion 200 in the Y direction.

Steps 214 that increase the height in a stepwise manner in the −Z direction are provided at a corner between the bottom wall portion 200 and the first side wall portion 201, at a corner between the bottom wall portion 200 and the second side wall portion 202, and at a corner between the bottom wall portion 200 and the front wall portion 205 (as shown in FIG. 7 and FIG. 13). When the first liquid container 100*a* is placed in the first case 61*a*, the steps 214 are in contact with the outer circumferential edge 113 of the bag-like member 110*a* to support the outer circumferential edge 113 of the bag-like member 110*a*. This configuration stabilizes the location position of the bag-like member 110*a* on the first case 61*a*.

According to the embodiment, in the first liquid container 100*a*, only the location position of the connection member 120*a* is fixed on the first case 61*a*, and the bag-like member 110*a* other than its +Y direction side end is substantially not bound to the first case 61*a*. The bag-like member 110*a* is placed on the first case 61*a* in such a state that the bag-like member 110*a* is allowed to move in a direction away from the first case 61*a*. The configuration that the first liquid container 100*a* is not unnecessarily bound to the first case 61*a* simplifies mounting and dismounting of the first liquid container 100*a* to and from the first case 61*a*. This configuration also suppresses any extra load other than the gravity from being applied to the bag-like member 110*a* and thereby suppresses the pressure condition in the containing portion 115 inside of the bag-like member 110 from being deteriorated by the extra load.

The configuration of the lower surface side of the bottom wall portion 200 is described with reference to FIG. 8 and FIG. 10. A groove 215 is provided at a +Y direction side end on a +Z direction side surface of the bottom wall portion 200. According to the embodiment, the groove 215 is defined and formed by a rib 216. The groove 215 forms a case-side fixation structure 220. A +Y direction side end of the groove 215 is formed by the inner space 211 of the projection 210 described above. More specifically the inner space 211 of the projection 210 forms part of the case-side fixation structure 220 and is included in the case-side fixation structure 220. The inner space 211 of the projection 210 is open in the +Y direction and forms an inlet of the groove 215 (case-side fixation structure 220).

The case-side fixation structure 220 serves in cooperation with the device-side fixation structure 54 (shown in FIG. 5) to restrict the movement of the first case 61*a* in the Y direction. The case-side fixation structure 220 is provided with an engaged element (described later) that is engaged with the protrusion 54*p* (engagement element 54*p*) of the device-side fixation structure 54 in the case placement state that the first case 61*a* is placed in a predetermined location area LA of the case placement unit 60 (shown in FIG. 3). The engagement of the protrusion 54*p* with the engaged element restricts the movement of the first case 61*a* in the −Y direction. According to the embodiment, the groove 215 forming the case-side fixation structure 220 is configured to have a heart cam groove structure that is a looped groove structure described later. The configuration of the case-side fixation structure 220 and the mechanism of engagement between the engaged element of the case-side fixation structure 220 and the protrusion 54*p* (engagement element 54*p*) of the device-side fixation structure 54 will be described later.

A plurality of rail ribs 230 and a plurality of legs 231 are also provided on the +Z direction side surface of the bottom wall portion 200. The rail ribs 230 are formed as convex wall portions protruded in the +Z direction and are linearly extended at substantially fixed widths in the Y direction. As described above, the rail ribs 230 are fitted in the rail grooves 64 provided in the bottom surface of the case placement unit 60 to guide the movement of the first case 61*a* in the Y direction. The plurality of legs 231 are protruded in the +Z direction and respectively have an identical height (a shown in FIG. 12). The plurality of legs 231 serve to appropriately keep the location position of the first case 61*a* in the location area LA of the case placement unit 60 (shown in FIG. 3).

Second Mounting Body: Second Liquid Container and Second Case

The following first describes the schematic configuration of the second liquid container 100*b* and subsequently describes the schematic configuration of the second case 61*b*. In the description below and the drawings referred to, the components that are identical with or correspond to the various components of the first liquid container 100*a* and the first case 61*a* described above are expressed by the same reference signs or by the reference signs including the same numerals with different alphabet suffixes. The components in the second liquid container 100*b* or in the second case 61*b* expressed by these corresponding reference signs have similar functions to those of the corresponding components in the first liquid container 100*a* or in the first case 61*a*. The various advantageous effects described above with reference to the first liquid container 100*a* and the first case 61*a* are thus achieved by such corresponding components in the second liquid container 100*b* and the second case 61*b*. The same applies to other embodiments other than the first embodiment and modifications described later.

Figure 18:
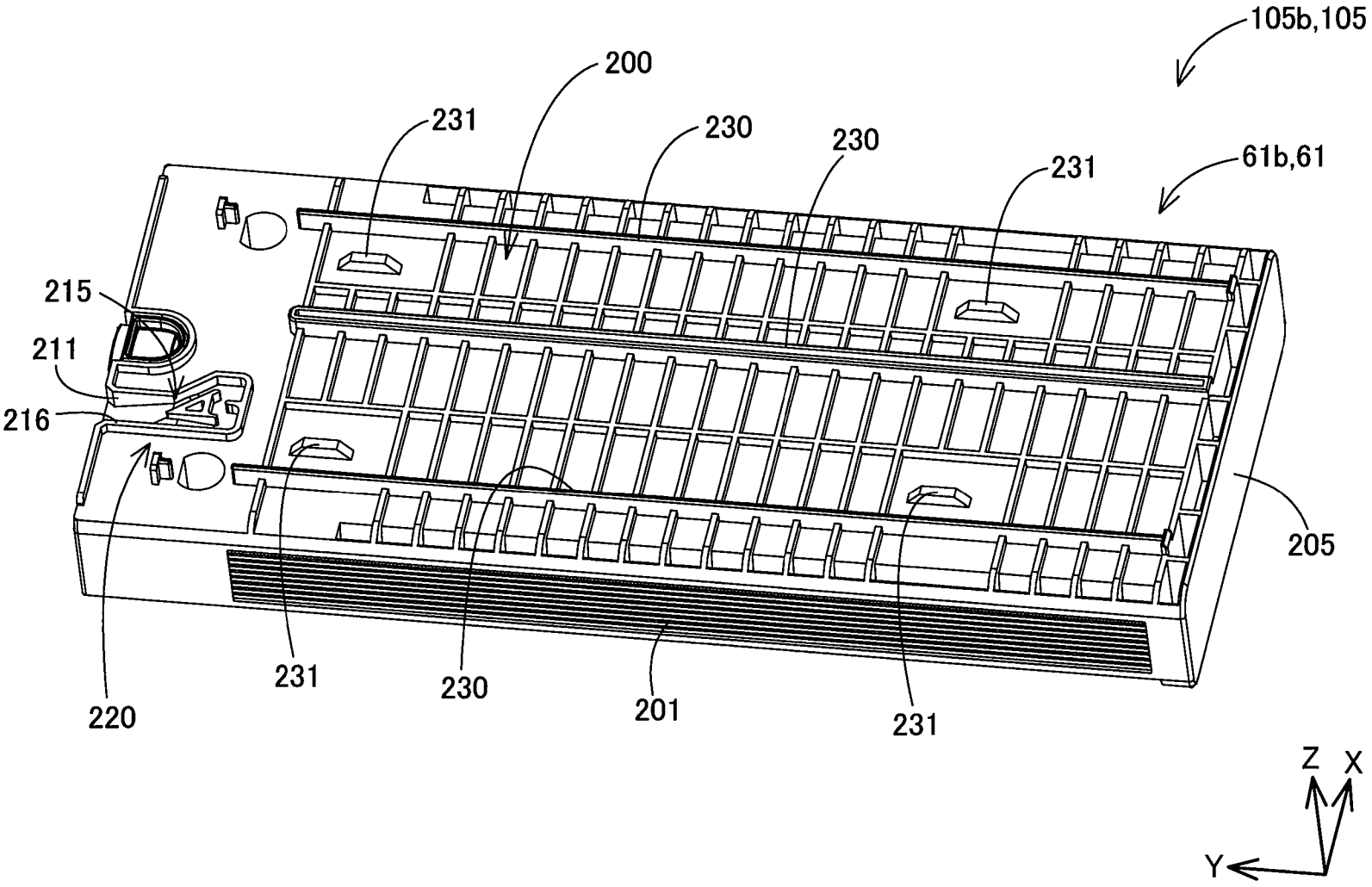
FIG. 18 is a schematic perspective view illustrating the second mounting body viewed from below.
Figure 19:
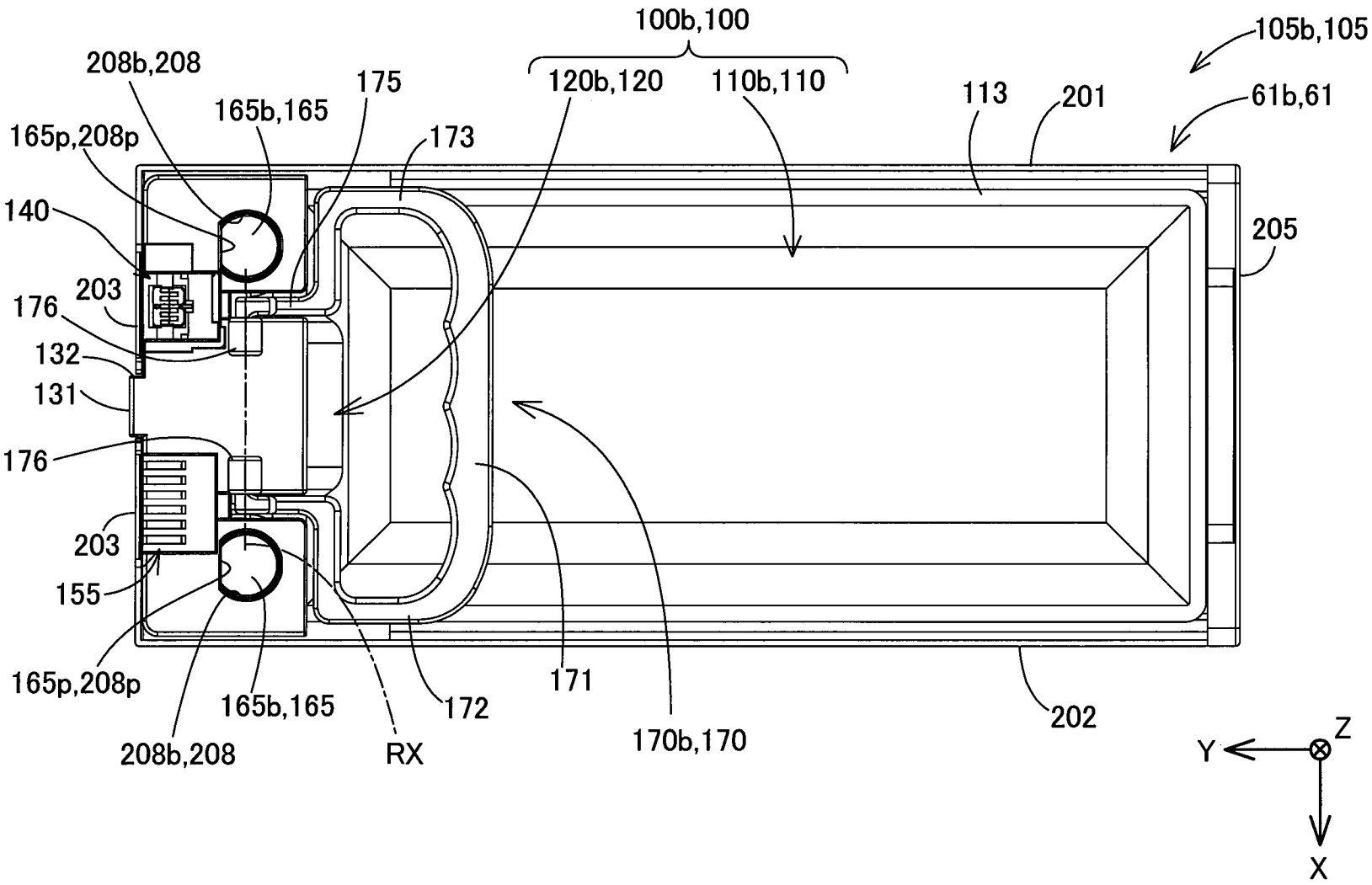
FIG. 19 is a schematic diagram illustrating an upper surface side of the second mounting body.
Figure 20:
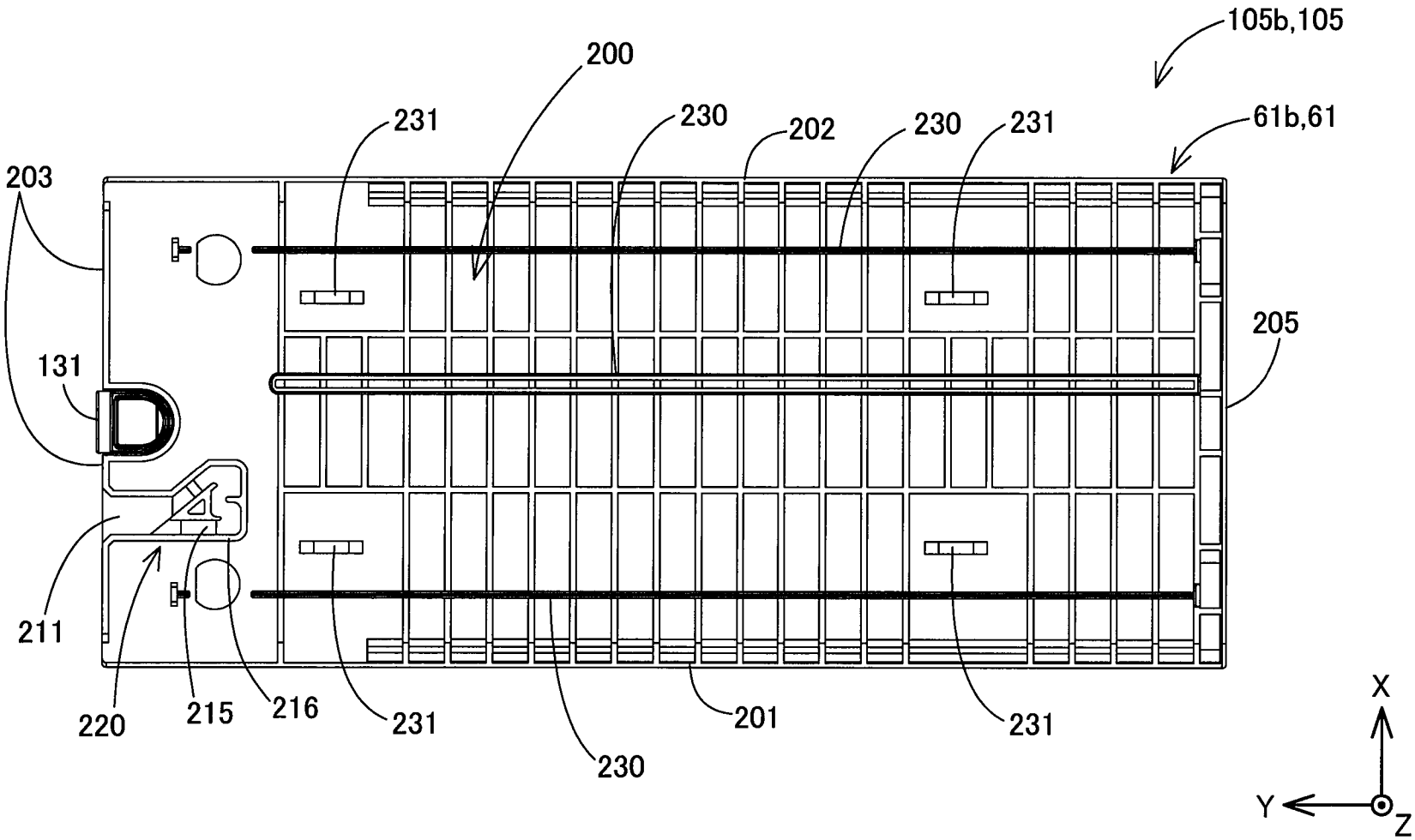
FIG. 20 is a schematic diagram illustrating a lower surface side of the second mounting body.
Figure 21:
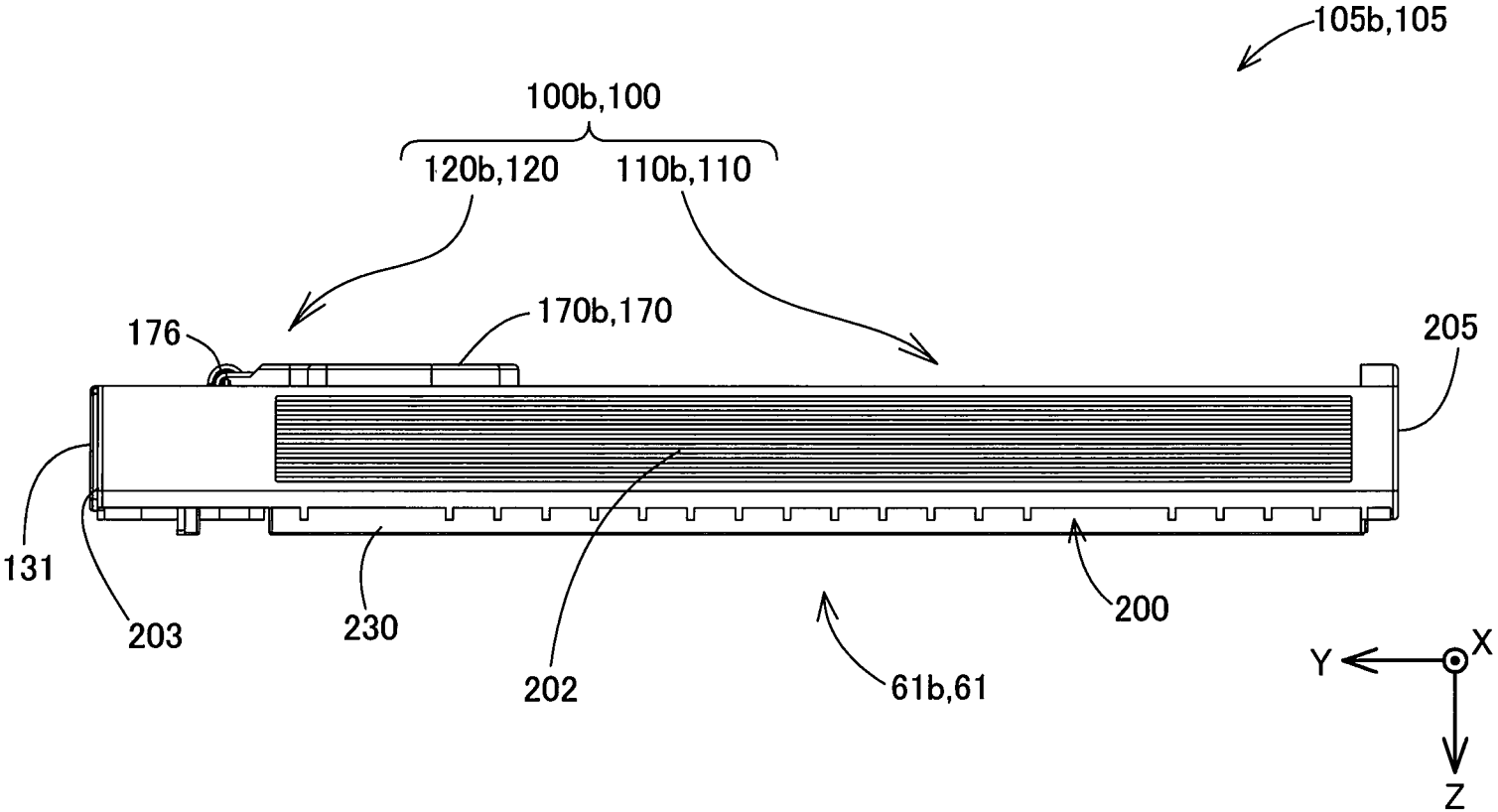
FIG. 21 is a schematic diagram illustrating a left side surface side of the second mounting body.
Figure 22:
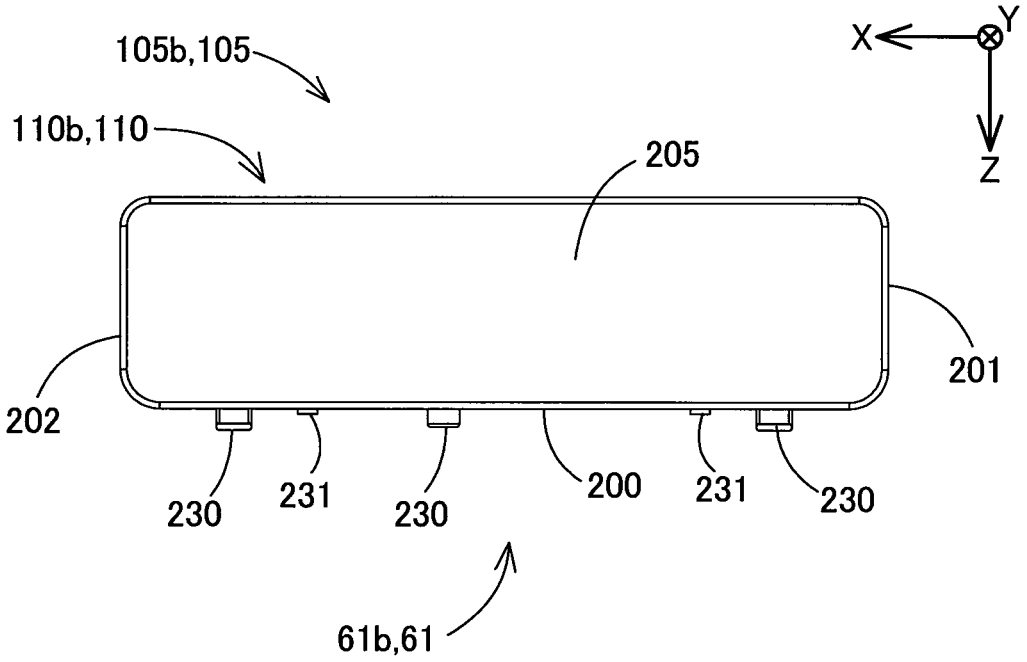
FIG. 22 is a schematic diagram illustrating a front surface side of the second mounting body.
Figure 23:
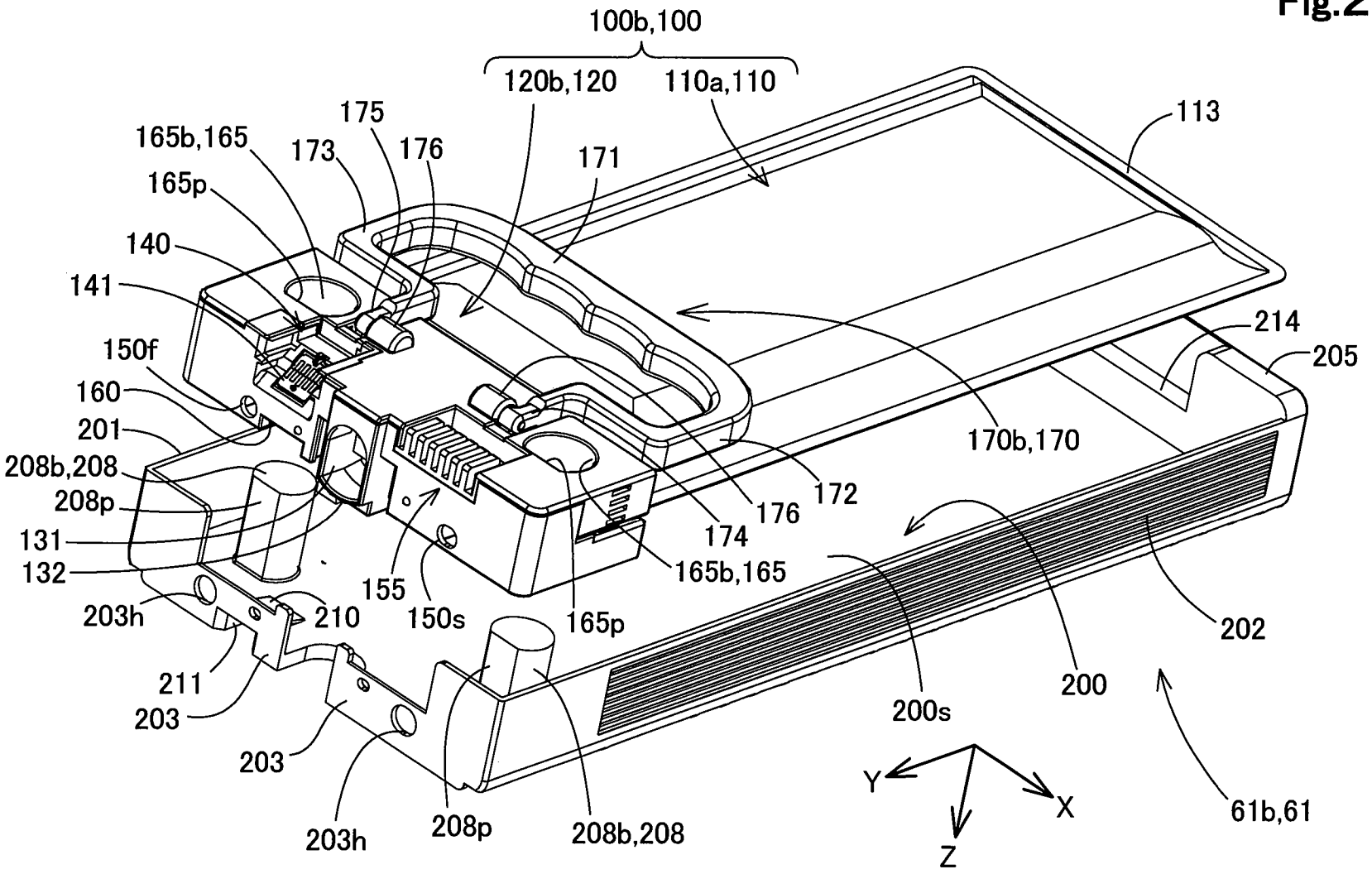
FIG. 23 is a schematic exploded perspective view illustrating a second case and a second liquid container separated from each other.
Figure 24:
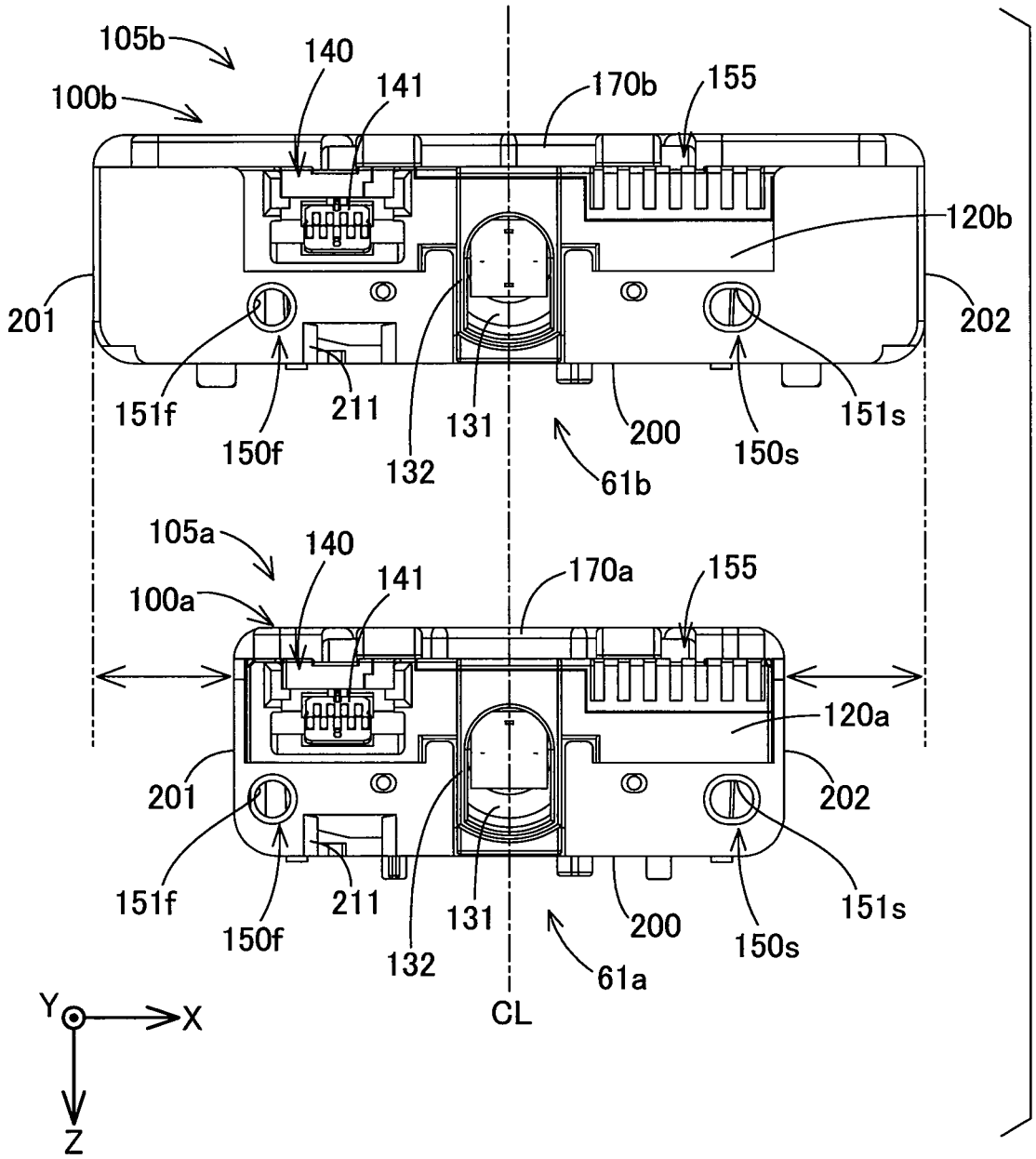
FIG. 24 is a schematic diagram illustrating a rear surface side of the second mounting body.

The following description refers to FIGS. 17 to 24. FIG. 17 is a schematic perspective view illustrating the second mounting body 105*b* viewed from above. FIG. 18 is a schematic perspective view illustrating the second mounting body 105*b* viewed from below. FIG. 19 is a schematic diagram illustrating an upper surface side of the second mounting body 105*b* when the second mounting body 105*b* is viewed in the +Z direction. FIG. 20 is a schematic diagram illustrating a lower surface side of the second mounting body 105*b* when the second mounting body 105*b* is viewed in the −Z direction. FIG. 21 is a schematic diagram illustrating a left side surface side of the second mounting body 105*b* when the second mounting body 105*b* is viewed in the −X direction. FIG. 22 is a schematic diagram illustrating a front surface side of the second mounting body 105*b* (i.e., a rear end side in the mounting direction) when the second mounting body 105*b* is viewed in the +Y direction. FIG. 23 is a schematic exploded perspective view illustrating the second liquid container 100*b* taken out from the second case 61*b* when being viewed from below. FIG. 24 is a schematic diagram illustrating a rear surface side of the second mounting body 105*b* (i.e., a front end side in the mounting direction) when the second mounting body 105*b* is viewed in the −Y direction. For the purpose of comparison, the first mounting body 105*a* viewed in the same direction is illustrated in the lower part of FIG. 24. Center axes CL in the X direction of the respective mounting bodies 105*a* and 105*b* are shown by the one-dot chain line in FIG. 24.

Second Liquid Container

The second liquid container 100*b* has a substantially similar configuration to that of the first liquid container 100*a* except the configuration described below (as shown in FIG. 17, FIG. 19 and FIG. 23). The second liquid container 100*b* has a larger width in the X direction than the width of the first liquid container 100*a*, with a view to increasing the capacity of the liquid compared with the first liquid container 100*a*.

Like the first liquid container 100*a*, the second liquid container 100*b* includes a bag-like member 110*b* and a connection member 120*b* (as shown in FIG. 17, FIG. 19 and FIG. 23). The bag-like member 110*b* of the second liquid container 100*b* has a substantially similar configuration to that of the bag-like member 110*a* of the first liquid container 100*a*, except a larger width in the X direction.

The connection member 120*b* of the second liquid container 100*b* has a substantially similar configuration to that of the connection member 120*a* of the first liquid container 100*a* except the configuration described below (as shown in FIG. 23 and FIG. 24). The connection member 120*b* has respective end portions in the X direction that are respectively protruded in the +X direction and in the −X direction according to the width in the X direction of the bag-like member 110*b*, compared with the connection member 120*a* of the first liquid container 100*a*. The width in the X direction of the connection member 120*b* is slightly larger than the width in the X direction of the bag-like member 110*b*, and respective corners on the −Y direction side of the connection member 120*b* are held by the connection member 120*b* (as shown in FIG. 19).

The location layout of the respective components on a +Y direction side end of the connection member 120*b* of the second liquid container 100*b* for connection with the second connection receiving portion 50*b* is substantially similar to that of the connection member 120*a* of the first liquid container 100*a* (as shown in FIG. 24). The positions of the respective components (the container-side electrical connecting structure 140, the two receiving portions 150*f* and 150*s*, the fitting structure receiving portion 155, the recess 160 and the fitting concave 161) relative to the liquid outlet 131 are common to the two different connection members 120*a* and 120*b*.

The two guided elements 165*b* are provided on respective sides in the X direction of the second connection member 120*b* (as shown in FIG. 17, FIG. 19 and FIG. 23). The two guided elements 165*b* are provided as through holes pierced through the connection member 120*b* in the Z direction at positions nearer to the respective ends in the X direction of the connection member 120*b* (as shown in FIG. 23).

The guided element 165*b* has an approximately circular opening section on a horizontal cut surface (as shown in FIG. 19). A +Y direction side end portion of the guided element 165*a* has a chamfered shape. A planar portion 165*p* including a flat surface facing in the −Y direction is accordingly formed at the +Y direction side end portion of the guided element 165*a* (as shown in FIG. 19 and FIG. 23). According to the embodiment, the two guided elements 165*b* of the second connection member 120*b* respectively have portions substantially similar to the shape of the corresponding guided elements 165*a* of the first connection member 120*a*, at positions corresponding to the corresponding guided elements 165*a* of the first connection member 120*a*.

The guided elements 165*b* are located on the −Y direction side of the liquid outlet 131, the container-side electrical connecting structure 140 and the fitting structure receiving portion 155 (as shown in FIG. 17, FIG. 19 and FIG. 23). The two guided elements 165*b* are provided to be arrayed in the X direction (as shown in FIG. 19). The two guided elements 165*b* are formed symmetrically with respect to the center of the second connection member 120*b* in the X direction. The other details of the guided elements 165*b* will be described later.

A handle 170*b* is provided on the third surface portion 123 of the second connection member 120*b* (as shown in FIG. 17). The handle 170*b* of the second connection member 120*b* has a substantially similar configuration to that of the handle 170*a* of the first liquid container except a greater length in the X direction of a grip portion 171.

Like the handle 170*a*, the handle 170*b* is operated by the user to rotate about the axis RX along the X direction as shown by an arrow R (shown in FIG. 17) and to be set at a first position or at a second position. The width in the X direction of the grip portion 171 of the handle 170*b* is slightly smaller than the width in the X direction of the connection member 120*b* and is slightly larger than the width in the X direction of the bag-like member 110*b*. Two base end portions 174 and 175 of the handle 170*b* are located between the two guided elements 165*b* in the X direction. The distance between the two base end portions 174 and 175 of the handle 170*b* is substantially equal to the distance between the two base end portions 174 and 175 in the first liquid container 100*a*.

As described above, the connection member 120*b* of the second liquid container 100*b* has only a little change from the connection member 120*a* of the first liquid container 100*a*. This configuration allows common components to be used and thereby reduces the manufacturing cost. The second connection receiving portion 50*b* corresponding to the connection member 120*b* of the second liquid container 100*b* also has a substantially similar configuration to that of the first connection receiving portion 50*a* corresponding to the connection member 120*a* of the first liquid container 100*a*. This reduces the manufacturing cost of the connection members 120.

In the description below, the bag-like member 110*a* of the first liquid container 100*a* and the bag-like member 110*b* of the second liquid container 100*b* are collectively called "bag-like member 110" unless there is a need to distinguish the bag-like members 110*a* and 110*b* from each other. Similarly the connection members 120*a* and 120*b*, the guided elements 165*a* and 165*b* and the handles 170*a* and 170*b* are collectively called "connection member 120", "guided element 165" and "handle 170", respectively.

Second Case

The second case 61*b* has a substantially similar configuration to that of the first case 61*a* except the configuration described below. The second case 61*b* has a width in the X direction that is changed corresponding to the width in the X direction of the second liquid container 100*b* (as shown in FIG. 17 and FIG. 24). In the second case 61*b*, a first side wall portion 201 and a second side wall portion 202 are provided at positions respectively protruded in the +X direction and in the −X direction, compared with the first case 61*a* (as shown in FIG. 24). In the second case 61*b*, a rear wall portion 203 (shown in FIG. 24) and a front wall portion 205 (shown in FIG. 22) are respectively extended in the X direction, compared with the first case 61*a*.

The second case 61*b* is provided with two guide elements 208*b* corresponding to the guided elements 165*b* of the second connection member 120*b* (as shown in FIG. 17, FIG. 19 and FIG. 23). In the second case 61*b*, each of the two guide elements 208*b* are protruded in the −Z direction from a bottom surface 200*s* of a bottom wall portion 200 at positions away from the first side wall portion 201 and the second side wall portion 202 (as shown in FIG. 23). According to the embodiment, the respective guide elements 208*b* are in an approximately cylindrical shape. It is preferable that inside of the respective guide elements 208*b* is thinned.

A +Y direction side curved surface of each guide element 208*b* has a chamfered shape. The guide element 208*b* accordingly has a planar portion 208*p* including a flat surface facing in the +Y direction (as shown in FIG. 19 and FIG. 23). As in the case of the first mounting body 105*a*, in the second mounting body 105*b*, when the guide element 208*b* is fitted in the guided element 165*b*, the planar portion 208*p* of the guide element 208*b* is in surface contact with the planar portion 165*p* of the guided element 165*b* (as shown in FIG. 17 and FIG. 19).

The height in the Z direction of each guide element 208*b* is substantially equal to the thickness in the Z direction of the second connection member 120*b*. Accordingly in the state that the second liquid container 100*b* is placed in the second case 61*b*, the respective guide elements 208*b* pass through the corresponding guided elements 165*b* (as shown in FIG. 17). This configuration enables the planar portion 165*p* (shown in FIG. 19) and the planar portion 208*p* (shown in FIG. 19) that are opposed to each other in the Y direction to readily come into contact with each other when a load in the −Y direction is applied to the second liquid container 100*b* placed in the second case 61*b*. This configuration accordingly enhances the position stability of the second liquid container 100*b*.

In the description below, the guide elements 208*a* of the first liquid container 100*a* and the guide elements 208*b* of the second liquid container 100*b* are collectively called "guide elements 208" unless there is a need to distinguish the guide elements 208*a* and 208*b* from each other.

Mounting Mechanism of Liquid Container

Figure 25:
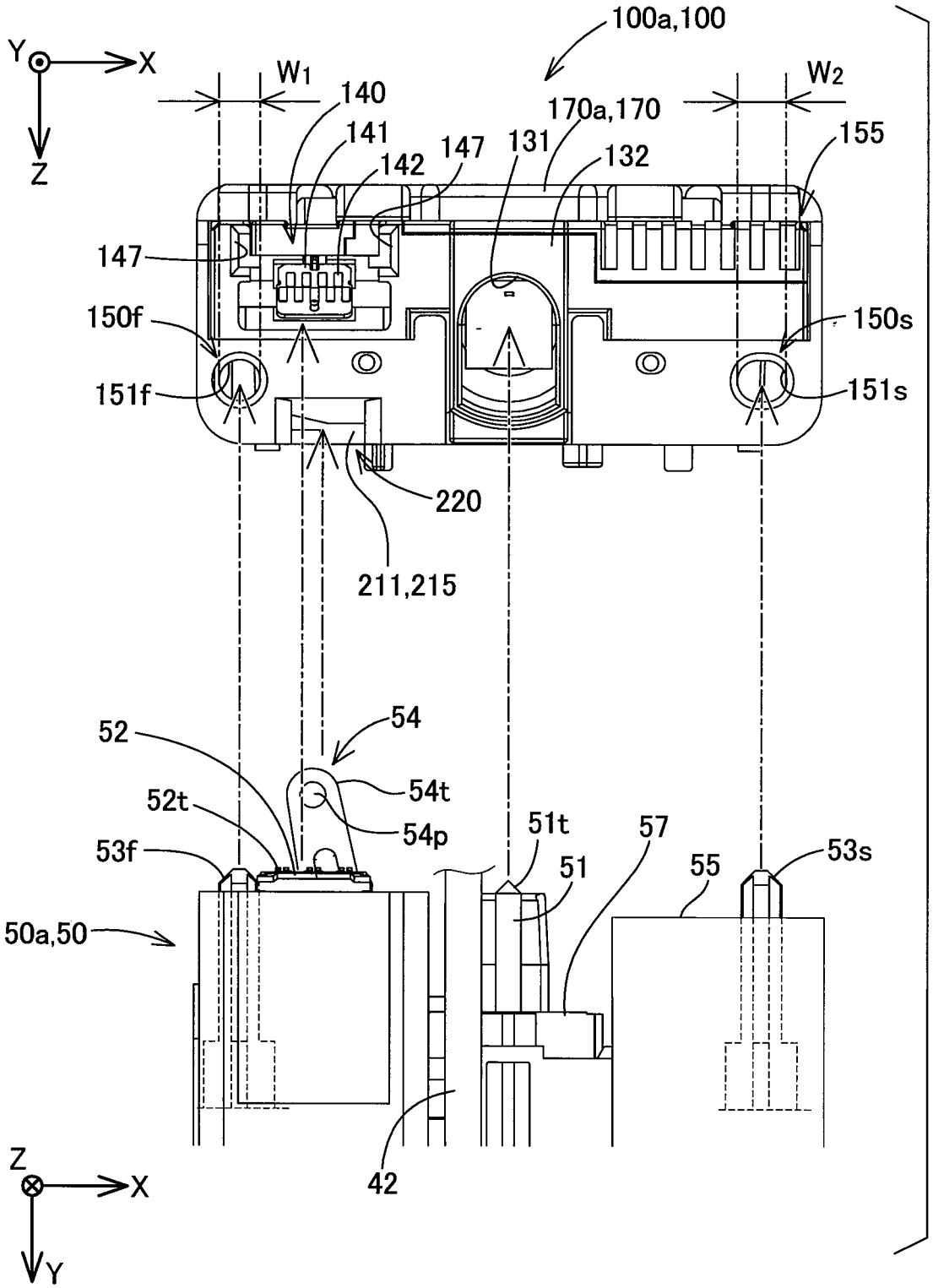
FIG. 25 is a schematic diagram illustrating a mechanism of mounting a liquid container to a connection receiving portion.

The following describes the mounting mechanism of the liquid container 100 to the connection receiving portion 50 with reference to FIG. 25. The upper part of FIG. 25 illustrates the first liquid container 100*a* placed in the first case 61*a* when being viewed in the −Y direction. The lower part of FIG. 25 illustrates part of the first connection receiving portion 50*a* viewed in the −Z direction to be corresponded to the first liquid container 100*a* shown in the upper part. The following description is common to mounting of the first liquid container 100*a* to the first connection receiving portion 50*a* and mounting of the second liquid container 100*b* to the second connection receiving portion 50*b*.

In the case placement unit 60 (shown in FIG. 3), when the liquid container 100 placed in the case 61 is moved in the +Y direction toward the location area LA, the pair of positioning elements 53*f* and 53*s* of the connection receiving portion 50 are first inserted into the pair of receiving portions 150*f* and 150*s* of the liquid container 100, so as to position the liquid outlet 131 of the liquid container 100.

The liquid introducing element 51 of the connection receiving portion 50 is subsequently inserted into the liquid outlet 131 of the liquid container 100, so that the liquid outlet 131 of the liquid container 100 is connected with the liquid introducing element 51 of the connection receiving portion 50. Before the connection of the liquid outlet 131 with the liquid introducing element 51 is fully completed, the peripheral portion 132 provided in the periphery of the liquid outlet 131 comes into contact with the base end member 57 provided in the periphery of the liquid introducing element 51. The liquid container 100 and the case 61 are pressed in the +Y direction until the connection of the liquid outlet 131 with the liquid introducing element 51 is completed, so that the base end member 57 is displayed in the +Y direction. The liquid container 100 is biased in the −Y direction by the biasing member 57*e* (shown in FIG. 5) provided inside of the base end member 57.

In parallel with the connection of the liquid outlet 131 with the liquid introducing element 51 described above, the device-side electrical connecting structure 52 of the connection receiving portion 50 is connected with the container-side electrical connecting structure 140 of the liquid container 100. The pair of guide projections 52*g* (shown in FIG. 5) of the device-side electrical connecting structure 52 are first inserted into the corresponding guide recesses 147. This positions the substrate portion 141 of the container-side electrical connecting structure 140 relative to the device-side electrical connecting structure 52. The terminal portions 52*t* of the device-side electrical connecting structure 52 are subsequently inserted into the substrate placement structure 144 of the liquid container 100 to electrically come into contact with the corresponding terminals 142 of the substrate portion 141. On completion of the connection between the liquid outlet 131 and the liquid introducing element 51, the electrical connection is also established between the container-side electrical connecting structure 140 and the device-side electrical connecting structure 52.

The device-side fixation structure 54 of the connection receiving portion 50 is inserted into the inner space 211 of the projection 210 that forms the inlet of the groove 215 of the case 61, prior to insertion of the pair of positioning elements 53*f* and 53*s* into the pair of receiving portions 150*f* and 150*s*. On completion of the connection between the liquid outlet 131 and the liquid introducing element 51, the protrusion 54*p* of the device-side fixation structure 54 is engaged with the engaged element of the case-side fixation structure 220 of the case 61 (shown in FIG. 10 and FIG. 20) by an engagement mechanism described later. The state that the position of the case 61 is fixed in the predetermined location area LA (shown in FIG. 3) in the case 61 is expressed as "the case placement state that the case 61 is mounted to the case placement unit 60".

In the liquid container 100 of the embodiment, the container-side electrical connecting structure 140 is located between the liquid outlet 131 and the first receiving portion 150*f* in the X direction. Accordingly the pair of positioning elements 53*f* and 53*s* and the pair of receiving portions 150*f* and 150*s*, along with the liquid outlet 131, serve to enhance the positioning accuracy in the X direction of container-side electrical connecting structure 140 relative to the device-side electrical connecting structure 52.

In the liquid container 100 of the embodiment, the recess 160 that defines the inner space 211 serving as the inlet portion of the case-side fixation structure 220 is located between the liquid outlet 131 and the first receiving portion 150*f* in the X direction. The pair of positioning elements 53*f* and 53*s* and the pair of receiving portions 150*f* and 150*s* accordingly guide the movement of the device-side fixation structure 54 in the Y direction after the insertion of the device-side fixation structure 54 in the groove 215 and enhances the positioning accuracy of the device-side fixation structure 54 relative to the case-side fixation structure 220.

Additionally in the liquid container 100 of the embodiment, the container-side electrical connecting structure 140 and the recess 160 are provided between the liquid outlet 131 and the first receiving portion 150*f* as described above. This configuration increases the distance in the X direction between the pair of receiving portions 150*f* and 150*s*. This configuration thus further enhances the positioning accuracy by the pair of positioning elements 53*f* and 53*s* and the pair of receiving portions 150*f* and 150*s*.

As described above, in the liquid container 100 of the embodiment, the first opening 151*f* of the first receiving portion 150*f* and the second opening 151*s* of the second receiving portion 150*s* have different opening shapes. An opening width W2 in the X direction of the second opening 151*s* is larger than an opening width W1 in the X direction of the first opening 151*f*. This configuration provides a margin for an angle in the horizontal direction of the second positioning element 53*s* relative to the Y direction in the case of insertion of the second positioning element 53*s* into the second receiving portion 150*s*. This facilitates the operation of connecting the liquid container 100 with the connection receiving portion 50. Providing such a margin reduces the stress generated by insertion of the second positioning element 53*s* into the second receiving portion 150*s* in the process of connecting the liquid container 100 with the connection receiving portion 50. According to the embodiment, the opening width in the Z direction of the first opening 151*f* and the opening width in the Z direction of the second opening 151*s* are substantially equal to each other. The opening width in the Z direction of the first opening 151*f* and the opening width in the Z direction of the second opening 151*s* may however, be different from each other.

Figure 26A:
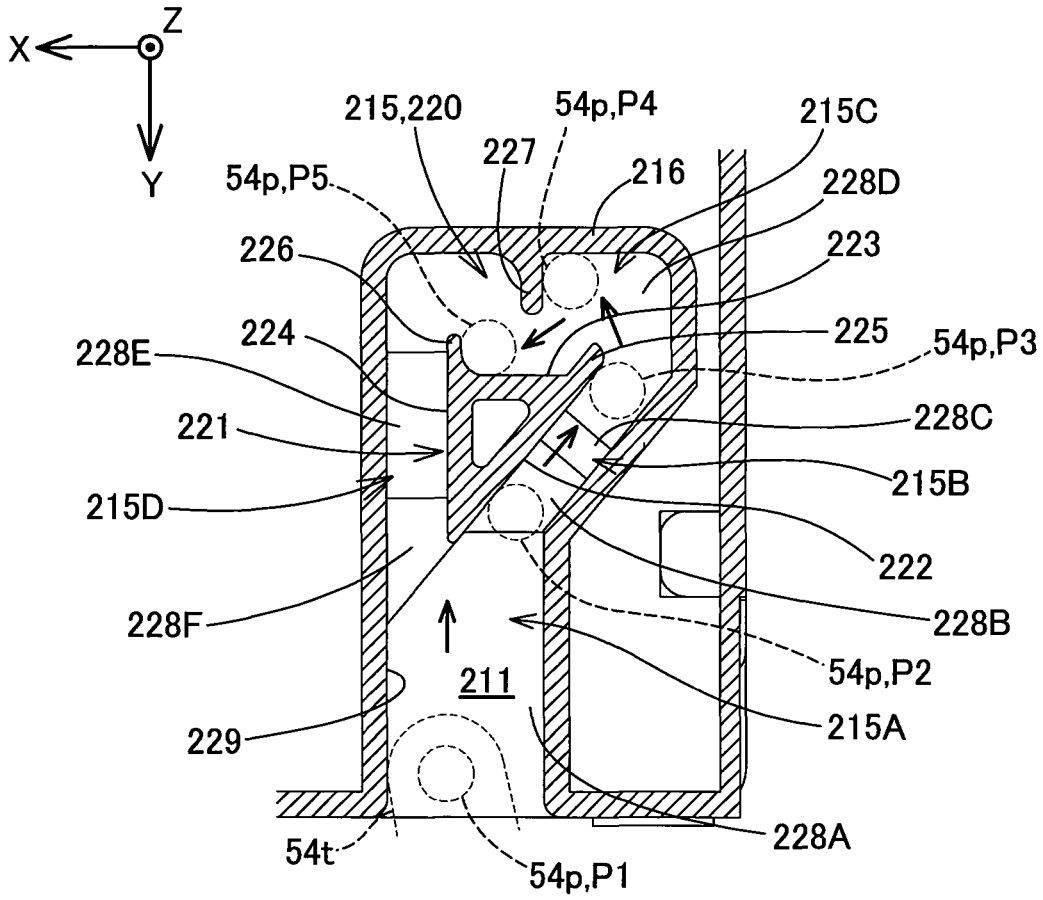
FIG. 26A is a schematic diagram illustrating a mechanism of engaging an engagement element with an engaged element.
Figure 26B:
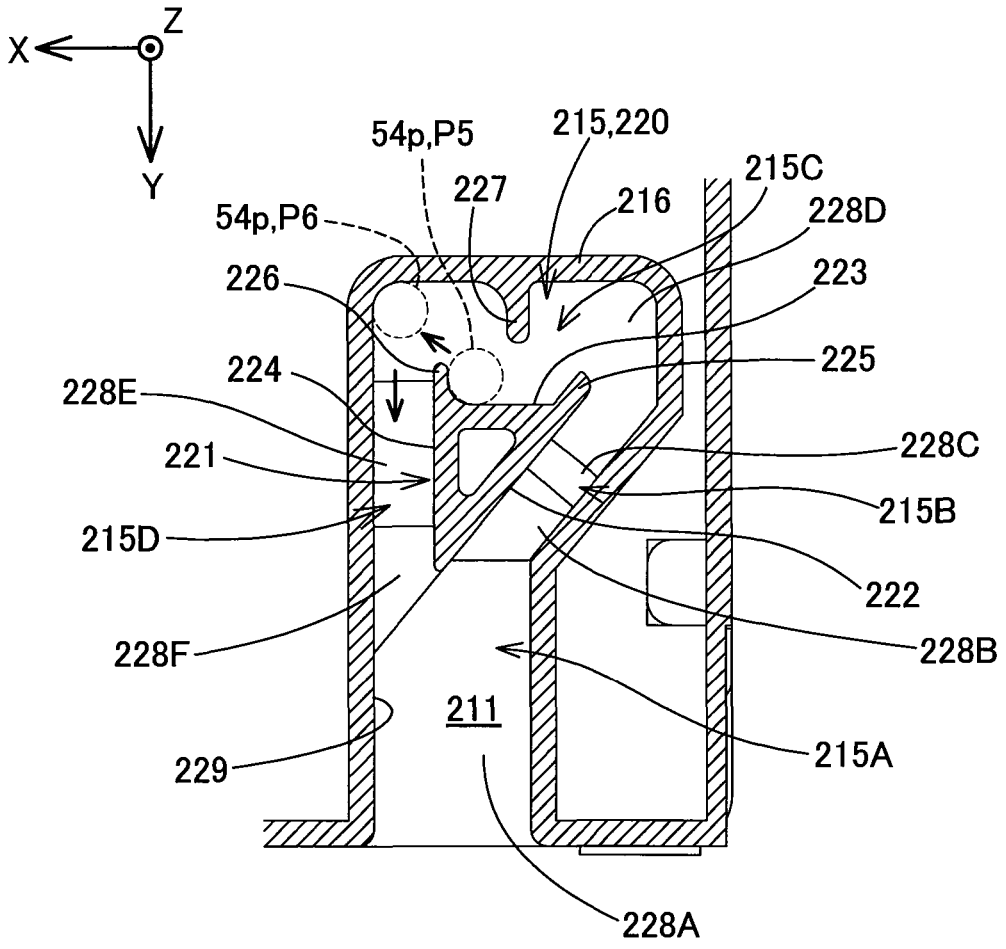
FIG. 26B is a schematic diagram illustrating a mechanism of releasing the engagement of the engagement element with the engaged element.

Engagement Mechanism of Device-Side Fixation Structure with Case-Side Fixation Structure The engagement mechanism of the device-side fixation structure 54 with the case-side fixation structure 220 of the case 61 is described with reference to FIG. 26A and FIG. 26B. FIG. 26A and FIG. 26B respectively illustrate the case-side fixation structure 220 when being viewed in the −Z direction. In FIG. 26A and FIG. 26B, positions P1 to P6 of the protrusion 54*p* at different timings are shown by the broken line, in order to indicate the movement locus of the protrusion 54*p* of the device-side fixation structure 54 in the groove 215.

The configuration of the case-side fixation structure 220 is described first with reference to FIG. 26A. The case-side fixation structure 220 includes a middle projection 221 that is protruded in the +Z direction at the center in an inner area on the −Y direction side of the inner space 211 of the projection 210. An outer circumferential wall surface of the middle projection 221 forms an outer circumferential contour in an approximately triangular shape when being viewed in the Z direction. The inside of the middle projection 221 is thinned.

The outer circumferential wall surface of the middle projection 221 includes a first wall surface 222, a second wall surface 223 and a third wall surface 224. The first wall surface 222 is extended diagonally between the X direction and the Y direction. At least part of the first wall surface 222 is arranged to overlap with the inner space 211 in the Y direction. The second wall surface 223 is extended in the X direction and is arranged to intersect with the first wall surface 222. The third wall surface 224 is extended in the Y direction and is arranged to intersect with the first wall surface 222 and the second wall surface 223. The third wall surface 224 is arranged to overlap with the inner space 211 of the projection 210 in the Y direction.

The middle projection 221 includes a first protruded wall portion 225 and a second protruded wall portion 226. The first protruded wall portion 225 is slightly extended in the −Y direction from the second wall surface 223 along the extending direction of the first wall surface 222 from the second wall surface 223 at a −X direction side end of the second wall surface 223. The second protruded wall portion 226 serves as an engaged element. In the description below, the second protruded wall portion 226 may also be called engaged element 226. The second protruded wall portion 226 is slightly extended in the −Y direction from the second wall surface 223 along the extending direction of the third wall surface 224 at a +X direction side end of the second wall surface 223.

The case-side fixation structure 220 further includes a third protruded wall portion 227. The third protruded wall portion 227 is formed as part of the rib 216. The third protruded wall portion 227 is protruded in the +Y direction from the rib 216 toward the second wall surface 223 at a position opposed to the second wall surface 223 of the middle projection 221 in the Y direction.

For the purpose of illustration, the groove 215 is divided into a first groove part 215A, a second groove part 215B, a third groove part 215C and a fourth groove part 215D. The first groove part 215A is a portion that is formed by the inner space 211 and that is extended in the Y direction. The second groove part 215B is a portion that faces the first wall surface 222 and that is extended diagonally between the X direction and the Y direction. The third groove part 215C includes a portion facing the second wall surface 223 and is a portion formed in a substantially zigzag meandering shape in the X direction by the three protruded wall portions 225 to 227. The fourth groove part 215D is a portion that faces the third wall surface 224 and that is extended in the +Y direction toward the first groove part 215A.

A first bottom surface 228A that is a bottom of the first groove part 215A forms an inclined surface that gradually rises in the +Z direction toward the −Y direction. A second bottom surface 228B that is a bottom of a portion of the second groove part 215B coupled with the first groove part 215A forms an approximately horizontal surface. A third bottom surface 228C that is located at the approximate center of the second groove part 215B forms an inclined surface that falls in the −Z direction from the second bottom surface 228B. A fourth bottom surface 228D that includes a bottom of a −Y direction side end portion of the second groove part 215B and a bottom of the third groove part 215C forms an approximately horizontal surface. A fifth bottom surface 228E that is a bottom of the fourth groove part 215D forms an inclined surface that rises more in the +Z direction from the fourth bottom surface 228D toward the +Y direction side. A sixth bottom surface 228F that is a bottom between the first bottom surface 228A and the fifth bottom surface 228E forms an approximately horizontal surface.

The mechanism to complete the engagement of the second protruded wall portion 226 (engaged element 226) of the case-side fixation structure 220 with the protrusion 54*p* (engagement element) of the device-side fixation structure 54 is described with reference to FIG. 26A. At the time when the leading end 54*t* of the device-side fixation structure 54 is inserted in the −Y direction into the first groove part 215A, a +X direction side end face of the leading end 54*t* comes into contact with a +X direction side wall surface 229 of the first groove part 215A, and the protrusion 54*p* of the device-side fixation structure 54 is located at a position (P1) away from the side wall surface 229. In this state, the end face of the leading end 54*t* is pressed in the −X direction by the side wall surface 229, so that the device-side fixation structure 54 is rotated in the −X direction, compared with the state that no external force in the horizontal direction is applied. The protrusion 54*p* of the device-side fixation structure 54 comes into contact with the first bottom surface 228A that is the inclined surface, and is pressed in the +Z direction by the first bottom surface 228A in the course of moving in the −Y direction from the position P1.

When the liquid container 100 is further pressed in the +Y direction, the protrusion 54*p* of the device-side fixation structure 54 is pressed in the +Z direction by the first bottom surface 228A, and the leading end 54*t* of the device-side fixation structure 54 is located on the +Z direction side of a +Z direction side end face of the rib 216 to be separated from the rib 216. The protrusion 54*p* of the device-side fixation structure 54 then comes into contact with the first wall surface 222 and rides over the horizontal second bottom surface 228B (position P2).

While being pressed in the −X direction by the first wall surface 222, the protrusion 54*p* of the device-side fixation structure 54 moves in the −Y direction along the first wall surface 222, reaches the horizontal third bottom surface 228C and further reaches to a position to come into contact with the first protruded wall portion 225 (position P3). The protrusion 54*p* of the device-side fixation structure 54 further moves in the −Y direction to release the contact with the first protruded wall portion 225. The protrusion 54*p* is then instantaneously moved in the +X direction by the biasing force applied to the device-side fixation structure 54 in the +X direction and collides against the third protruded wall portion 227 (position P4). This collision generates a click.

When the user releases the force applied to the liquid container 100 and the case 61 in the +Y direction in response to this clock, the liquid container 100 and the case 61 slightly move in the −Y direction by the biasing force in the −Y direction by the base end member 57 (shown in FIG. 25). The protrusion 54*p* of the device-side fixation structure 54 accordingly moves in the +Y direction along the third protruded wall portion 227 to release the contact with the third protruded wall portion 227. The protrusion 54*p* is then instantaneously moved in the +X direction by the biasing force applied to the device-side fixation structure 54 in the +X direction and collides against the second wall surface 223 and the second protruded wall portion 226 to be received by the second wall surface 223 and the second protruded wall portion 226 (position P5).

Accordingly, at the position P5, the protrusion 54*p* of the device-side fixation structure 54 is locked by the second protruded wall portion 226 of the case-side fixation structure 220, so that the second protruded wall portion 226 of the case-side fixation structure 220 is engaged with the protrusion 54*p* of the device-side fixation structure 54. In the description below, the second protruded wall portion 226 may also be called "locking element 226" as well as "engaged element 226". The engagement between the second protruded wall portion 226 of the case-side fixation structure 220 and the protrusion 54*p* of the device-side fixation structure 54 restricts the movement of the case 61 in the −Y direction and sets the case 61 in the case placement state that the case 61 is mounted to the case placement unit 60. In this state, the protrusion 54*p* of the device-side fixation structure 54 is in contact with the fourth bottom surface 228D. As described above, the device-side fixation structure 54 is biased in the −Z direction by the elastic member (not shown) placed inside of the connection receiving portion 50 and is elastically rotated in the +Z direction when an external force is applied in the +Z direction. The biasing force in the −Z direction is transmitted through the protrusion 54*p* to the fourth bottom surface 228D (shown in FIG. 26A). Accordingly, in the case placement state that the case 61 is mounted to the case placement unit 60, the protrusion 54*p* applies a force to the case 61 in the −Z direction.

In the case placement state that the engaged element 226 of the case-side fixation structure 220 is engaged with the engagement element 54*p* of the device-side fixation structure 54, the container-side electrical connecting structure 140 is electrically connected with the device-side electrical connecting structure 52, and the container-side electrical connecting structure 140 receives a force in at least the +Z direction from the device-side electrical connecting structure 52. As described above, in the liquid container 100 of the embodiment, the recess 160 and the container-side electrical connecting structure 140 have a positional relationship of at least partly overlapping with each other when being viewed in the Z direction. The projection 210 of the case 61 is received in the recess 160. The inner space 211 of the projection 210 forms at least part of the case-side fixation structure 220. At least part of the force in the +Z direction which the container-side electrical connecting structure 140 receives from the device-side electrical connecting structure 52 is cancelled out by the force in the −Z direction which the case 61 receives from the protrusion 54*p*. This configuration reduces a Z direction component of the force which the liquid container 100 receives on the +Y direction side and suppresses the location position in the Z direction of the liquid container 100 from being deviated from an expected proper position. Accordingly this suppresses deterioration of the location position of the liquid container 100 relative to the connection receiving portion 50 and improves the connection. This also suppresses a useless stress from being generated in a connecting portion of the connection receiving portion 50 and the liquid container 100 due to the deterioration of the location position of the liquid container 100 and thereby suppresses the above various components involved in the connection of the connection receiving portion 50 with the liquid container 100 from being damaged or deteriorated.

The mechanism of releasing the engagement of the case-side fixation structure 220 with the device-side fixation structure 54 is described with reference to FIG. 26B. In the liquid ejection device 10 of the embodiment, the case-side fixation structure 220 and the device-side fixation structure 54 that are engaged with each other are configured to release the engagement when the case 61 is further pressed in the +Y direction. When the user presses the case 61 in the +Y direction, the protrusion 54*p* of the device-side fixation structure 54 moves in the −Y direction from the position P5 and is released from the locked state with the second protruded wall portion 226 in the +X direction. Accordingly, the protrusion 54*p* is instantaneously moved in the +X direction by the biasing force that is applied in the +X direction to the device-side fixation structure 54 by the biasing member and collides against the +X-direction side wall surface 229 of the rib 216 (position P6).

The protrusion 54*p* is accordingly located in the fourth groove part 215D and is thus allowed to move in the +Y direction. In other words, the engagement between the case-side fixation structure 220 and the device-side fixation structure 54 is released. The click generated by the collision of the rib 216 against the protrusion 54*p* described above informs the user of the release of the engagement between the case-side fixation structure 220 and the device-side fixation structure 54. When the protrusion 54*p* is allowed to move in the +Y direction, the liquid container 100 and the case 61 automatically move in the −Y direction by the force applied in the −Y direction by the base end member 57 (shown in FIG. 25). After the base end member 57 is separated from the connection receiving portion 50, the user is allowed to draw out the case 61 and thereby take out the liquid container 100. As understood from the above description, the groove 215 forms a loop-shaped guide path to guide the protrusion 54*p*. The guide path has a common inlet portion and outlet portion. The guide path is formed by the locking element 226 provided in the middle thereof to lock the protrusion 54*p*, an inlet guide path and an outlet guide path. The inlet guide path is a path portion from the above inlet portion to the engagement element 226. The outlet guide path is a path portion from the engagement element 226 to the above outlet portion.

Figure 27A:
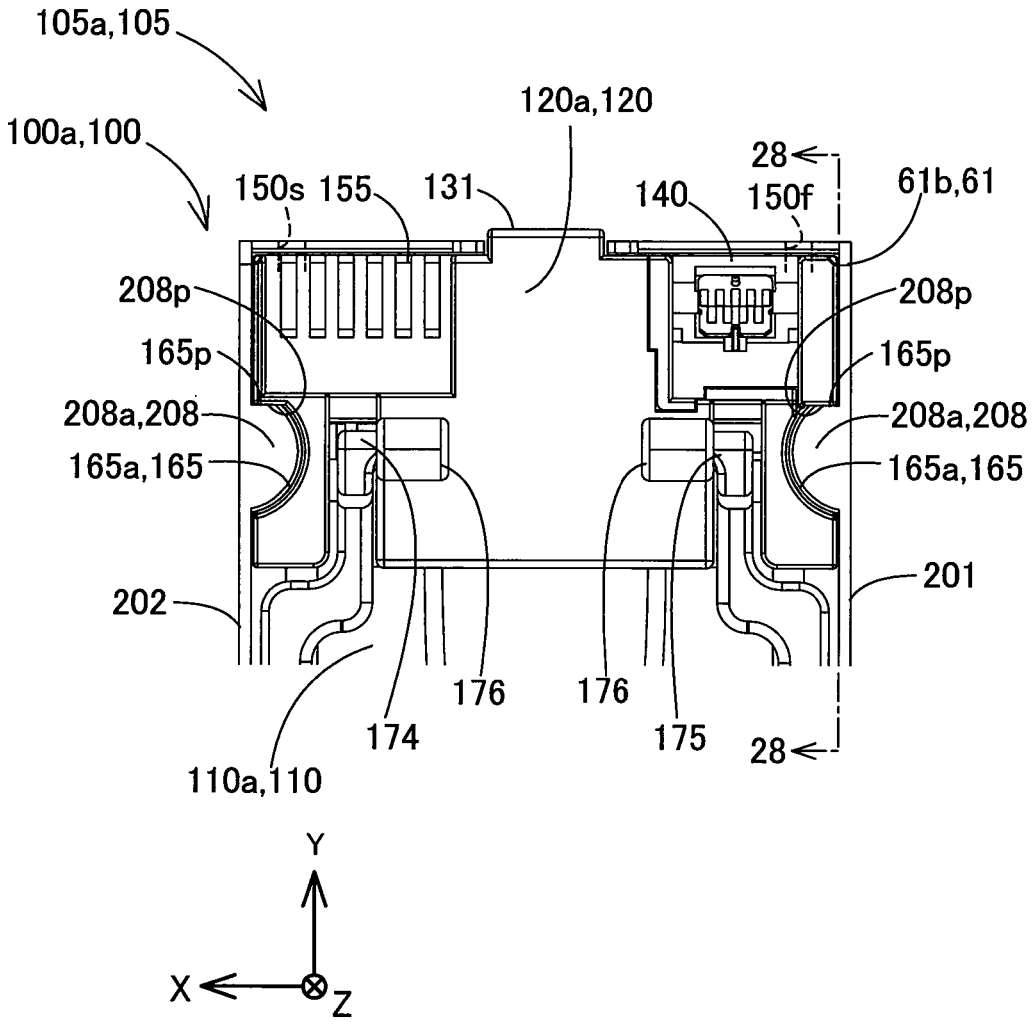
FIG. 27A is a schematic diagram illustrating a leading end side in a mounting direction of the first mounting body when being viewed in a +Z direction.
Figure 27B:
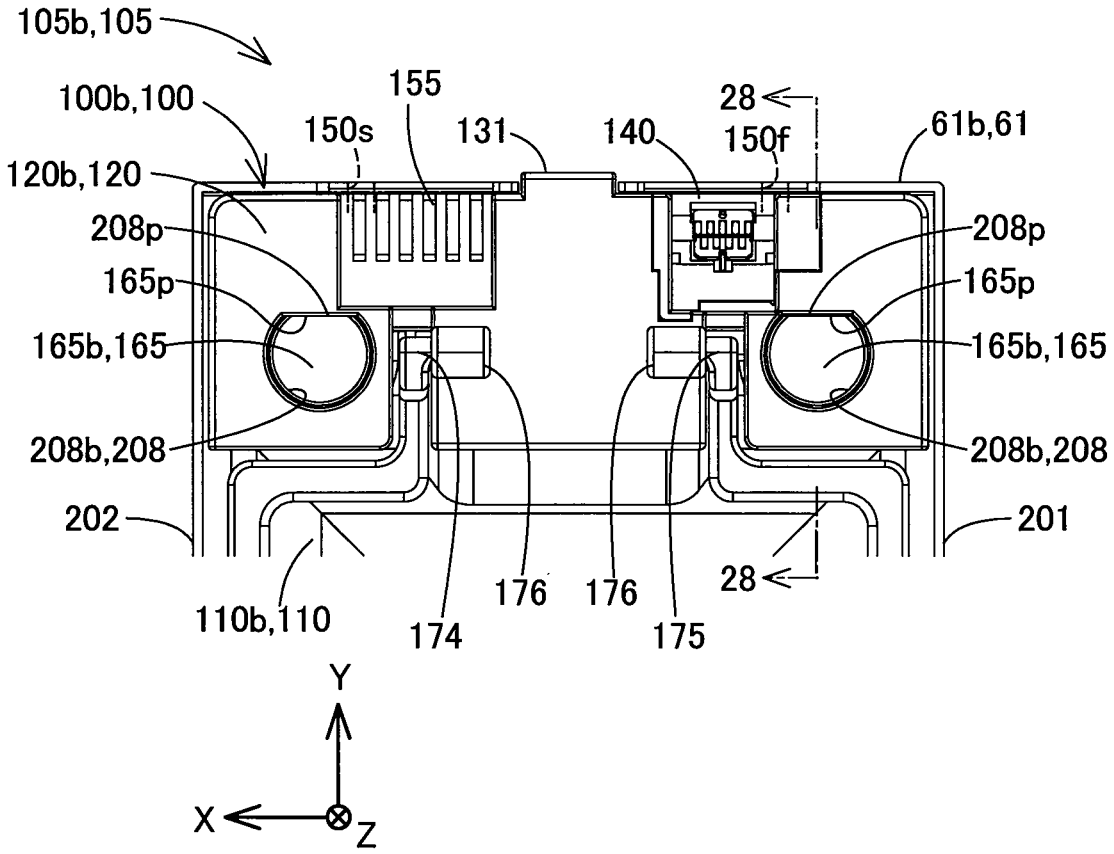
FIG. 27B is a schematic diagram illustrating a leading end side in the mounting direction of the second mounting body when being viewed in the +Z direction.
Figure 28:
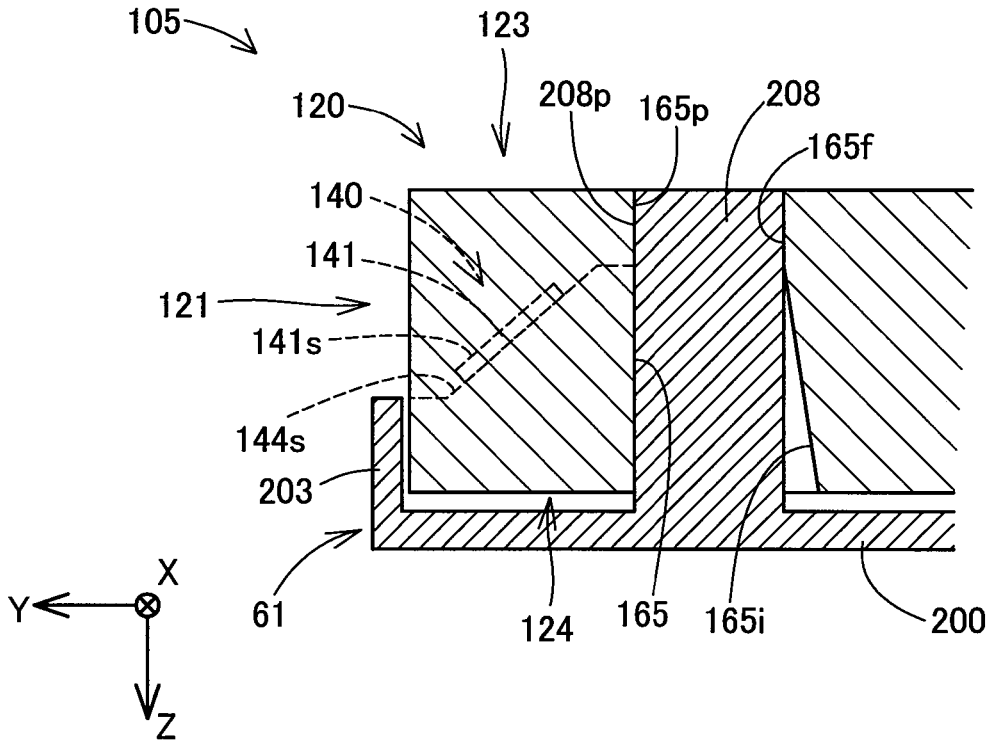
FIG. 28 is a schematic diagram schematically illustrating a sectional configuration of the mounting body.

Details of Configurations and Functions of Engaged Element and Engagement Element The following description refers to FIG. 27A, FIG. 27B and FIG. 28. FIG. 27A is a schematic diagram illustrating a leading end side in the mounting direction of the first mounting body 105*a* when being viewed in the +Z direction. FIG. 27B is a schematic diagram illustrating a leading end side in the mounting direction of the second mounting body 105*b* when being viewed in the +Z direction. FIG. 28 is a schematic diagram schematically illustrating the sectional configuration of the mounting body 105, taken along lines 28-28 respectively shown in FIG. 27A and FIG. 27B. The location area of the substrate portion 141 and the inclined surface 144*s* which the substrate portion 141 is placed on when being viewed in the −X direction are shown by the broken line in FIG. 28.

As described above, in the mounting body 105, the two guided elements 165 are arrayed in the X direction that is the longitudinal direction of the connection member 120 (as shown in FIG. 27A and FIG. 27B). This configuration suppresses the liquid container 100 from rotating and moving in a direction along the bottom surface 200*s* of the bottom wall portion 200 on the case 61. This accordingly suppresses deterioration of the connection between the connection member 120 and the connection receiving portion 50 due to a change in position of the liquid container 100.

According to the embodiment, the liquid outlet 131 is located between the two guided elements 165 in the X direction. In the liquid ejection device 10, even when the position of the mounting body 105 is changed such that the array direction of the two guided elements 165 is deviated relative to the X direction, this configuration suppresses a positional misalignment of the liquid outlet 131 relative to the liquid introducing element 51 of the connection receiving portion 50. This accordingly suppresses deterioration of the connection between the liquid introducing element 51 and the liquid outlet 131 due to a change in position of the liquid container 100. This also suppresses a stress from being generated at the position of the contact between the liquid introducing element 51 and the liquid outlet 131 due to this change in position and thereby suppresses the liquid introducing element 51 and the liquid outlet 131 from being damaged and deteriorated.

According to the embodiment, the container-side electrical connecting structure 140 is located between the two guided elements 165 in the X direction. In the liquid ejection device 10, even when the position of the mounting body 105 is changed such that the array direction of the two guided elements 165 is deviated relative to the X direction, this configuration suppresses a positional misalignment of the container-side electrical connecting structure 140 relative to the device-side electrical connecting structure 52 of the connection receiving portion 50. This accordingly suppresses deterioration of the connection between the device-side electrical connecting structure 52 and the container-side electrical connecting structure 140 due to a change in position of the liquid container 100. This also suppresses a stress from being generated at the position of the contact between the device-side electrical connecting structure 52 and the container-side electrical connecting structure 140 due to this change in position and thereby suppresses the device-side electrical connecting structure 52 and the container-side electrical connecting structure 140 from being damaged and deteriorated.

Additionally according to the embodiment, the container-side electrical connecting structure 140 is located between the guided element 165 on the −X direction side out of the two guided elements 165 and the liquid outlet 131 in the X direction. The container-side electrical connecting structure 140 is accordingly positioned by the three points, i.e., the two guided elements 165 and the liquid outlet 131. This configuration further suppresses the location position of the liquid container 100 from rotating relative to the device-side electrical connecting structure 52. This further suppresses deterioration of the connection between the device-side electrical connecting structure 52 and the container-side electrical connecting structure 140.

Especially, according to the embodiment, the two guided elements 165 are arranged on the −Y direction side of the liquid outlet 131. More specifically, the liquid outlet 131 is located at a position away from a virtual straight line of connecting the two guided elements 165, and the liquid outlet 131 and the two guided elements 165 are arranged to be away from each other in the two directions, X direction and Y direction. This configuration enhances the stability of the location position of the liquid container 100 by the three-point support of the two guided elements 165 and the liquid outlet 131 and further increases the positioning accuracy of the container-side electrical connecting structure 140. The two guided elements 165 are also arranged on the −Y direction side of the container-side electrical connecting structure 140. Accordingly, the container-side electrical connecting structure 140 is supported by the guide element 208 fitted in the guided element 165 on the +Y direction side in the course of connection of the container-side electrical connecting structure 140 with the device-side electrical connecting structure 52. This suppresses a positional misalignment of the container-side electrical connecting structure 140 along the Y direction due to a load applied from the device-side electrical connecting structure 52. According to the embodiment, the liquid outlet 131 and the container-side electrical connecting structure 140 are collected on the +Y direction side end of the connection member 120. This configuration allows for downsizing of the connection member 120. This configuration also facilitates the connection of the liquid outlet 131 with the liquid introducing element 51 and the connection of the container-side electrical connecting structure 140 with the device-side electrical connecting structure 52.

According to the embodiment, the container-side electrical connecting structure 140 is provided at a position nearer to the guided element 165 on the −X direction side than the center in the X direction of the liquid container 100. This configuration enables the container-side electrical connecting structure 140 to be positioned on the case 61 with the higher accuracy by positioning the liquid container 100 relative to the case 61 by insertion of the guide elements 208 into the guided elements 165. This enhances the connectivity of the container-side electrical connecting structure 140 with the device-side electrical connecting structure 52. According to the embodiment, the container-side electrical connecting structure 140 is provided at a position that is away from the liquid outlet 131 in the X direction and that is away from the two guided elements 165 in the Y direction. This configuration provides the substrate placement structure 144 of the container-side electrical connecting structure 140 in the connection member 120 such as not to interfere with the liquid outlet 131 and the guided elements 165 and thereby achieves downsizing of the connection member 120.

According to the embodiment, the bag-like member 110 is located on the −Y direction side of the two guided elements 165, and the liquid outlet 131 and the container-side electrical connecting structure 140 are located at positions away from the containing portion 115 of the bag-like member 110 across the two guided elements 165. This configuration suppresses the force of pulling the connection member 120 in the −Y direction generated by the load of the liquid contained in the bag-like member 110 from being transmitted to the liquid outlet 131 and the container-side electrical connecting structure 140 by the support of the guide elements 208 fitted in the respective guided elements 165. This configuration also suppresses deformation and a change in position of the bag-like member 110 accompanied with consumption of the liquid from affecting a connecting portion between the liquid outlet 131 and the liquid introducing element 51 and a connecting portion between the container-side electrical connecting structure 140 and the device-side electrical connecting structure 52. This accordingly suppresses the stress from being continuously generated in these connecting portions and suppresses, for example, creep-induced deformation and deterioration of the connection-involved components. This also suppresses deterioration of the connection qualities in these connecting portions.

According to the embodiment, the two guided elements 165 are formed over the entire thickness in the X direction of the connection member 120, and the respective guide elements 208 are placed over the entire thickness inside of the corresponding guided elements 165 (as shown in FIG. 28). This configuration facilitates the contact between the planar portions 165*p* of the guided elements 165 and the planar portions 208*p* of the guide elements 208 under application of a load from the bag-like member 110 as described above. This configuration accordingly enhances the positional stability of the first liquid container 100*b*. This configuration also suppresses the liquid container 100 on the case 61 from rotating in a direction away from the case 61 to change its position.

According to the embodiment, each of the two receiving portions 150*f* and 150*s* is provided at such a position as to at least partly overlap with one of the two guided elements 165 when being viewed in the Y direction (as shown in FIG. 27A and FIG. 27B). This configuration increases the positioning accuracy of the connection member 120 of the mounting body 105 relative to the connection receiving portion 50. This accordingly further improves the connectivity between the liquid outlet 131 and the liquid introducing element 51 and the connectivity between the container-side electrical connecting structure 140 and the device-side electrical connecting structure 52.

According to the embodiment, as described above, the two guided elements 165 are provided as concaves (including through holes) of the connection member 120 (as shown in FIG. 13 and FIG. 23). This facilitates the user to visually recognize the positions of the two guided elements 165. The user is also allowed to touch the two guided elements 165 with a hand and tactually recognize the positions of the two guided elements 165. As described above, the two guided elements 165 are formed in such a shape that allows the user to readily recognize their positions. The user can thus readily position the liquid container 100 relative to the case 61 by using the two guided elements 165 as the guides in the course of mounting the liquid container 100 to the case 61.

According to the embodiment, the guide elements 208 of the case 61 are fitted in the guided elements 165 by simple insertion in the Z direction into the guided elements 165. This configuration facilitates the mounting operation of the liquid container 100 to the case 61.

According to the embodiment, the guided element 165*a* is provided to be pierced in the Z direction from the third surface portion 123 to the fourth surface portion 124 in the connection member 120 (as shown in FIG. 28). This configuration causes the positions of the guide elements 208 on the case 61 to be visible in the +Z direction through the inner spaces of the guided elements 165 when the liquid container 100 is placed in the case 61. This accordingly facilitates the placement operation of the liquid container 100 relative to the case 61 and improves the mountability of the liquid container to the case.

As described above, according to the embodiment, the terminals 142 of the container-side electrical connecting structure 140 are pressed in the +Z direction in addition to in the −Y direction by the terminal portions 52*t* of the device-side electrical connecting structure 52 (shown in FIG. 5). In the mounting body 105 of the embodiment, upper ends of the guide elements 208 are located above the terminals 142 of the substrate portion 141. Accordingly, the contact between the upper ends of the guide elements 208 and the guided elements 165 suppresses the connection member 120 from being pressed in the +Z direction by the terminal portions 52*t* of the device-side electrical connecting structure 52*t* to rotate.

Additionally, according to the embodiment, a fitting portion 165*f* where the entire inner wall surface of the guided element 165 is in surface contact with the outer circumferential side face of the guide element 208 is provided at an upper end of the guided element 165 (as shown in FIG. 28). This configuration further increases the positioning accuracy of the liquid container 100 on the case 61 by means of the guided elements 165 and the guide elements 208. The fitting portion 165*f* is located above the terminals 142 of the substrate portion 141. This configuration further suppresses the connection member 120 from being pressed in the +Z direction by the terminal portions 52*t* of the device-side electrical connecting structure 52*t* to rotate described above. Furthermore, according to the embodiment, the fitting portion 165*f* includes the planar portion 165*p* that faces in the +Y direction. The planar portion 165*p* comes into contact with the planar portion 208*p* of the guide element 208 to be supported by the planar portion 208*p* when a load is applied in the −Y direction to the connection member 120. This configuration further suppresses the connection member 120 from being pressed by the terminal portions 52*t* of the device-side electrical connecting structure 52*t* to rotate.

According to the embodiment, the guided element 165 includes an inclined surface 165*i* that faces in the +Z direction at a +Z direction side end that is an inlet side end where the guide element 208 is inserted (as shown in FIG. 28). According to the embodiment, the inclined surface 165*i* is located on the −Y direction side of the planar portion 165*p* and is extended downward from the fitting portion 165*f*. The inclined surface 165*i* faces to a side face of the inserted guide element 208 in the state that the guide element 208 is fitted in the guided element 165. The presence of the inclined surface 165*i* increases the opening area in a downward direction at a section along the X direction and the Y direction of the guided element 165 at a position lower than the fitting portion 165*f*. This configuration enables the upper end of the guide element 208 to be smoothly guided to the fitting portion 165*f* of the guided element 165 and thereby facilitates the mounting operation of the liquid container 100 to the case 61.

The presence of the inclined surface 165*i* enables the guide element 208 to be locally fitted in the guided element 165 in the fitting portion 165*f* at the upper end. This facilitates release of the engagement between the guided element 165 and the guide element 208 and facilitates the dismounting operation of the liquid container 100 from the case 61. Additionally this configuration promptly releases the engagement between the guided element 165 and the guide element 208 even when an unexpected impact force is externally applied to the mounting body 105, for example, due to a fall of the mounting body 105. This accordingly distributes the impact force applied to the mounting body 105 and suppresses the liquid container 100 from being damaged and destroyed.

According to the embodiment, the planar portion 165*p* of the guided element 165 and the planar portion 208*p* of the guide element 208 are in surface contact with each other over the substantially entire length in the Z direction. This configuration suppresses the position of the liquid container 100 from being changed even when a load is applied in the −Y direction to the liquid container 100 on the case 61.

Combination of First Liquid Container and Second Case

Figure 29:
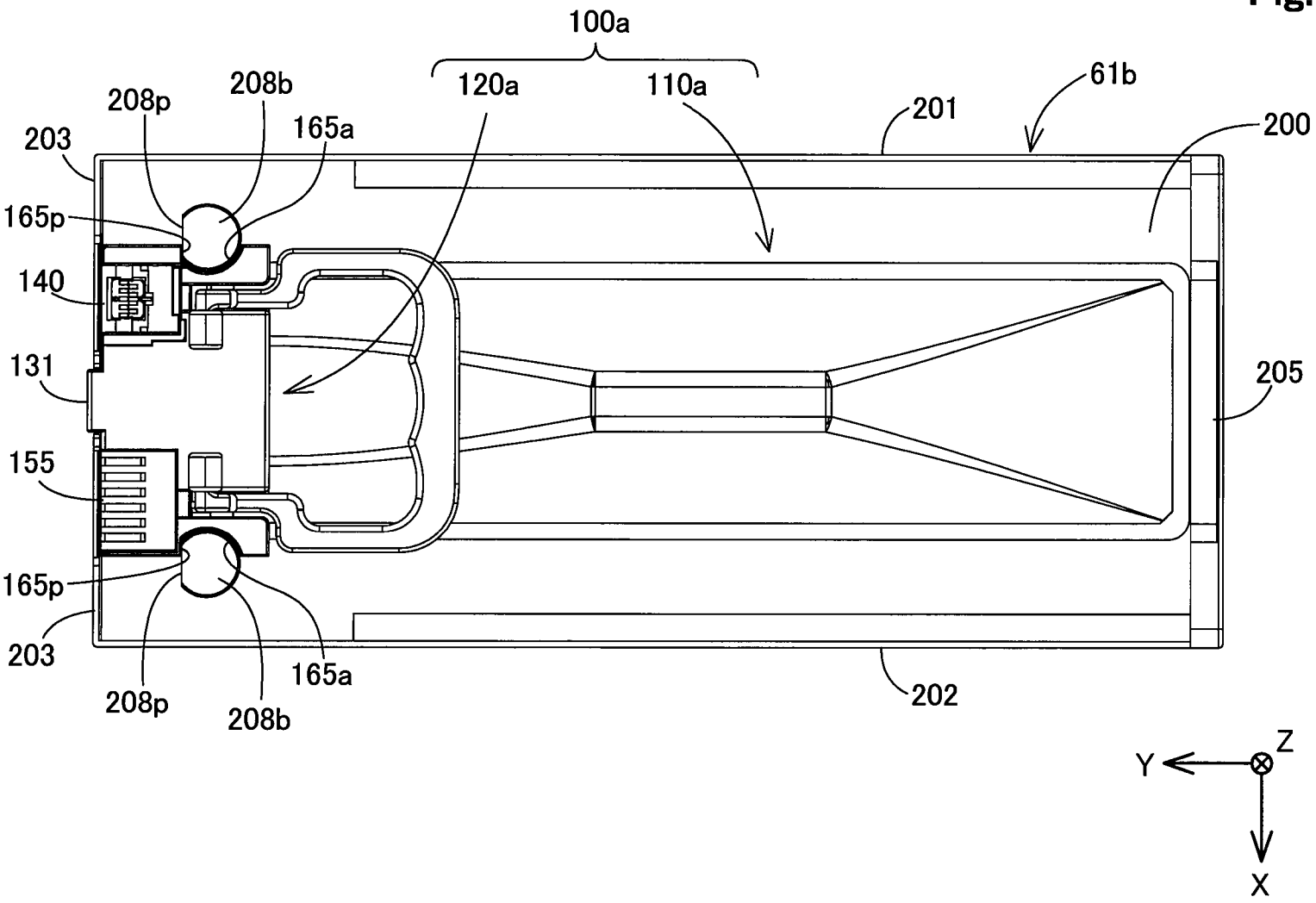
FIG. 29 is a schematic diagram illustrating the first liquid container placed in the second case.

FIG. 29 is a schematic diagram illustrating the first liquid container 100*a* placed in the second case 61*b* when being viewed in the +Z direction. According to the embodiment, the first connection member 120*a* of the first liquid container 100*a* has a substantially similar location layout of the respective components involved in connection with the connection receiving portion 50 to that of the second connection member 120*b* of the second liquid container 100*b*. As described above, the two guided elements 165*b* of the second connection member 120*b* are provided at positions corresponding to those of the guided elements 165*a* of the first connection member 120*a* and include portions having shapes identical with those of the guided elements 165*a* of the first connection member 120*a*. The first liquid container 100*a* is thus mountable to the second case 61*b* that is configured to be fitted for the second connection member 120*b* of the second liquid container 100*b*. When the first liquid container 100*a* is mounted to the second case 61*b*, parts of the two guide elements 208*b* of the second case 61*b* are fitted in the guided elements 165*a* of the first connection member 120*a*. This configuration enables the first liquid container 100*a* to be positioned on the second case 61*b*.

Fixation Structure of Bag-Like Member in Connection Member

Figure 30:
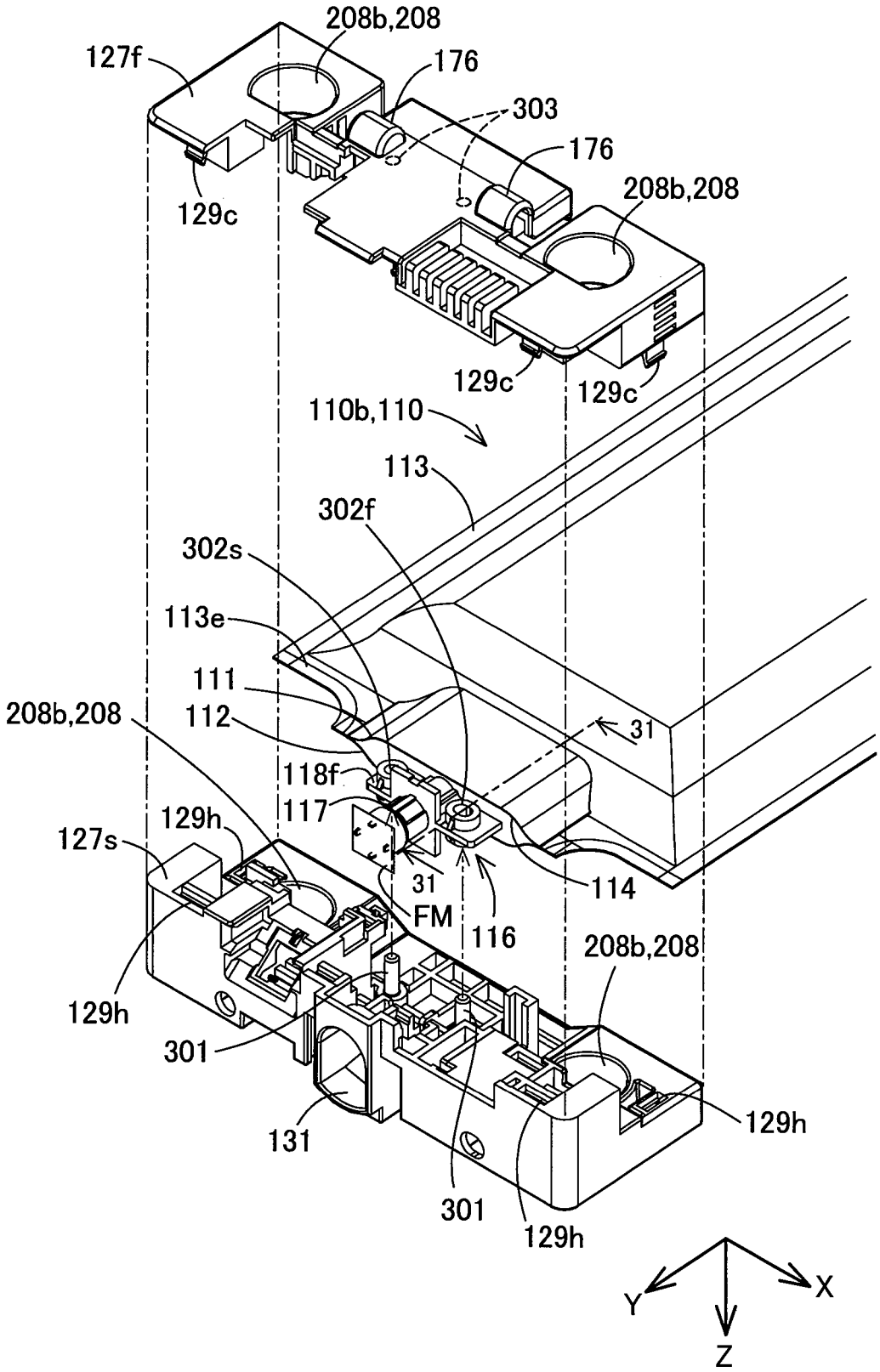
FIG. 30 is an exploded perspective view illustrating the liquid container.
Figure 31:
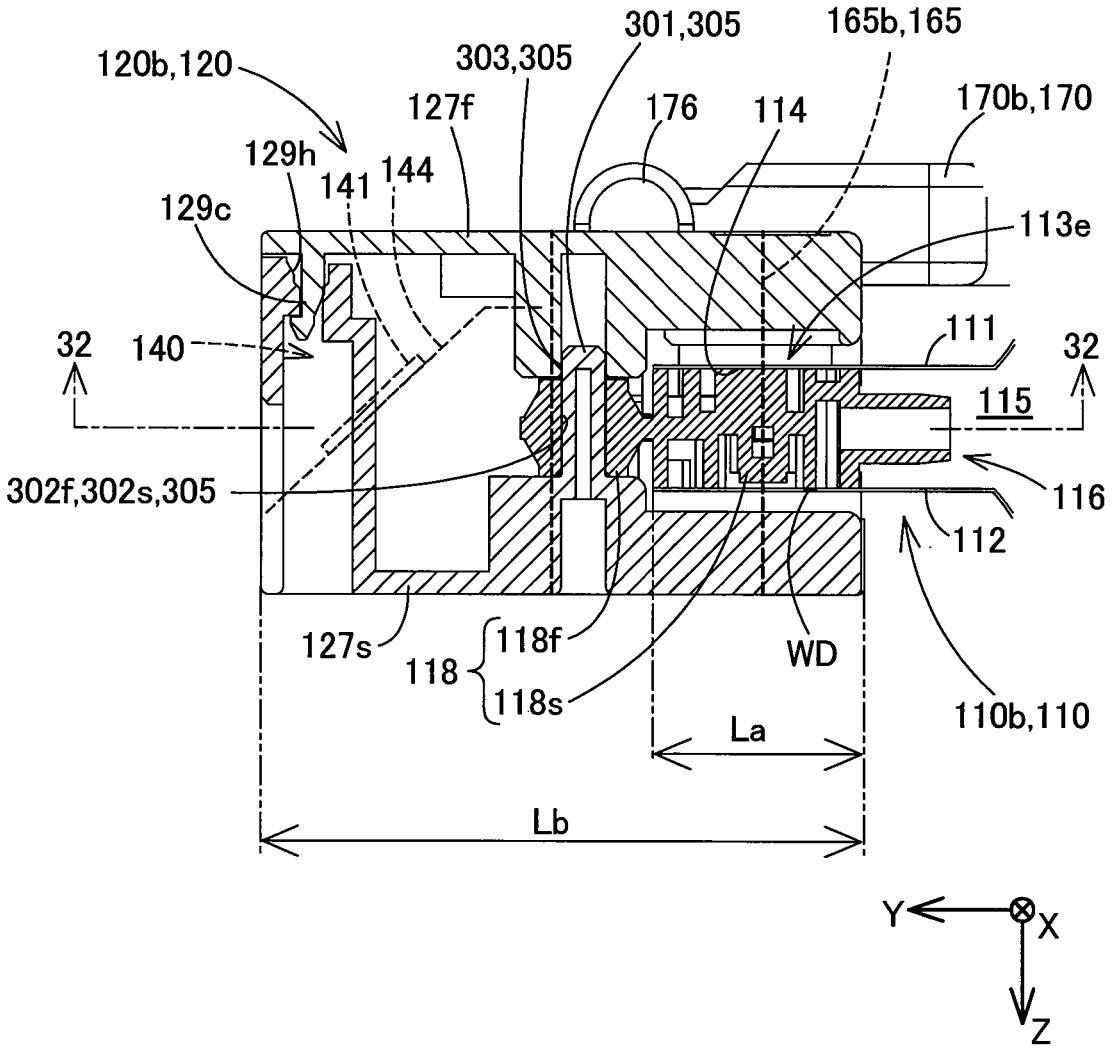
FIG. 31 is a first schematic sectional view illustrating the connection member.
Figure 32:
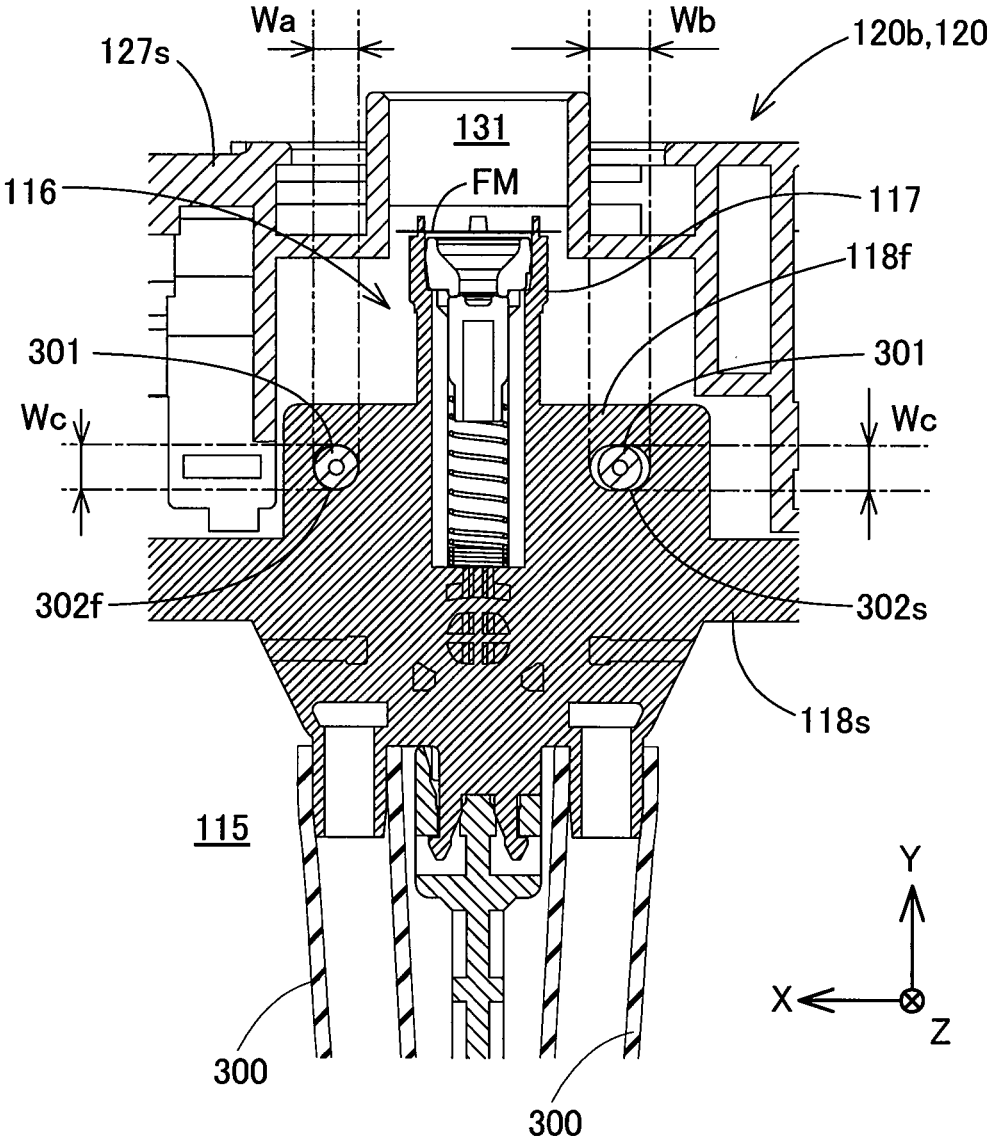
FIG. 32 is a second schematic sectional view illustrating the connection member.

The details of the fixation structure of the bag-like member 110 in the connection member 120 of the liquid container 100 are described with reference to FIG. 30 to FIGS. 33A and 33B. FIG. 30 is a schematic exploded perspective view illustrating the liquid container 100 with separation of the first member 127*f* and the second member 127*s* from each other in the connection member 120. FIG. 31 is a first schematic sectional view illustrating the connection member 120, taken along a line 31-31 shown in FIG. 30. FIG. 32 is a second schematic sectional view illustrating the connection member 120, taken along a line 32-32 shown in FIG. 31. Although FIGS. 30 to 32 illustrate the configuration of the second liquid container 100*b*, the description below is common to the first liquid container 100*a* and the second liquid container 100*b*.

The connection member 120 is configured by laying the first member 127*f* over the second member 127*s* in the Z direction and coupling the first member 127*f* with the second member 127*s* (as shown in FIG. 30). The first member 127*f* includes a plurality of claws 129*c* protruded downward in the +Z direction. The second member 127*s* includes engagement holes 129*h* corresponding to the respective claws 129*c*. The first member 127*f* and the second member 127*s* are coupled with each other by engagement of the respective claws 129*c* with the corresponding engagement holes 129*h*. When the first member 127*f* and the second member 127*s* are coupled with each other, the first member 127*f* and the second member 127*s* hold a leading end 113*e* on the +Y direction side of the outer circumferential edge 113 of the bag-like member 110 that is placed between the first member 127*f* and the second member 127*s* in the Z direction.

A supply port 114 that is an opening communicating with the containing portion 115 is provided at the leading end 113*e* of the bag-like member 110 (as shown in FIG. 30 and FIG. 31). The supply port 114 is a portion of the outer circumferential edge 113 of the bag-like member 110 where the first sheet member 111 and the second sheet member 112 are not joined with each other. A supply port member 116 is inserted in the supply port 114 of the bag-like member 110 to form a liquid flow path that connects the liquid outlet 131 with the supply port 114.

The supply port member 116 is produced by molding a resin material such as polypropylene. The supply port member 116 includes a piping portion 117 (shown in FIG. 30) and a connection main body 118 (shown in FIG. 31). The piping portion 117 (shown in FIG. 30) is a tubular portion that is extended in the Y direction and that is located at the center in the X direction, and has a +Y direction side opening end that is connected with the liquid outlet 131 of the connection member 120. The +Y direction side opening of the piping portion 117 is sealed by application of a film member FM. When the liquid introducing element 51 is connected with the liquid outlet 131, the liquid introducing element 51 passes through the film member FM and is connected with the opening of the piping portion 117.

The connection main body 118 is a portion provided on the −Y direction side of the piping portion 117 (as shown in FIG. 30 and FIG. 31). A liquid flow path (not shown) is provided inside of the connection main body 118 to be connected with the piping portion 117 and to be extended in the Y direction. The connection main body 118 includes a first fixation portion 118*f* and a second fixation portion 118*s*. The first fixation portion 118*f* is a portion that is placed outside of the bag-like member 110 and that is coupled with and fixed to the connection member 120 (as shown in FIG. 30 and FIG. 31). The second fixation portion 118*s* is a portion that is placed inside of the bag-like member 110 and that is fixed to the bag-like member 110 (as shown in FIG. 31). The second fixation portion 118*s* is joined in an airtight manner with an inner circumferential surface of the supply port 114 of the bag-like member 110 (as shown in FIG. 30 and FIG. 31). A tubular member 300 placed inside of the containing portion 115 to guide the liquid contained in the containing portion 115 to outside of the bag-like member 110 is connected with a −Y direction side end of the second fixation portion 118*s* (as shown in FIG. 32).

The two protrusions 301 are provided on an upper surface of the second member 127*s* (as shown in FIG. 30). The two protrusions 301 are shaft-like portions extended in the −Z direction. According to the embodiment, the two protrusions 301 are formed in an approximately cylindrical shape. The two protrusions 301 are provided at positions across the liquid outlet 131 and the piping portion 117 in the X direction when being viewed in the Y direction (as shown in FIG. 32).

The two through ports 302*f* and 302*s* are provided on the first fixation portion 118*f* of the connection main body 118 to pass through the first fixation portion 118*f* in the Z direction (as shown in FIG. 30). The two through ports 302*f* and 302*s* are arrayed in the X direction. A liquid flow path connecting with the piping portion 117 is provided between the two through ports 302*f* and 302*s* (as shown in FIG. 32). Corresponding one of the two protrusions 301 of the second member 127*f* is inserted into each of the through ports 302*f* and 302*s* (as shown in FIG. 30). The protrusion 301 on the +X direction side is inserted into the first through port 302*f*, and the protrusion 301 on the −X direction side is inserted into the second through port 302*s*.

The two apertures 303 which the respective protrusions 301 are fitted in are provided on a lower surface of the first member 127*f* at positions corresponding to the two protrusions 301 of the second member 127*s*. The positions of formation of the two apertures 303 are shown by the broken line in FIG. 30. When the first member 127*f* and the second member 127*s* are coupled with each other, upper end portions of the two protrusions 301 of the second member 127*s* that pass through the two through ports 302*f* and 302*s* of the first fixation portion 118*f* described above are fitted in the two apertures 303 of the first member 127*f* (as shown in FIG. 31). The bag-like member 110 is accordingly fixed to the connection member 120. In the description below, the two protrusions 301 of the second member 127*s*, the two through ports 302*f* and 302*s* of the supply port member 116 and the two apertures 303 of the first member 127*f* may be collectively called "fixation structures 305" configured to fix the bag-like member 110 to the connection member 120.

As described above, in the liquid container 100 of the embodiment, the leading end 113*e* of the bag-like member 110 including the supply port 114 is placed and held in the Z direction between the first member 127*f* and the second member 127*s* that constitute the connection member 120. This configuration suppresses a positional misalignment of the supply port 114 relative to the connection member 120 and suppresses deterioration of the connection of a liquid supply path between the liquid ejection device 10 and the liquid container 100. The bag-like member 110 is fixed to the connection member 120 by the process of coupling the first member 127*f* and the second member 127*s* with each other in the Z direction. This facilitates assembly of the bag-like member 110.

In the connection member 120 of the embodiment, the entire supply port member 116 attached to the bag-like member 110 is covered by the first member 127*f* and the second member 127*s* that constitute the main body portion of the connection member 120. This configuration enhances the protection of the supply port member 116. In the connection member 120 of the embodiment, the two protrusions 301 and the two through ports 302*f* and 302*s* that constitute the fixation structures 305 to fix the bag-like member 110 are arrayed in the X direction across the liquid flow path provided in the supply port member 116. This configuration suppresses a positional misalignment that the connection member 120 and the bag-like member 110 are rotated relative to each other in the X direction. This also suppresses a positional misalignment between the liquid outlet 131 of the connection member 120 and the liquid flow path of the supply port member 116 and suppresses deterioration of the communication of the liquid supply flow path inside of the connection member 120. Additionally in the connection member 120 of the embodiment, the two protrusions 301 provided to fix the supply port member 116 are extended in the Z direction across the first member 127*f* and the second member 127*s*. This configuration enhances the strength of the fixation structure 305 provided to fix the supply port member 116 and further suppresses a positional misalignment of the supply port member 116 inside of the connection member 120.

As described above, according to the embodiment, the second fixation portion 118*s* of the supply port member 116 is welded to the sheet members 111 and 112 at the supply port 114 of the bag-like member 110. A length La in the Y direction of a welding area WD of the second fixation portion 118*s* is shorter than a length Lb in the Y direction of the connection member 120 (as shown in FIG. 31). The entire welding area WD is covered by the connection member 120. This configuration causes the welding area WD to be protected by the connection member 120 and suppresses the sheet members 111 and 112 from being peeled off from the supply port member 116.

The location position of the substrate portion 141 in the container-side electrical connecting structure 140 is shown by the broken line in FIG. 31. According to the embodiment, the container-side electrical connecting structure 140 is provided on the +Y direction side of the supply port 114. Accordingly the substrate placement structure 144 is provided as the recess that is recessed in the +Z direction without interfering with the bag-like member 110, and the substrate portion 141 is arranged at a position that at least partly overlaps with the supply port 114 in the Y direction. This configuration reduces the thickness of the connection member 120 in the Z direction and achieves downsizing of the connection member 120.

According to the embodiment, the container-side electrical connecting structure 140 is provided at a position on the +Y direction side away from the fixation structures 305 of the supply port member 116. Even when the fixation structure 305 of the supply port member 116 is damaged by, for example, applying an unexpected impact to the liquid container 100, this configuration suppresses the damage from affecting the container-side electrical connecting structure 140. This enhances the protection of the substrate portion 141.

According to the embodiment, the two through ports 302*f* and 302*s* provided in the first fixation portion 118*f* of the supply port member 116 have different opening widths in the X direction (as shown in FIG. 32). The opening width herein means a maximum value of the opening width in the X direction. An opening width Wb in the X direction of the second through port 302*s* is larger than an opening width Wa in the X direction of the first through port 302*f*. This configuration provides a margin for the insertion angle of the protrusion 301 in the X direction when the corresponding protrusion 301 is inserted into the second through port 302*s*. This enables the corresponding protrusion 301 to be readily inserted into the second through port 302*s* after the corresponding protrusion 301 is inserted into the first through port 302*f* to determine a reference position. This facilitates the attachment process of the bag-like member 110 to the second member 127*s* and facilitates the assembly process to fix the bag-like member 110 to the connection member 120. Providing the fixation structure 305 with such a margin reduces the stress generated in the fixation structure 305 in the process of assembling the connection member 120 and suppresses deterioration of the fixation property of the bag-like member 110 relative to the connection member 120. According to the embodiment, opening widths We in the Y direction of the first through port 302*f* and of the second through port 302*s* are approximately equal to the diameter in the Y direction of the protrusions 301. The opening widths in the Y direction of the first through port 302*f* and of the second through port 302*s* may be different from each other.

Figure 33A:
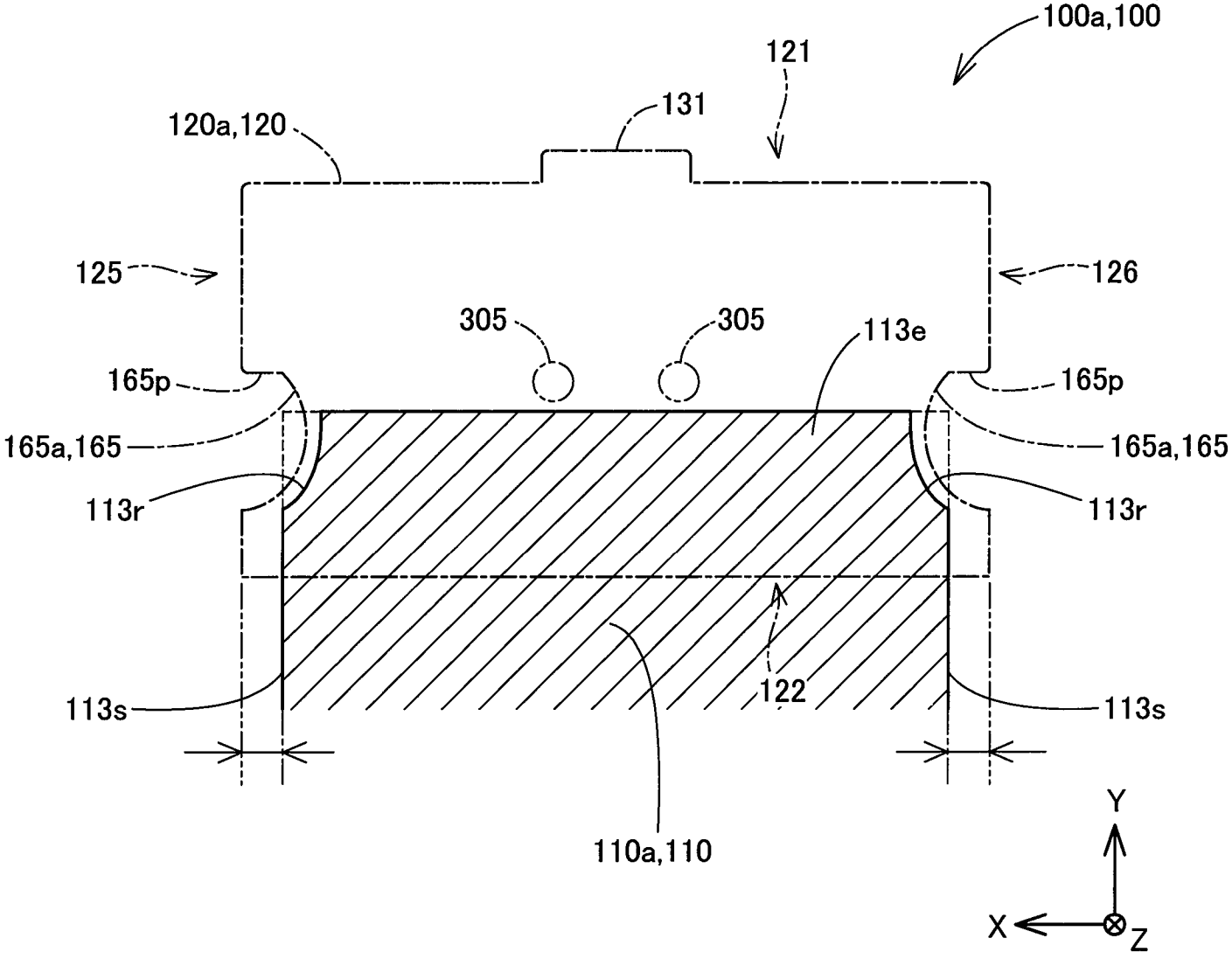
FIG. 33A is a diagram illustrating the location position of a bag-like member relative to the connection member of the first liquid container.
Figure 33B:
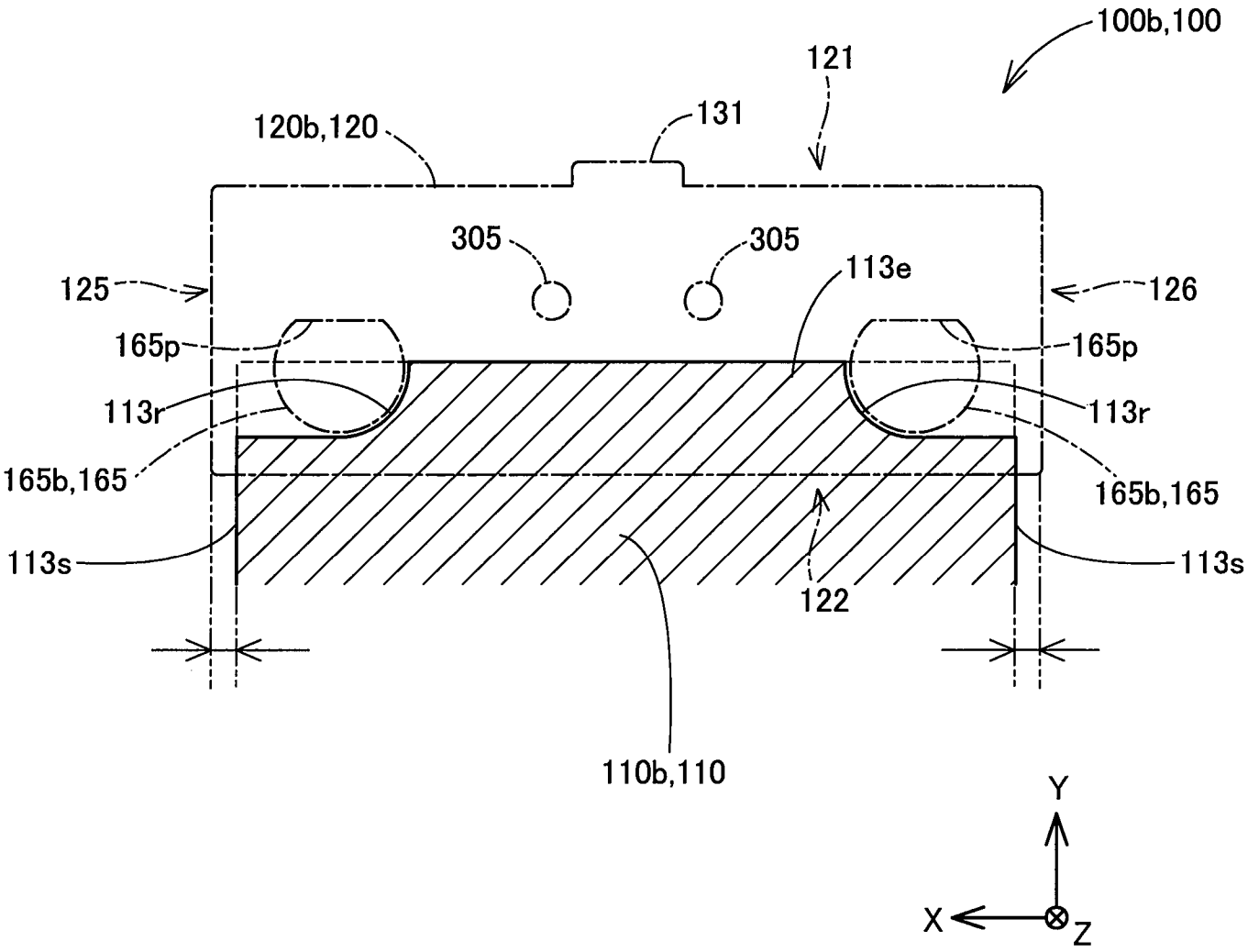
FIG. 33B is a diagram illustrating the location position of the bag-like member relative to the connection member of the second liquid container.

FIG. 33A and FIG. 33B are diagrams illustrating the position of the leading end 113*e* of the bag-like member 110 in the connection member 120. FIG. 33A is a diagram with regard to the first liquid container 100*a*, and FIG. 33B is a diagram with regard to the second liquid container 100B. Outlines of the connection members 120*a* and 120*b* when being viewed in the +Z direction are shown by the one-dot chain line, and the location areas of the bag-like members 110*a* and 110*b* are filled with hatched lines in FIG. 33A and FIG. 33B. The positions of the fixation structures 305 provided to fix the bag-like members 110*a* and 110*b* to the connection members 120*a* and 120*b* are respectively shown by the two-dot chain line in FIG. 33A and FIG. 33B.

According to the embodiment, the leading end 113*e* of the bag-like member 110 is provided at a position between the two guided elements 165 in the connection member 120. The leading end 113*e* of the bag-like member 110 is located at a position overlapping with the two guided elements 165 when being viewed in the X direction. For example, when an impact is applied in the X direction to the mounting body 105, the leading end 113*e* of the bag-like member 110 held by the connection member 120 is supported in the X direction by the guided elements 165. This configuration enhances the impact resistance of the liquid container 100.

According to the embodiment, the fixation structures 305 used to fix the leading end 113*e* of the bag-like member 110 are provided at the positions overlapping with the two guided elements 165 when being viewed in the X direction. This configuration causes the leading end 113*e* of the bag-like member 110 to be supported by the fixation structures 305 as well as the guided elements 165 and the guide elements 208 described above, when an impact force in the X direction is applied. This accordingly further enhances the impact resistance of the liquid container 100.

According to the embodiment, side end portions 113*s* of the bag-like member 110 are located on the inner side of the fifth surface portion 125 and the sixth surface portion 126 of the connection member 120 in the X direction. The configuration that the side end portions 113*s* of the bag-like member 110 are not protruded to outside of the connection member 120 in the X direction enhances the protection of the side end portions 113*s* of the bag-like member 110. According to the embodiment, when the liquid container 100 is viewed in the Y direction, at least part of the bag-like member 110 is overlapped with the respective guided elements 165. This configuration suppresses a positional misalignment in the +Y direction of the bag-like member 110 in the connection member 120.

According to the embodiment, in order to avoid two corners on the +Y direction side of the bag-like member 110 from interfering with the guided elements 165, these corners are cut. Accordingly a depression 113*r* that is indented in a direction from the guided element 165 toward the bag-like member 110 is formed along an inner circumferential surface of each of the two guided elements 165 on a +Y direction side end portion of the side end portion 113*s* of the bag-like member 110. The shapes of the corners prior to cutting are shown by the broken line in FIG. 33A and FIG. 33B.

Providing such depressions 113*r* causes the corners of the bag-like member 110 not to interfere with fixation of the bag-like member 110 to the connection member 120 and thereby facilitates assembly of the liquid container 100. The presence of the depressions 113*r* also enables the leading end 113*e* and the side end portions 113*s* of the bag-like member 110 to be located near to the guided elements 165. This configuration accordingly enables the outer circumferential edge 113 of the bag-like member 110 to be held by the connection member 120. In other words, this configuration enables the bag-like member 110 to be protected by the connection member 120. The depressions 113*r* are formed by specifying the positions of the guided elements 165 based on the positions of the two through ports 302*f* and 302*s* of the supply port member 116 and cutting the welding part of the bag-like member 110 after the supply port member 116 is welded to the supply port 114 of the bag-like member 110.

Configuration of Containing Portion

Figure 34:
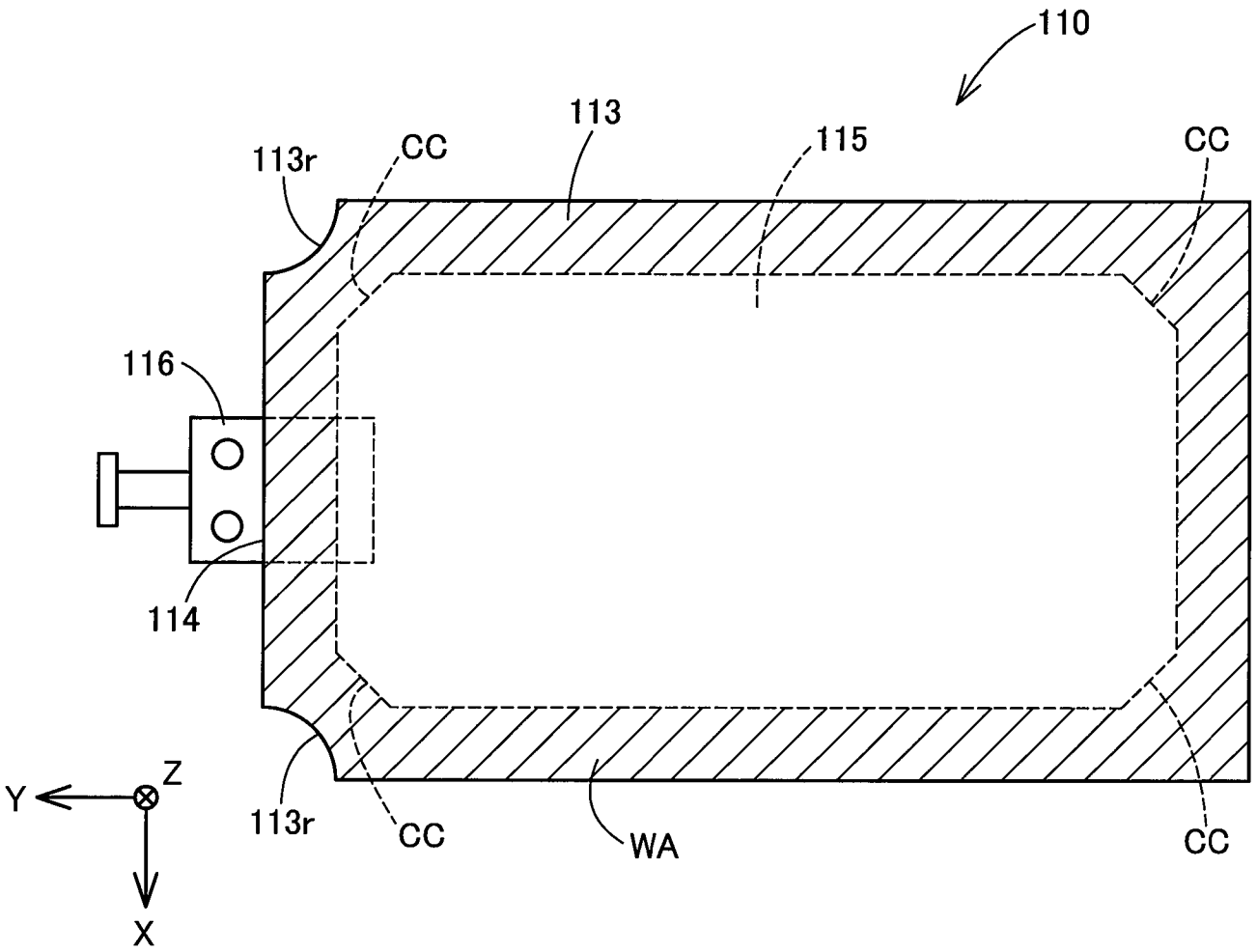
FIG. 34 is a diagram illustrating the configuration of a containing portion inside of the bag-like member.

The configuration of the containing portion 115 inside of the bag-like member 110 is described with reference to FIG. 34. FIG. 34 schematically illustrates the bag-like member 110 when being viewed in the +Z direction. A welding area WA at the outer circumferential edge of the bag-like member 110 is shown by the broken line and is filled with hatched lines in FIG. 34. The welding area WA is formed along the outer circumferential edge 113 of the bag-like member 110, and the containing portion 115 is formed as an area surrounded by the welding area WA. It is preferable that the welding area WA has inclined connection parts CC, in order not to provide the containing portion 115 with four right-angled corners. In other words, it is preferable that the welding area WA has areas protruded toward the center of the containing portion 115 at the four corners of the containing portion 115. Providing the containing portion 115 with such connection parts CC suppresses the liquid from remaining at the four corners of the containing portion 115 in the course of consumption of the liquid contained in the containing portion 115 by the liquid ejection device 10. Forming at least one connection part CC in the containing portion 115 brings this advantageous effect. The connection part CC is not necessarily formed by a straight line but may be formed by a curved line.

Details of Configuration and Functions of Handle

Figure 35:
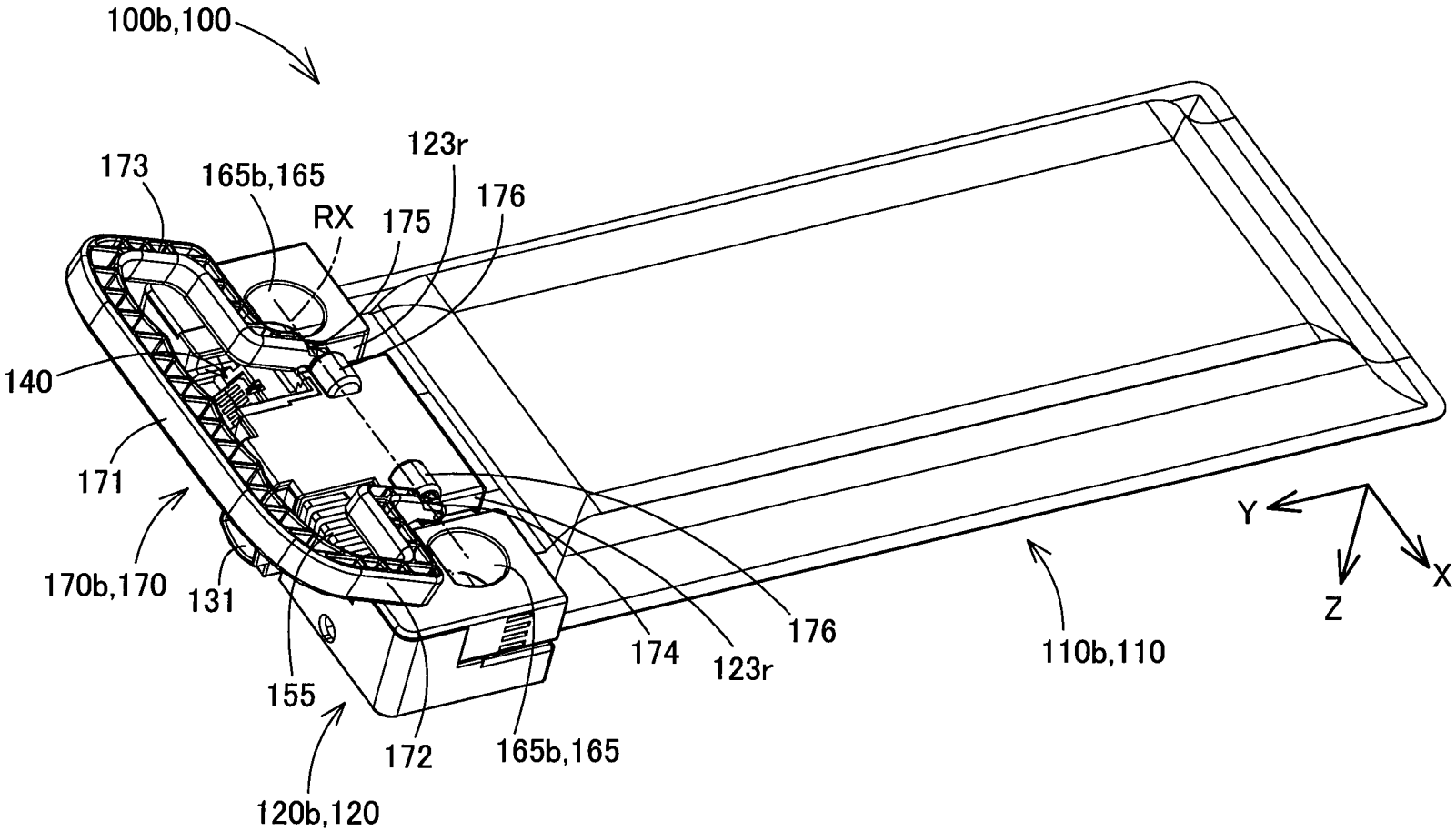
FIG. 35 is a schematic perspective view illustrating the first liquid container when a handle is at a second position.
Figure 36:
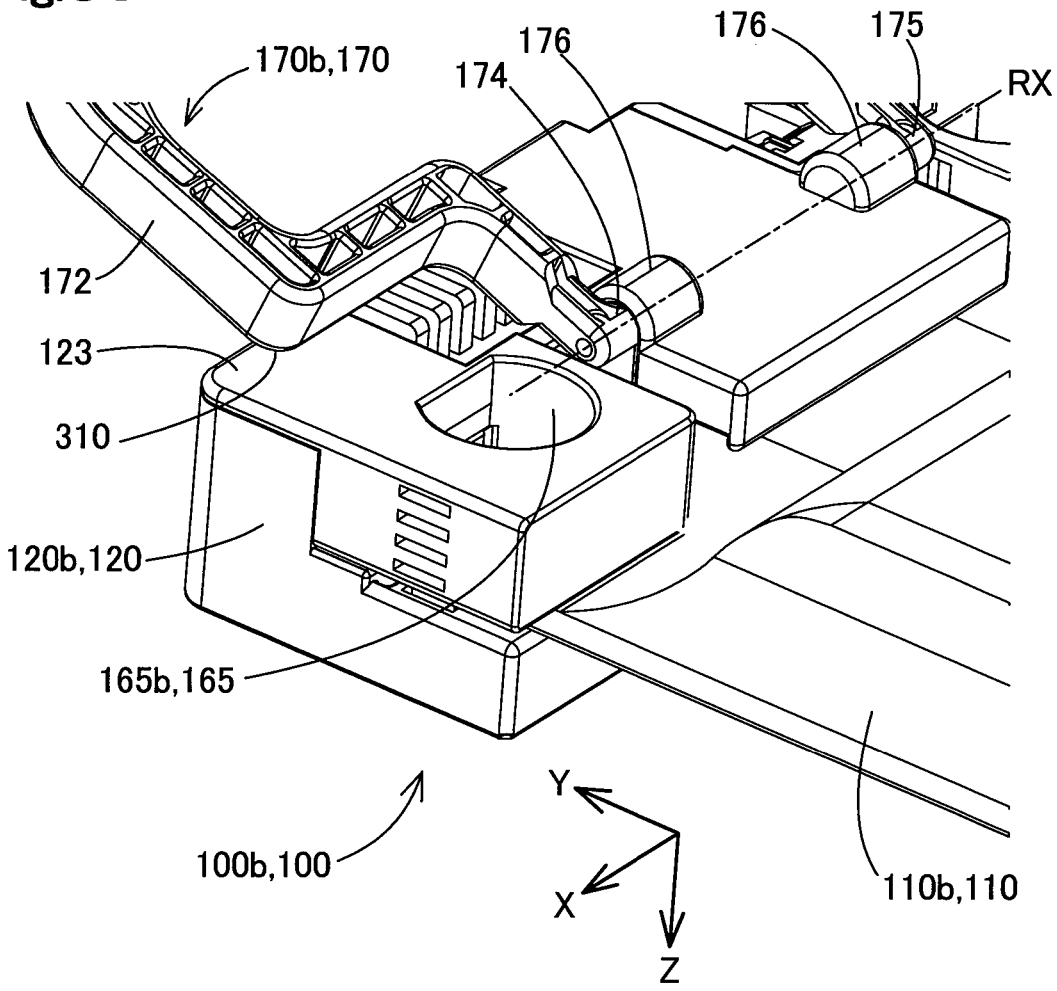
FIG. 36 is a schematic diagram illustrating the periphery of base end portions of the handle at the second position.
Figure 37:
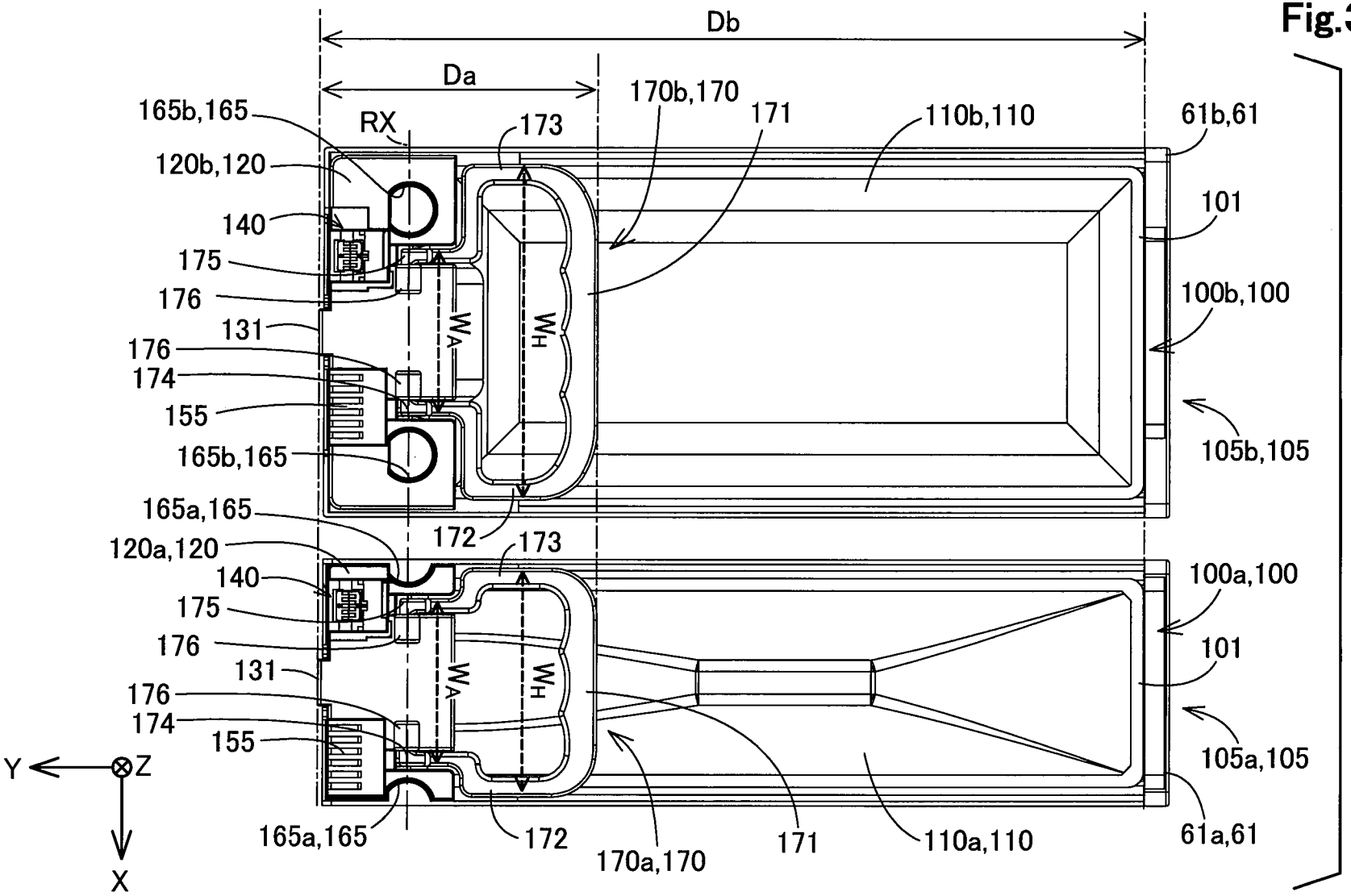
FIG. 37 is a schematic diagram illustrating the mounting body when the handle is at a first position.

The details of the configuration and the functions of the handle 170 are described with reference to FIGS. 35 to 37. FIG. 35 is a schematic perspective view illustrating the first liquid container 100*a* when the handle 170*a* is at the second position. The handle 170*b* of the second liquid container 100*b* is similarly set at a second position, like the position of the handle 70*a* shown in FIG. 35. FIG. 36 is a schematic diagram extracting and illustrating the periphery of a second base end portion 175 of the handle 170*b* at the second position. FIG. 37 is a schematic diagram illustrating the two different mounting bodies 105*a* and 105*b* with the handles 170*a* and 170*b* at the first position when being viewed in the +Z direction. The description below is common to the handle 170*a* of the first liquid container 100*a* and the handle 170*b* of the second liquid container 100*b*, unless otherwise specified.

As described above, for example, in the case of carrying the liquid container 100, the handle 170 is rotated toward the connection member 120 from the first position that is laid down to the bag-like member 110-side to the rising second position (as shown in FIG. 35). The handle 170 is provided at the connection member 120 located on the +Y direction side end of the liquid container 100. When the user holds the handle 170 to move the liquid container 100, the position of the liquid container 100 is stabilized in such a state that the bag-like member 110-side where the center of gravity of the liquid container 100 is located is hung. This configuration enhances the handling performance of the liquid container 100 and facilitates mounting and dismounting of the liquid container 100 to and from the case 61.

According to the embodiment, when the handle 170 is at the second position, parts of the coupling portions 172 and 173 come into contact with the connection member 120 in the rotating direction of the handle 170, so as to stop the handle 170 (as shown in FIG. 36). The handle 170 is stopped when the grip portion 171 is located above the fixation structures 176. The contact location of the connection member 120 that is in contact with the handle 170 serves as a restrictor 310 to restrict the rotation of the handle 170. The restrictor 310 is located on the opposite side to the bag-like member 110 across the rotating axis RX of the handle 170. The presence of the restrictor 310 suppresses rocking of the liquid container 100 when the user grips the handle 170 and thereby further stabilizes the position of the liquid container 100 at the second position. It is desirable that the center of gravity of the liquid container 100 is located on the bag-like member 110-side of the rotating axis RX when being viewed from the restrictor 310. This configuration causes the handle 170 to abut on the restrictor 310 when the user grips the handle 170 to hang the liquid container 100. This accordingly suppresses rocking of the bag-like member 110 and thereby suppresses fluctuation of the liquid contained in the bag-like member 110.

According to the embodiment, the handle 170 at the second position is held at a position that overlaps with the container-side electrical connecting structure 140 in the Z direction and that is away from the container-side electrical connecting structure 140 (as shown in FIG. 36). Accordingly the container-side electrical connecting structure 140 is covered and protected by the handle 170 at the second position.

As described above, according to the embodiment, the base end portions 174 and 175 of the handle 170 are provided between the two guided elements 165 in the X direction. This facilitates the user to recognize the positions of the guided elements 165 based on the position of the handle 170 (as shown in FIG. 35). This configuration accordingly simplifies the mounting and dismounting operations of the liquid container 100 to and from the case 61 by using the handle 170. This configuration also facilitates positioning of the liquid container 100 when the liquid container 100 is placed in the case 61.

In the liquid container 100 of the embodiment, the grip portion 171 of the handle 170 at the first position is located at a position protruded from the connection member 120 toward the bag-like member 110 on the −Y direction side (as shown in FIG. 37). This configuration enables the user to readily grip the grip portion 171 when the handle 170 is at the first position. When the handle 170 is at the second position, the grip portion 171 of the handle 170 is arranged at a position protruded from the connection member 120 toward the +Y direction side that is opposite to the bag-like member 110 (as shown in FIG. 35). This configuration also enables the user to readily grip the grip portion 171 when the handle 170 is at the second position. Especially according to the embodiment, the handle 170 at the second position is inclined upward relative to the horizontal direction. The grip portion 171 is accordingly located at the position that enables the user to more readily grip. In the liquid container 100, the grip portion 171 of the handle 170 is located at such positions that enable the user to readily grip, whether the handle 170 is at the first position or at the second position. This accordingly facilitates the user's operations of the handle 170 and facilitates the mounting and dismounting operations of the liquid container 100 to and from the case 61.

According to the embodiment, the liquid outlet 131 and the containers-side electrical connecting structure 140 are arranged at positions that do not overlap with the handle 170 in the Z direction at the first position (as shown in FIG. 37). The fitting structure receiving portion 155 is also arranged at a position that does not overlap with the handle 170 in the Z direction. In the connection member 120 of the embodiment, recesses 123*r* are provided in the third surface portion 123 of the connection member 120 to receive at least part of the handle 170 at the first position (as shown in FIG. 15 and FIG. 35). According to the embodiment, parts of the coupling portions 172 and 173 are received in the recesses 123*r* when the handle 170 is at the first position. At least part of the handle 170 at the first position accordingly enters the connection member 120 in the Z direction. This reduces the dimension the liquid container 100 in the Z direction.

According to the embodiment, the handle 170 at the first position is placed at a position that does not interfere with the liquid outlet 131, the container-side electrical connecting structure 140 and the fitting structure receiving portion 155. This configuration accordingly suppresses the handle 170 from disturbing the connection of the mounting body 105 with the connection receiving portion 50.

According to the embodiment, the handle 170 at the first position is arranged along a plane perpendicular to the Z direction (as shown in FIG. 37 and FIG. 14). This configuration suppresses the handle 170 from being unnecessarily protruded in the −Z direction when the liquid container 100 is placed in the case 61 and thereby achieves downsizing of the mounting body 105. This accordingly reduces the spatial volume of the case placement unit 60 in the liquid ejection device 10 and thereby achieves downsizing of the liquid ejection device 10.

According to the embodiment, the two coupling portions 172 and 173 of the handle 170 respectively include portions that are extended from the respective ends of the grip portion 171 in a direction toward the center in the X direction of the grip portion 171 (as shown in FIG. 37). According to the embodiment, the coupling portions 172 and 173 are respectively bent in a crank-like shape from the respective ends of the grip portion 171 toward the center in the X direction of the grip portion 171. This configuration causes a width WH in the X direction of the grip portion 171 of the handle 170 to be longer than a width WB in the X direction between the base end portions 174 and 175. This configuration reduces the size of the base end portions 174 and 175-side of the handle 170 and provides the grip portion 171 of the easy-to-grasp size.

According to the embodiment, the coupling portions 172 and 173 of the handle 170 are extended around the guided elements 165 not to overlap with the guided elements 165 in the Z direction both at the first position and at the second position. This configuration suppresses the handle 170 from disturbing the user's visual recognition of the guided elements 165.

The grip portion 171 of the handle 170 may be in contact with the bag-like member 110 at the first position. It is, however, preferable that the grip portion 171 of the handle 170 is kept at the position away from the bag-like member 110 at the first position as illustrated in FIG. 14. This configuration causes the bag-like member 110 not to be pressed in the Z direction by the handle 170 and suppresses deterioration of the pressure condition of the containing portion 115 inside of the bag-like member 110 due to a load applied from the handle 170. This accordingly suppresses deterioration of the supply performance of the liquid from the liquid container 100 to the liquid ejection device 10. The connection member 120 may be provided with a restrictor that comes into contact with part of the handle 170 at the first position to restrict rotation of the handle 170 in a direction toward the bag-like member 110. This restrictor may serve to suppress the handle 170 at the first position from coming into contact with the bag-like member 110.

The following description refers to FIG. 37. Da denotes a distance in the Y direction from a −Y direction side end of the connection member 120 to a −Y direction side end of the handle 170 at the first position. Db denotes a distance in the Y direction from the −Y direction side end of the connection member 120 to the −Y direction side end 101 of the bag-like member 110. It is preferable that the distance Da is not greater than one third of the distance Db ($Da \leq Db/3$). This reduces the overlap range of the handle 170 and the bag-like member 110 in the Z direction. The grip portion 171 of the handle 170 is located above a portion of the bag-like member 110 having a relatively small thickness in the Z direction. This configuration enables the grip portion 171 of the handle 170 to be located at the easy-to-grasp position and suppresses the bag-like member 110 from receiving a load from the handle 170 at the first position. This prevents size expansion of the handle 170 and achieves downsizing of the liquid container 100 to be placed in a space-saving manner in the case placement unit 60 of the liquid ejection device 10.

Summary of First Embodiment

As described above, positioning using the guided elements 165 and the guide elements 208 improves the mounting position of the liquid container 100 of the embodiment relative to the liquid ejection device 10. The liquid container 100 of the embodiment also has the various functions and advantageous effects described in the above embodiment.

B. Second Embodiment

Figure 38:
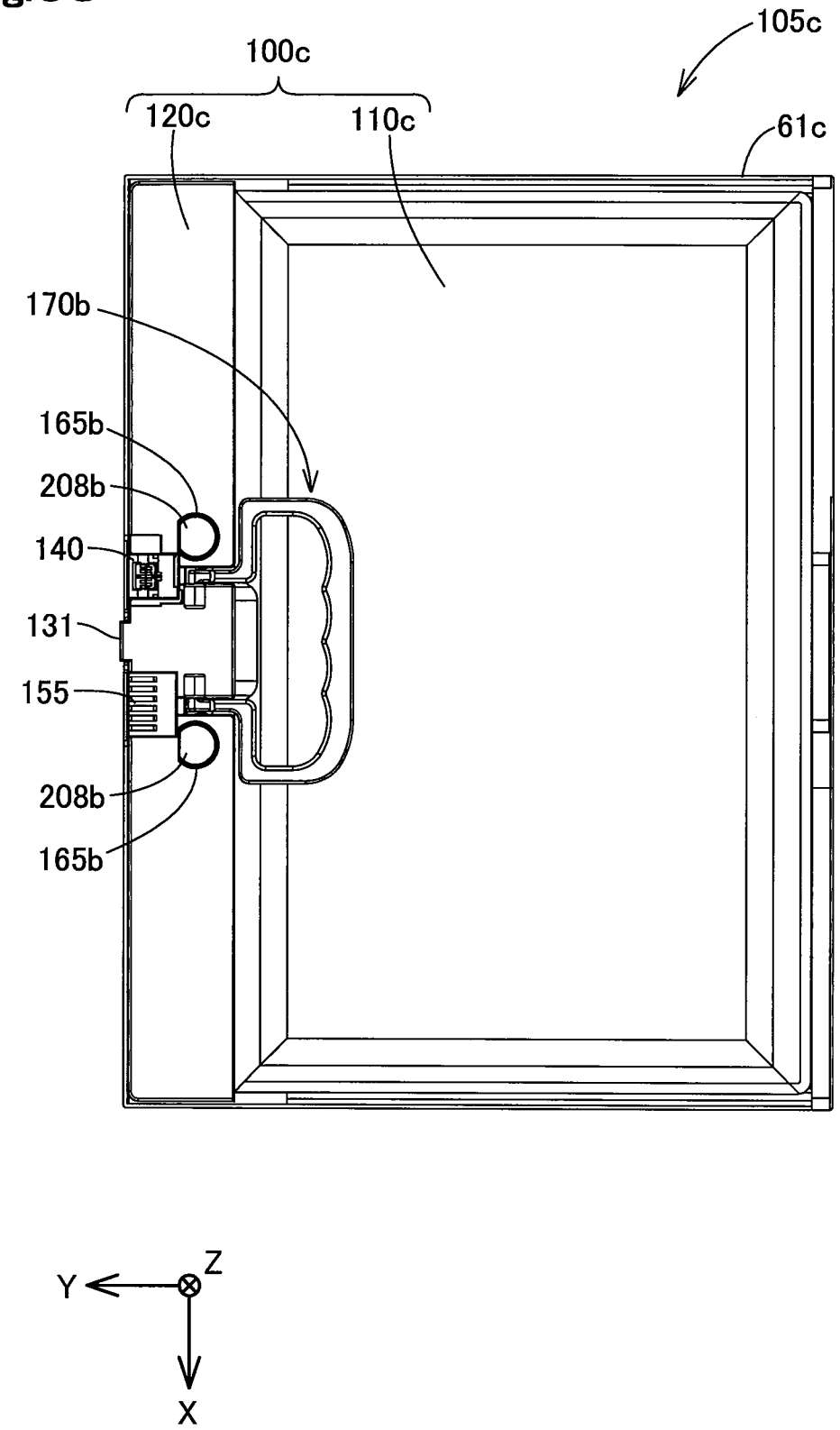
FIG. 38 is a schematic diagram illustrating a mounting body according to a second embodiment.

FIG. 38 is a schematic diagram illustrating a mounting body 105*c* according to a second embodiment when being viewed in the +Z direction. The mounting body 105*c* of the second embodiment is comprised of a liquid container 100*c* and a case 61*c* having large dimensions in the X direction. The liquid container 100*c* and the case 61*c* respectively have substantially similar configurations to those of the second liquid container 100*b* and the second case 61*b* of the first embodiment, except that side end portions in the X direction are extended in the +X direction and in the −X direction.

A liquid ejection device which the liquid container 100*c* of the second embodiment is mounted to an inkjet printer for monochromatic printing but is otherwise substantially similar to the liquid ejection device 10 described in the first embodiment. In the liquid ejection device of the second embodiment, a case placement unit 60 is occupied by one liquid container 100*c*. One connection receiving portion 50 is provided at the approximate center in the X direction in a +Y direction side area of the case placement unit 60.

A bag-like member 110*c* in the liquid container 100*c* of the second embodiment has an extended width in the X direction, compared with the bag-like member 110*b* in the second liquid container 100*b* of the first embodiment. The bag-like member 110*c* has the larger width in the X direction than a width in the Y direction.

A connection member 120*c* in the liquid container 100*c* of the second embodiment has respective end portions in the X direction that are respectively extended in the +X direction and in the −X direction corresponding to the extended width in the X direction of the bag-like member 110*c*. A +Y direction side end portion of the bag-like member 110*c* is held in the connection member 120*c* over the entire length in the X direction.

The connection member 120*c* of the second embodiment is configured to be connectable with a connection receiving portion 50 that has the same configuration as that described in the first embodiment. The location layout of various components of the connection member 120*c* involved in connection with the connection receiving portion 50 is substantially identical with that of the second connection member 120*b* of the first embodiment. The connection member 120*c* includes two guided elements 165*b* that are similar to those described in the first embodiment.

The case 61*c* of the second embodiment has an expanded width in the X direction to be fitted for the liquid container 100*c*. The case 61 includes two guide elements 208*b* that are provided in a bottom surface of a bottom wall portion 200 and that are similar to those described in the first embodiment. In the mounting body 105*c* of the second embodiment, the guide elements 208*b* are fitted in the guided elements 165*b*. This increases the positioning accuracy of the liquid container 100*c* on the case 61*c*.

The liquid container 100*c* of the second embodiment increases the contained amount of ink. The liquid container 100*c* also has the enhanced stability of the location position. The liquid container 100*c* of the second embodiment additionally has various functions and advantageous effects described in the first embodiment. The liquid ejection device which the liquid container 100*c* of the second embodiment is mounted to may be configured such that a plurality of the liquid containers 100*c* are laid one over another in the Z direction to be mounted in parallel to one another. In this modification, the liquid ejection device may perform multicolor printing with a plurality of the liquid containers 100*c* containing different color inks.

C. Third Embodiment

Figure 39:
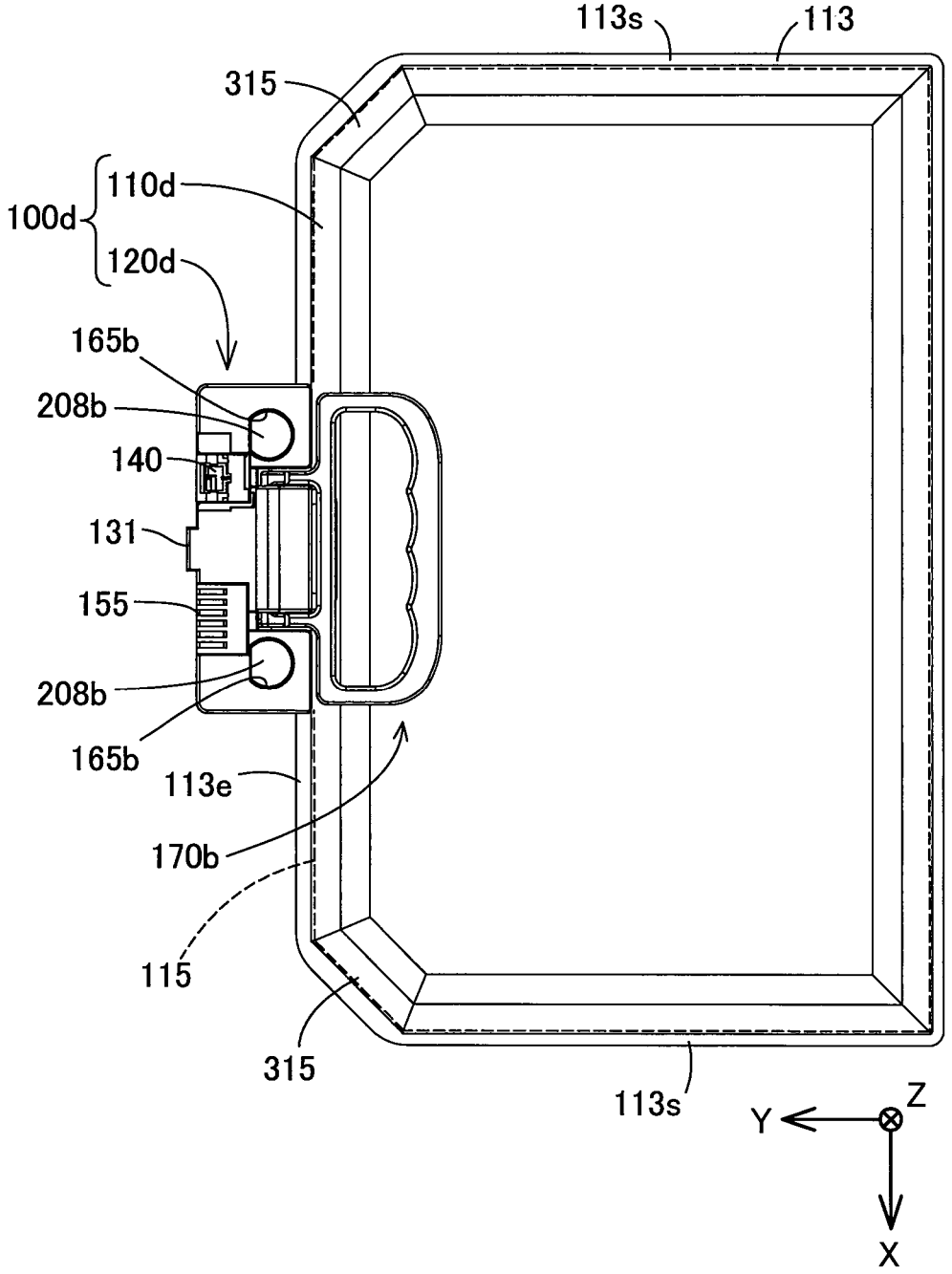
FIG. 39 is a schematic diagram illustrating a liquid container according to a third embodiment.

FIG. 39 is a schematic diagram illustrating a liquid container 100*d* according to a third embodiment when being viewed in the +Z direction. The liquid container 100*d* of the third embodiment is substantially similar to the liquid container 100*c* of the second embodiment, except that the liquid container 100*d* includes a bag-like member 110*d* in a different shape when being viewed in the Z direction and that the liquid container 100*d* is provided with a connection member 120*d* having a configuration similar to the configuration of the second connection member 120*b* described in the first embodiment.

The liquid container 100*d* of the third embodiment has such a configuration that the side end portions 113*s* on the respective sides in the X direction of the bag-like member 110*b* are respectively extended in the +X direction and in the −X direction from the second connection member 120*b* in the second liquid container 100*b* described in the first embodiment. The liquid container 100*d* is placed in the case 61*c* described in the second embodiment and is mounted to a liquid ejection device that is similar to that described in the second embodiment.

In the liquid container 100*d* of the third embodiment, a middle part in the X direction of a leading end 113*e* of the bag-like member 110*d* is held by the connection member 120*d*. Respective side end portions 113*s* in the X direction of the bag-like member 110*d* of the third embodiment are accordingly extended in the X direction from the connection member 120*d*.

Two corners 315 on a +Y direction side end portion of the bag-like member 110*d* have chamfered shapes. This configuration suppresses welding areas at the respective corners 315 from being damaged or deteriorated. A containing portion 115 included in the bag-like member 110*d* similarly have corners of chamfered shapes (shown by the broken line). This configuration suppresses the liquid from remaining in these corners of the containing portion 115 in the course of consumption of the liquid contained in the containing portion 115 by the liquid ejection device. The liquid container 100*d* of the third embodiment additionally has various functions and advantageous effects similar to those described in the above respective embodiments.

D. Fourth Embodiment

Figure 40:
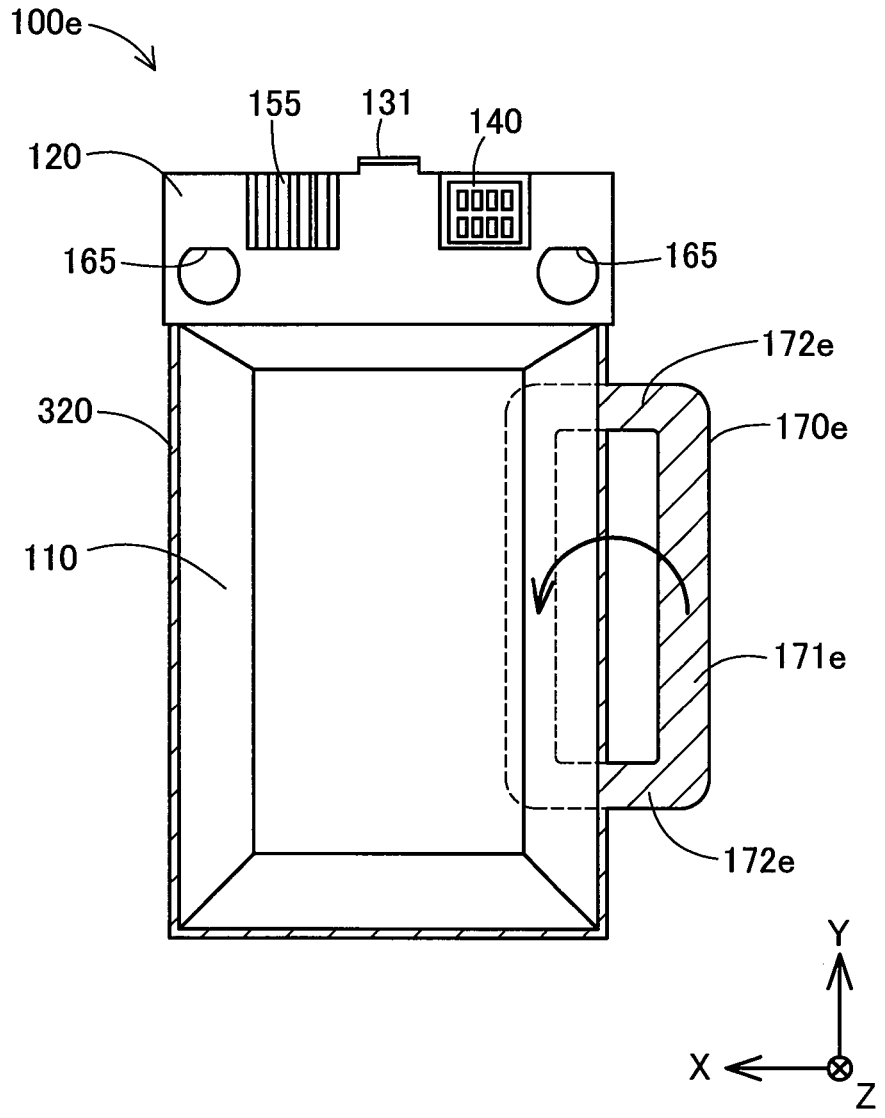
FIG. 40 is a diagram illustrating a liquid container according to a fourth embodiment.

FIG. 40 is a diagram illustrating a liquid container 100*e* according to a fourth embodiment. The liquid container 100*e* has a substantially similar configuration to that of the liquid container 100 described in the first embodiment, except that the handle 170 attached to the connection member 120 is replaced by a handle 170*e* attached to a sheet member 320. The liquid container 100*e* is placed on a case 61 similar to that described in the first embodiment and is mounted to a liquid ejection device 10 having a similar configuration to that described in the first embodiment.

The liquid container 100*e* is provided with the sheet member 320 that is located below a bag-like member 110 and that is configured to support the bag-like member 110. The sheet member 320 is arranged to support the entire bag-like member 110. The sheet member 320 may be formed by, for example, film formation of a resin such as polyethylene terephthalate (PET). The sheet member 320 may be formed from a paper, plastic or metal plate-like material.

The handle 170*e* is provided on one end portion in the X direction of the sheet member 320. The handle 170*e* is provided on a −X direction side end portion in FIG. 40. The handle 170*e* is extended in the X direction from a side end portion 113*s* of the bag-like member 110. The handle 170*e* includes a grip portion 171*e* that is extended in the Y direction along the side end portion 113*s* of the bag-like member 110 and two coupling portions 172*e* that are configured to couple the respective end portions of the grip portion 171*e* with the sheet member 320. The handle 170*e* may be configured as part of the sheet member 320 or may be configured by joining a separate member from the sheet member 320 with the sheet member 320.

The handle 170*e* is generally set at a second position where the handle 170*e* is extended in the X direction from the bag-like member 110. The user grips the handle 170*e* at the second position to carry the liquid container 100*e*. The handle 170*e* is rotatable about coupling positions of the two coupling portions 172*e* with the sheet member 320 as the point of support. The handle 170*e* is also allowed to be set at a first position where the handle 170*e* is laid down toward the bag-like member 110 to be laid over the bag-like member 110 (shown by the broken line). This configuration suppresses the handle 170*e* from disturbing placement of the liquid container 100*e* in the case 61.

In the state that the liquid container 100*e* is placed in the case 61, the handle 170*e* may not be fully bent toward the bag-like member 110. The handle 170*e* may be rotated upward from the first position to come into contact with the side wall portions 201 and 202 of the case 61. The contact of the handle 170*e* with the case 61 stabilizes the position in the X direction of the liquid container 100*e*.

The handle 170*e* may be configured to be separable from the sheet member 320 by providing perforation or the like at the coupling positions of the two coupling portions 172*e* with the sheet member 320. This configuration enables the liquid container 100*e* to be mounted to the liquid ejection device 10 in a space-saving manner with separation of the handle 170*e* and thereby enhances the mountability of the liquid container 100*e* to the liquid ejection device 10.

The handle 170*e* may be provided on respective sides in the X direction of the bag-like member 110 or may be provided on a −Y direction side end of the bag-like member 110. The liquid container 100*e* of the fourth embodiment has various functions and advantageous effects described in the above respective embodiments, in addition to the functions and advantageous effects described above.

E. Fifth Embodiment

Figure 41:
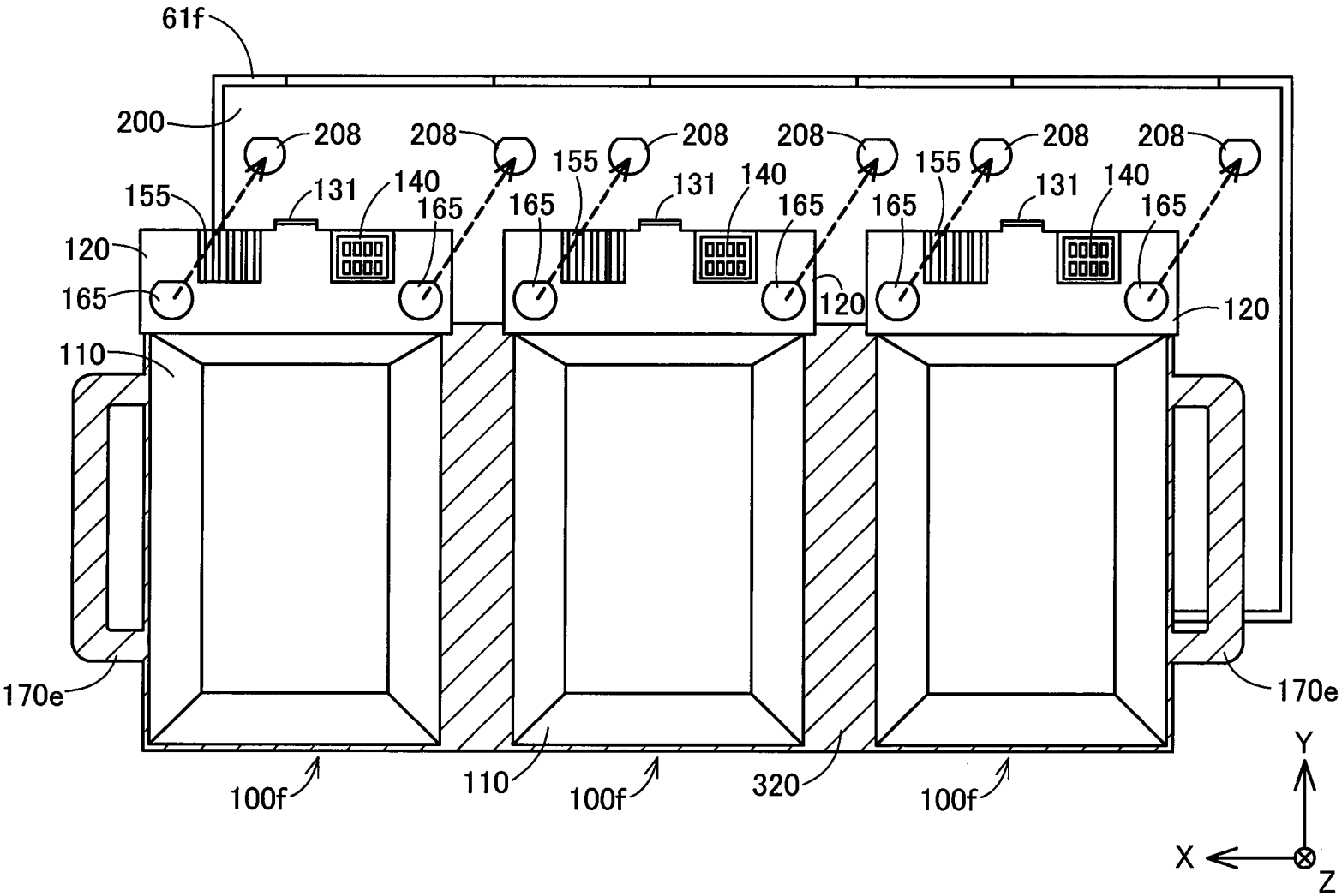
FIG. 41 is a diagram illustrating the configuration of a liquid container according to a fifth embodiment.

FIG. 41 is a diagram illustrating the configuration of liquid containers 100*f* according to a fifth embodiment. FIG. 41 illustrates a plurality of the liquid containers 100*f* and one common case 61*f* in which the plurality of liquid containers 100*f* are placed. The liquid container 100*f* of the fifth embodiment has a similar configuration to that of the liquid container 100*e* of the fourth embodiment except the points described below. According to the fifth embodiment, the plurality of liquid containers 100*f* are arrayed in a line in the X direction to be coupled with one another via a sheet member 320. A handle 170*e* similar to that described in the fourth embodiment is provided on each of the liquid containers 100*f* located at the positions on the respective ends in the X direction.

The coupled body of the plurality of liquid containers 100*f* are provided with two handles 170*e* located on the respective ends in the X direction. This configuration enhances the handling performance of the plurality of liquid containers 100*f* connected in the X direction and simplifies the mounting operation of the liquid containers 100*f* to the case 61. The handle 170*e* may be provided on only one side in the X direction. Providing even one handle 170*e* ensures the convenience in the case of carrying the plurality of liquid containers 100*f*.

The plurality of liquid containers 100*f* coupled with one another by means of the sheet member 320 are placed on the case 61*f*. A bottom wall portion 200 of the case 61*f* is provided with guide elements 208 corresponding to guided elements 165 of the respective liquid containers 100*f*. The respective liquid containers 100*f* are positioned at predetermined location positions in the case 61*f* by fitting the guide elements 208 into the corresponding guided elements 165.

When the coupled body of the liquid containers 100*f* is placed in the case 61*f*, the handle 170*e* may be bent toward the bag-like member 110 as described in the fourth embodiment or may come into contact with a side wall portion of the case 61 to rotate upward. The handles 170*e* may be separated from the liquid containers 100*e*.

The plurality of liquid containers 100*f* placed in the case 61*f* are mounted to a liquid ejection device. An identical color ink may be contained in all the plurality of liquid containers 100*f*. This readily increases the volume of this color ink. Different color inks may be respectively contained in the plurality of liquid containers 100*f*. This enables the plurality of color inks to be handled simultaneously and efficiently.

As described above, the handles 170*e* may be used to simultaneously handle the plurality of liquid containers 100*f* of the fifth embodiment that are coupled with one another. This configuration enables the liquid containers 100*f* to be mounted to and dismounted from the case 61*f* efficiently. The liquid container 100*f* of the fifth embodiment additionally has various functions and advantageous effects described in the above respective embodiments.

F. Modifications

The various configurations described in the above respective embodiments may be modified, for example, as described below. The modifications described below are all examples of the aspects of the present disclosure.

F1. Modification 1

In the above respective embodiments, the guided elements 165 are provided on the −Y direction side of the liquid outlet 131 and the container-side electrical connecting structure 140. According to a modification, the guided elements 165 may be provided on a +Y direction side of the liquid outlet 131 and the container-side electrical connecting structure 140 or may be provided to be aligned in the X direction with the liquid outlet 131 and the container-side electrical connecting structure 140.

F2. Modification 2

In the above respective embodiments, the guided elements 165 are provided on the +Y direction side of the bag-like member 110 including the containing portion 115. According to a modification, the guided elements 165 may be provided on a −Y direction side of the bag-like member 110 including the containing portion 115. For example, the connection member 120 may include portions that are extended in the −Y direction along the side end portions 113*s* of the bag-like member 110, and the guided elements 165 may be provided in these locations.

F3. Modification 3

In the above respective embodiments, the guided elements 165 are provided over the length in the Z direction in the connection member 120. According to a modification, the guided elements 165 may not be provided over the length in the Z direction in the connection member 120. For example, the guided elements 165 may be formed in a closed shape on the third surface portion 123-side of the connection member 120.

F4. Modification 4

In the above respective embodiments, the guided element 165 includes the planar portion 165*p*. The planar portion 165*p* may, however, be omitted. The guided element 165 includes the inclined surface 165*i* (shown in FIG. 28), but the inclined surface 165*i* may also be omitted. In the above respective embodiments, the guided element 165 includes the fitting portion 165*f* (shown in FIG. 28) that is fitted in the guide element 208 at the upper end portion. According to a modification, the guided element 165 may have, for example, a portion that is to be fitted in the guide element 208 in the middle of the upper end and the lower end in the Z direction or a portion that is to be fitted in the guide element 208 at the lower end portion.

F5. Modification 5

In the above respective embodiments, the container-side electrical connecting structure 140 includes the substrate portion 141 provided with the terminals 142. According to a modification, the container-side electrical connecting structure 140 may not include the substrate portion 141. For example, the container-side electrical connecting structure 140 may be configured such that the terminals 142 which the device-side electrical connecting structure 52 electrically comes into contact with are arranged directly on a wall surface of the connection member 120. In the above respective embodiments, the terminals 142 of the container-side electrical connecting structure 140 are arranged to face obliquely upward. According to a modification, the terminals 142 of the container-side electrical connecting structure 140 may not be arranged to face obliquely upward. The terminals 142 may be arranged to be perpendicular to the Z direction or may be arranged to be perpendicular to the Y direction. In the above respective embodiments, the substrate placement structure 144 configured to arrange the terminals 142 is provided as the recess that is recessed both in the −Y direction and in the +Z direction. According to a modification, the substrate placement structure 144 may not be formed as a recess. The terminals 142 may be provided in a portion that is protruded from the remaining portion.

F6. Modification 6

In the above respective embodiments, the first receiving portion 150*f* and the second receiving portion 150*s* are respectively provided at the positions that at least partly overlap with the respective guided elements 165 when being viewed in the Y direction. According to a modification, the first receiving portion 150*f* and the second receiving portion 150*s* may be provided at positions offset from the respective guided elements 165 when being viewed in the Y direction. In the above respective embodiments, the first receiving portion 150*f* and the second receiving portion 150*s* may be omitted.

F7. Modification 7

In the above respective embodiments, the main body of the connection member 120 is formed by coupling the first member 127*f* with the second member 127*s* in the Z direction (as shown in FIG. 30). According to a modification, the main body of the connection member 120 may be formed by coupling three or more members or may be formed by coupling two members in the X direction.

F8. Modification 8

In the above respective embodiments, the depressions 113*r* are provided at the +Y direction side ends of the side end portions 113*s* of the bag-like member 110. According to a modification, the depressions 113*r* may be omitted. In the above respective embodiments, the +Y direction side ends of the side end portions 113*s* of the bag-like member 110 may be folded to be around the guided elements 165 of the connection member 120.

F9. Modification 9

In the above respective embodiments, the bag-like member 110 includes the portions overlapping with the guided elements 165 of the connection member 120 when being viewed in the Y direction. According to a modification, the side end portions 113*s* of the bag-like member 110 may be located nearer to the center of the connection member 120 in the X direction than the guided elements 165 of the connection member 120 when being viewed in the Y direction.

F10. Modification 10

In the above respective embodiments, the guided element 165*a* is formed as the recess in the approximately semicylindrical shape, and the guided element 165*b* is formed as the through hole defining the space in the approximately cylindrical shape. According to a modification, the guided element 165 provided in the connection member 120 may have a different shape. For example, the guided element 165 may be formed as a recess that is recessed in a semispherical shape. The guided element 165 may have an approximately triangular or another polygonal opening shape in a horizontal section or may be formed as a slit-like cut extended in the Z direction. The two guided elements 165 may not be arrayed in the X direction. The two guided elements 165 may be provided at positions offset from each other in the Y direction. The two guided elements 165 are required to be away from each other in the X direction. The two guided elements 165 may have different sizes or different shapes.

F11. Modification 11

In the above respective embodiments, the guide element 208*a* is formed as the protrusion in the approximately semicylindrical shape corresponding to the shape of the inner space of the corresponding guided elements 165*a*. The guide element 208*b* is formed as the protrusion in the approximately cylindrical shape corresponding to the shape of the inner space of the corresponding guided element 165*b*. According to a modification, the guide element 208 may have a different shape from the shape of the inner space of the guided element 165 which the guide element 208 is fitted in. For example, the guide elements 208 which the guided elements 165*a* and 165*b* are fitted in may respectively have approximately polygonal prism shapes. The guide element 208 is required to have a shape at least partly fitting for the guided element 165 which the guide element 208 is fitted in.

F12. Modification 12

The handle 170 is not limited to the configurations described in the above respective embodiments. The handle 170 may be configured with omission of either one of the two coupling portions 172 and 173. In this modification, one of the base end portions 174 and 175 is omitted. The grip portion 171 may be curved to be extended in the X direction or may be bent to be extended. The two coupling portions 172 and 173 may be extended linearly or may be extended to be curved. The coupling portions 172 and 273 may be made of a material having flexibility. The fixation structure 176 may not be formed by the shaft holes which the shaft-like base end portions 174 and 175 are inserted in. The fixation structure 176 may be formed by, for example, a hinge. The fixation structure 176 of the handle 170 may not be provided on the third surface portion 123 of the connection member 120. For example, the fixation structure 176 of the handle 170 may be provided on the second surface portion 122 of the connection member 120 that faces in the −Y direction (as shown in FIG. 15) or may be provided on the fifth surface portion 125 or on the sixth surface portion 126 of the connection member 120. The rotating axis RX of the handle 170 may not be necessarily parallel to the X direction. The rotating axis RX of the handle 170 may intersect with the X direction. The handle 170 may be omitted.

F13. Modification 13

In the above respective embodiments, the Y direction that is the moving direction of the liquid container 100 and the case 61 in the case placement unit 60 corresponds to the front-rear direction of the liquid ejection device 10. According to a modification, the Y direction that is the moving direction of the liquid container 100 and the case 61 in the case placement unit 60 may not necessarily correspond to the front-rear direction of the liquid ejection device 10. For example, the Y direction that is the moving direction of the liquid container 100 and the case 61 in the case placement unit 60 may be a lateral direction of the liquid ejection device 10. More specifically a mounting slot for the liquid container 100 and the case 61 may be provided in a right side surface or in a left side surface of the liquid ejection device 10. The Y direction that is the moving direction of the case 61 may not be necessarily orthogonal to the direction of gravity but may be a direction obliquely intersecting with the direction of gravity. In the above respective embodiments, the case placement unit 60 is provided at the lowermost position in the liquid ejection device 10. According to a modification, the case placement unit 60 may be formed at another height position. The case placement unit 60 may be provided in a center area in the Z direction.

F14. Modification 14

The above first embodiment describes the configuration of the liquid ejection device 10 with four liquid containers 100 mounted thereto. The above second embodiment and third embodiment describe the configurations of the liquid ejection device with one liquid container 100*c* or 100*d* mounted thereto. The number of the liquid containers 100 mounted to the liquid ejection device is not limited to these numbers described in the above respective embodiments. For example, the liquid ejection device may be configured to allow only one first liquid container 100*a* or only one second liquid container 100*b* of the first embodiment to be mounted to. The liquid ejection device may be configured to allow two or more liquid containers 100*c* of the second embodiment or two or more liquid containers 100*d* of the third embodiment to be mounted to. In the first embodiment described above, the two different types of liquid containers 100*a* and 100*b* are mounted to the liquid ejection device 10. According to a modification, only either one of the liquid containers 100*a* and 100*b* may be mounted to the liquid ejection device 10, or three or more different types of liquid containers having different configurations may be mounted to the liquid ejection device 10.

F15. Modification 15

In the above respective embodiments, the case-side fixation structure 220 has the heart cam groove structure. According to a modification, the case-side fixation structure 220 may not necessarily have the heart cam groove structure. For example, the case-side fixation structure 220 may be configured to have only a step which the protrusion 54*p* of the device-side fixation structure 54 is engaged with in the −Y direction in the engagement state. In this modification, it is preferable that the device-side fixation structure 54 is configured to be moved in the X direction to be disengaged by, for example, the user's operation. In the above respective embodiments, the case-side fixation structure 220 may be omitted.

F16. Modification 16

The configuration of the liquid container 100 is not limited to the configurations described in the above respective embodiments. For example, the bag-like member 110 of the liquid container 100 may have an approximately disk shape. In the connection receiving portion 50, the liquid outlet 131 may not be necessarily located at the center in the X direction, and the container-side electrical connecting structure 140 may be provided at the center in the X direction. The liquid outlet 131 may not be necessarily provided between the pair of receiving portions 150*f* and 150*s* in the X direction. The pair of receiving portions 150*f* and 150*s* may not be necessarily provided at identical height positions and may not necessarily have substantially the same opening shapes and opening sizes. The container-side electrical connecting structure 140 may not be necessarily formed at the deep position in the −Y direction but may be formed at a position protruded in the +Y direction.

F17. Modification 17 The configuration of the case 61 which the liquid container 100 is placed in is not limited to the configurations described in the above respective embodiments. The case 61 may not be necessarily formed in the tray-like shape but may be formed from a frame-like member that is configured by combining a plurality of columnar members.

F18. Modification 18

The connection receiving portion 50 which the liquid container 100 is connected with is not limited to the configurations described in the above respective embodiments. The connection receiving portion 50 may not be necessarily configured as a single component, but the liquid introducing element 51, the device-side electrical connecting structure 52 and the pair of positioning elements 53*f* and 53*s* may be independently and separately arranged as different members.

F19. Modification 19

In the above respective embodiments, the liquid ejection device 10 is a printer, and the liquid ejection system 11 is an inkjet-type printing system. According to a modification, the liquid ejection device 10 may not be necessarily a printer, and the liquid ejection system 11 may not be necessarily a printing system. For example, the liquid ejection device 10 may be configured as cleaning device to eject a liquid detergent. In this example, the liquid ejection system is a cleaning system.

The present disclosure is not limited to any of the embodiments, the examples and the modifications described above but may be implemented by a diversity of configurations without departing from the scope of the disclosure. For example, the technical features of any of the embodiments, the examples and the modifications corresponding to the technical features of each of the aspects described in Summary may be replaced or combined appropriately in order to solve part or all of the problems described above or in order to achieve part or all of the advantageous effects described above. Any of the technical features that are even not explicitly explained as "may be omitted" in the description hereof may be omitted appropriately unless the technical feature is described as essential herein.

The present application is a national phase entry of International Appl. No. PCT/JP2017/028561, filed Aug. 7, 2017; which claims priority from Japanese patent application 2016-158443 filed on Aug. 12, 2016 and Japanese patent application 2016-203316 filed on Oct. 17, 2016, the entireties of the contents of all of which are hereby incorporated by reference into this application.

REFERENCE SIGNS LIST

10 . . . liquid ejection device, 10*c* . . . housing, 11 . . . liquid ejection system, 12 . . . front surface portion, 13 . . . operation part, 13*b* . . . operation button, 13*i* . . . display portion, 14 . . . medium outlet, 15 . . . medium receiver, 16 . . . medium storage inlet, 17 . . . medium storage unit, 18 . . . cover member, 20 . . . controller 30 . . . ejection unit, 31 . . . head portion, 32 . . . tube, 32*r* . . . curved portion, 33 . . . nozzle, 34 . . . carriage, 35 . . . medium conveyance unit, 36 . . . conveyance roller, 40 . . . liquid supply unit, 42 . . . supply pipe, 43 . . . joint, 45 . . . pressure fluctuation generator, 46 . . . pressure transmitting pipe, 50 . . . connection receiving portion, 50*a* . . . first connection receiving portion, 50*b* . . . second connection receiving portion, 51 . . . liquid introducing element, 51*p* . . . through hole, 51*t* . . . leading end portion, 52 . . . device-side electrical connecting structure, 52*g* . . . guide projection, 52*t* . . . terminal portion, 53*f* . . . first positioning element,

53*s* . . . second positioning element, 53*g* . . . groove, 54 . . . device-side fixation structure, 54*p* . . . protrusion, 54*p* . . . engagement element, 54*t* . . . leading end, 55 . . . fitting structure, 55*c* . . . protrusion, 56 . . . liquid receiving element, 57 . . . base end member, 57*e* . . . biasing member, 60 . . . case placement unit, 61 . . . case, 61*a* . . . first case, 61*b* . . . second case, 61*c* . . . case, 61*f* . . . case, 62 . . . opening member, 62*e* . . . top wall portion, 62*s* . . . inclined wall surface, 63 . . . through port, 63*r* . . . concave, 64 . . . rail groove, 65 . . . roller, 70*a* . . . handle, 100 . . . liquid container, 100*a* . . . first liquid container, 100*b* . . . second liquid container, 100*c* . . . liquid container, 100*d* . . . liquid container, 100*e* . . . liquid container, 100*f* . . . liquid container, 101 . . . end, 105 . . . mounting body, 105*a* . . . first mounting body, 105*b* . . . second mounting body, 105*c* . . . mounting body, 110 . . . bag-like member, 110*a* . . . bag-like member, 110*b* . . . bag-like member, 110*c* . . . bag-like member, 110*d* . . . bag-like member, 111 . . . first sheet member, 112 . . . second sheet member, 113 . . . outer circumferential edge, 113*e* . . . leading end, 113*r* . . . depression, 113*s* . . . side end portion, 114 . . . supply port, 115 . . . containing portion, 116 . . . supply port member, 117 . . . piping portion, 118 . . . connection main body, 118*f* . . . first fixation portion, 118*s* . . . second fixation portion, 120 . . . connection member, 120*a* . . . first connection member, 120*b* . . . second connection member, 120*c* . . . connection member, 120*d* . . . connection member, 121 . . . first surface portion, 122 . . . second surface portion, 123 . . . third surface portion, 124 . . . fourth surface portion, 125 . . . fifth surface portion, 126 . . . sixth surface portion, 127*f* . . . first member, 127*s* . . . second member, 128 . . . slit, 129*c* . . . claw, 129*h* . . . engagement hole, 131 . . . liquid outlet, 132 . . . peripheral portion, 140 . . . container-side electrical connecting structure, 141 . . . substrate portion, 141*s* . . . surface, 142 . . . terminal, 144 . . . substrate placement structure, 144*s* . . . inclined surface, 145 . . . wall portion, 146 . . . side wall surface, 147 . . . guide recess, 150*f* . . . first receiving portion, 150*s* . . . second receiving portion, 151*f* . . . first opening, 151*s* . . . second opening, 155 . . . fitting structure receiving portion, 156 . . . protrusion, 157 . . . valley, 160 . . . recess, 161 . . . fitting concave, 165 . . . guided element, 165*a* . . . guided element, 165*b* . . . guided element, 165*f* . . . fitting portion, 165*i* . . . inclined surface, 165*p* . . . planar portion, 170 . . . handle, 170*a* . . . handle, 170*b* . . . handle, 170*e* . . . handle, 171 . . . grip portion, 171*e* . . . grip portion, 172 . . . first coupling portion, 172*e* . . . coupling portion, 173 . . . second coupling portion, 174 . . . first base end portion, 175 . . . second base end portion, 176 . . . fixation structure, 200 . . . bottom wall portion, 200*s* . . . bottom surface, 201 . . . first side wall portion, 202 . . . second side wall portion, 203 . . . rear wall portion, 203*h* . . . through hole, 205 . . . front wall portion, 208 . . . guide element, 208*a* . . . guide element, 208*b* . . . guide element, 208*p* . . . planar portion, 210 . . . projection, 211 . . . inner space, 214 . . . step, 215 . . . groove, 215A . . . first groove part, 215B . . . second groove part, 215C . . . third groove part, 215D . . . fourth groove part, 216 . . . rib, 220 . . . case-side fixation structure, 221 . . . middle projection, 222 . . . first wall surface, 223 . . . second wall surface, 224 . . . third wall surface, 225 . . . first protruded wall portion, 226 . . . second protruded wall portion (engaged element, locking element), 227 . . . third protruded wall portion, 228A . . . first bottom surface, 228B . . . second bottom surface, 228C . . . third bottom surface, 228D . . . fourth bottom surface, 228E . . . fifth bottom surface, 228F . . . sixth bottom surface, 229 . . . side wall surface, 230 . . . rail rib, 231 . . . leg, 300 . . . tubular member, 301 . . . protrusion, 302*f* . . . first through port, 302*s* . . . second through port, 303 . . . aperture, 305 . . . fixation structure, 310 . . . restrictor, 315 . . . corner, 320 . . . sheet member, CC . . . connection part, CL . . . center axis, CP . . . contact area, FM . . . film member, LA . . . location area, MP . . . medium, RX . . . rotating axis, WA . . . welding area, WD . . . welding area

What is claimed is:

1. A liquid container configured to be mountable to and dismountable from a case of a liquid ejection device, wherein a direction parallel to a direction of gravity is defined as a Z direction, a direction of the Z direction that is identical with the direction of gravity is defined as a +Z direction and a direction of the Z direction that is opposite to the direction of gravity is defined as a −Z direction;

a direction orthogonal to the Z direction is defined as a Y direction, one direction of the Y direction is defined as a +Y direction and the other direction of the Y direction is defined as a −Y direction; and a direction orthogonal to the Z direction and the Y direction is defined as an X direction, one direction of the X direction is defined as a +X direction and the other direction of the X direction is defined as a −X direction, the liquid ejection device comprising: a housing with a case placement unit therein; the case configured to move along the +Y direction to be inserted into the case placement unit, the case including a bottom surface arranged to face in the −Z direction and two guide elements protruded in the −Z direction from the bottom surface in a state that the case is placed in the case placement unit; a liquid introducing element located at a +Y direction side end of the case placement unit; and a device-side electrical connecting structure located at the +Y direction side end of the case placement unit, the liquid container comprising:

a bag-like member that has flexibility and includes a containing portion therein to contain a liquid therein; and a connection member located at a +Y direction side end of the liquid container, in a mounting state that the liquid container is mounted to the liquid ejection device, the connection member comprising:

a liquid outlet configured such that the liquid introducing element is inserted into the liquid outlet in the −Y direction, in the mounting state;

a container-side electrical connecting structure configured such that the device-side electrical connecting structure is connected with the container-side electrical connecting structure in the −Y direction, in the mounting state; and two guided elements configured such that at least respective parts of the two guide elements are fitted in the two guided elements, in a state that the liquid container is placed in the case, each of the two guided elements including:

an inlet that accepts a corresponding guide element; and an inclined surface at the inlet, wherein in the mounting state, the liquid outlet is located between the two guided elements in the X direction, and the container-side electrical connecting structure is located between one of the two guided elements and the liquid outlet.

2. The liquid container according to claim 1, wherein in the mounting state, the two guided elements are located on the −Y direction side of the container-side electrical connecting structure and the liquid outlet.

3. The liquid container according to claim 2, wherein in the mounting state, the containing portion is located on the −Y direction side of the two guided elements.

4. The liquid container according to claim 2, wherein the container-side electrical connecting structure has a terminal portion that electrically comes into contact with the device-side electrical connecting structure, and the terminal portion is located on the +Z direction side of respective −Z direction side ends of the two guide elements and is pressed in at least the +Z direction by the device-side electrical connecting structure, in the mounting state.

5. The liquid container according to claim 1, wherein the liquid ejection device has two positioning elements that are provided in the case placement unit and that are extended from a +Y direction side end toward a −Y direction side end of the case placement unit, and the connection member of the liquid container is provided with two receiving portions configured to respectively receive the two positioning elements, wherein the two receiving portions are located at positions that are away from each other in the X direction across the liquid outlet in the mounting state, and each of the two receiving portions is arranged to at least partly overlap with either one of the two guided elements when being viewed in the Y direction in the mounting state.

6. The liquid container according to claim 1, wherein at least one of the guided elements is provided over a length in the Z direction of the connection member in the mounting state.

7. The liquid container according to claim 1, wherein the bag-like member has a supply port that is provided at a leading end of the bag-like member located on a +Y direction side of the bag-like member in the mounting state, that is arranged to communicate with the containing portion, and that is connected with the liquid introducing element via the liquid outlet, and the connection member includes a first member and a second member arranged to place and hold the leading end including the supply port therebetween in the Z direction in the mounting state.

8. The liquid container according to claim 1, wherein the bag-like member has a leading end that is located on a +Y direction side of the bag-like member in the mounting state and that is held by the connection member, wherein the leading end includes portions that overlap with the two guided elements in the X direction in the mounting state.

9. A liquid container configured to be mountable to and dismountable from a case of a liquid ejection device, wherein a direction parallel to a direction of gravity is defined as a Z direction, a direction of the Z direction that is identical with the direction of gravity is defined as a +Z direction and a direction of the Z direction that is opposite to the direction of gravity is defined as a −Z direction;

a direction orthogonal to the Z direction is defined as a Y direction, one direction of the Y direction is defined as a +Y direction and the other direction of the Y direction is defined as a −Y direction; and a direction orthogonal to the Z direction and the Y direction is defined as an X direction, one direction of the X direction is defined as a +X direction and the other direction of the X direction is defined as a −X direction, the liquid ejection device comprising: a housing with a case placement unit therein; the case configured to move along the +Y direction to be inserted into the case placement unit, the case including a bottom surface arranged to face in the −Z direction and two guide elements protruded in the −Z direction from the bottom surface in a state that the case is placed in the case placement unit; a liquid introducing element located at a +Y direction side end of the case placement unit; and a device-side electrical connecting structure located at the +Y direction side end of the case placement unit, the liquid container comprising:

a connection member located at a +Y direction side end of the liquid container, in a mounting state that the liquid container is mounted to the liquid ejection device, the connection member comprising:

a liquid outlet configured such that the liquid introducing element is inserted into the liquid outlet in the −Y direction, in the mounting state;

a container-side electrical connecting structure configured such that the device-side electrical connecting structure is connected with the container-side electrical connecting structure in the −Y direction, in the mounting state; and two guided elements configured such that at least respective parts of the two guide elements are fitted in the two guided elements, in a state that the liquid container is placed in the case; and a bag-like member that has flexibility and includes a containing portion therein to contain a liquid therein, the bag-like member having a leading end that is located on a +Y direction side of the bag-like member in the mounting state and that is held by the connection member, the leading end including depressions that are arranged to overlap with the two guided elements in the X direction in the mounting state, that are arranged to overlap with the two guided elements in the Y direction in the mounting state, and that are respectively indented along an inner circumferential surface of one of the two guided elements in a direction from the guided element toward the bag-like member, wherein in the mounting state, the liquid outlet is located between the two guided elements in the X direction, and the container-side electrical connecting structure is located between one of the two guided elements and the liquid outlet.

10. The liquid container according to claim 9, wherein in the mounting state, the two guided elements are located on the −Y direction side of the container-side electrical connecting structure and the liquid outlet.

11. The liquid container according to claim 10, wherein in the mounting state, the containing portion is located on the −Y direction side of the two guided elements.

12. The liquid container according to claim 10, wherein the container-side electrical connecting structure has a terminal portion that electrically comes into contact with the device-side electrical connecting structure, and the terminal portion is located on the +Z direction side of respective −Z direction side ends of the two guide elements and is pressed in at least the +Z direction by the device-side electrical connecting structure, in the mounting state.

13. The liquid container according to claim 9, wherein the liquid ejection device has two positioning elements that are provided in the case placement unit and that are extended from a +Y direction side end toward a −Y direction side end of the case placement unit, and the connection member of the liquid container is provided with two receiving portions configured to respectively receive the two positioning elements, wherein the two receiving portions are located at positions that are away from each other in the X direction across the liquid outlet in the mounting state, and each of the two receiving portions is arranged to at least partly overlap with either one of the two guided elements when being viewed in the Y direction in the mounting state.

14. The liquid container according to claim 9, wherein at least one of the guided elements is provided over a length in the Z direction of the connection member in the mounting state.

15. The liquid container according to claim 9, wherein the bag-like member has a supply port that is provided at a leading end of the bag-like member located on a +Y direction side of the bag-like member in the mounting state, that is arranged to communicate with the containing portion, and that is connected with the liquid introducing element via the liquid outlet, and the connection member includes a first member and a second member arranged to place and hold the leading end including the supply port therebetween in the Z direction in the mounting state.

* * * * *